US006559596B1

(12) United States Patent
Arai et al.

(10) Patent No.: US 6,559,596 B1
(45) Date of Patent: May 6, 2003

(54) GETTER, AIR TIGHT CHAMBER AND IMAGE FORMING APPARATUS HAVING GETTER, AND MANUFACTURING METHOD OF GETTER

(75) Inventors: Yutaka Arai, Atsugi (JP); Mitsutoshi Hasegawa, Yokohama (JP); Kazuya Shigeoka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/512,264

(22) Filed: Feb. 24, 2000

(30) Foreign Application Priority Data

Feb. 26, 1999 (JP) ..... 11-051545
Feb. 17, 2000 (JP) ..... 2000-039648

(51) Int. Cl.[7] ..... H01J 29/46
(52) U.S. Cl. ..... 313/553; 313/495; 313/558
(58) Field of Search ..... 313/333, 495, 313/558, 497, 554, 557, 461

(56) References Cited

U.S. PATENT DOCUMENTS

| | | | | |
|---|---|---|---|---|
| 3,584,253 A | 6/1971 | Wintzer | 313/180 |
| 4,312,669 A | 1/1982 | Boffito et al. | 75/177 |
| 4,972,116 A | 11/1990 | Tatsuda et al. | 313/422 |
| 5,223,766 A | 6/1993 | Nakayama et al. | 313/495 |
| 5,242,559 A | 9/1993 | Giorgi | 204/181.4 |
| 5,453,659 A | 9/1995 | Wallace et al. | 313/495 |
| 5,456,740 A | 10/1995 | Snow et al. | 96/11 |
| 5,936,342 A | 8/1999 | Ono et al. | 313/495 |

FOREIGN PATENT DOCUMENTS

| | | |
|---|---|---|
| EP | 0 660 357 | 6/1995 |
| JP | 46-39811 | 11/1971 |
| JP | 53-1141 | 1/1978 |
| JP | 63-181284 | 7/1988 |
| JP | 1-235152 | 9/1989 |
| JP | 4-12436 | 1/1992 |
| JP | 4-289640 | 10/1992 |
| JP | 5-151916 | 6/1993 |
| JP | 7-235255 | 9/1995 |
| JP | 9-82245 | 3/1997 |

OTHER PUBLICATIONS

A. Barosi, et al., "Zirconium–Aluminum Alloy as a Getter for High Intensity Discharge Lamps", Proc. 6$^{th}$ Internl. Vacuum Congr., Japan. J. Appl. Phys. Suppl. 2, pp. 49–52 (1974).

*Primary Examiner*—Vip Patel
*Assistant Examiner*—Ken A Berck
(74) *Attorney, Agent, or Firm*—Fitzpatrick, Cella, Harper & Scinto

(57) ABSTRACT

A getter which can maintain an absorption ability and secure sufficient characteristics even when a high-temperature low-vacuum is experienced in a process as compared with a conventional getter. The getter has an undulation on the surface, and is formed by depositing Ti or a composition mainly containing Ti or Zr or a base surface mainly containing Zr.

30 Claims, 25 Drawing Sheets

SECTIONAL VIEW

DIRECT VIEW (TOP VIEW) 10 μm

SECTIONAL VIEW

GETTER, AIR TIGHT CHAMBER AND IMAGE FORMING APPARATUS HAVING GETTER, AND MANUFACTURING METHOD OF GETTER

BACKGROUND OF THE INVENTION

1. Field of the Invention

The present invention relates to a getter which can physically and chemically absorb gas and a method of manufacturing the getter, and particularly to a getter which can maintain its performance for a long time even under an atmosphere in which getter performance is easily deteriorated and to a method of manufacturing the getter.

The present invention also relates to an airtight chamber which maintains a pressure that is equal to or less than an atmospheric pressure and to an image forming apparatus having the getter. Particularly, the image forming apparatus of the present invention is preferably used in the image forming apparatus which comprises: a vacuum chamber, an electron source; and an image-forming member for forming an image by irradiation of an electron beam emitted from the electron source.

2. Related Background Art

A substance which can physically and chemically absorb residual gases present in vacuo or in the atmosphere of inert gases or the like is usually referred to as the getter.

Preferable material used as the getter is a material having a high residual gas absorption rate, and being able to keep the absorption rate slow in order to keep the vacuum as long as possible in a system in which the material is disposed and to eliminate the influence of the residual gases in the atmosphere of inert gases or the like.

As the getter material, metal simple bodies of Ba, Li, Al, Zr, Ti, Hf, Nb, Ta, Th, Mo, V, and the like or alloys formed of the metal simple bodies are heretofore known.

Moreover, the getter for heating and evaporating the metal simple bodies or the alloy of the metal simple bodies in vacuo or in the atmosphere of inert gases or the like, and exposing a clean metal surface to chemically absorb a residual gases component in vacuo is called an evaporating getter, while a getter for the heating in vacuo or in the atmosphere of inert gases or the like to diffuse inwardly an oxide coat present on the surface, and exposing the metal surface to the top surface at every heating to absorb the residual gases in vacuo is called a non-evaporable getter.

The non-evaporable getter is formed of the metal simple body mainly containing zirconium (Zr), or titanium (Ti), or the alloy containing these metals, and a getter ability is usually obtained and used by forming a film of the metal or the alloy on a substrate of stainless, nichrome, or the like, and heating the substrate by energization heating and other means. For example, the manufacture method comprises: placing about 100 $\mu$m of a material powder to the substrate of stainless, nichrome, and the like by a rolling process, and the like; and calcining the substrate at a temperature of about 1000° C. in vacuo. This is performed in order to take a large reactive surface area by using the powder and effectively perform physical and chemical absorption.

In order to obtain the getter performance of the non-evaporable getter manufactured as described above, the vacuum, inert gases, and other atmospheres are used as the atmosphere in which the getter is disposed, and an active surface is formed and prepared for gas absorption by applying the heating operation (activation operation) to decompose and diffuse the surface oxide.

However, when the thin film of the metal simple body of Zr, Ti, and the like is formed on the substrate of stainless, nichrome, and the like by generally known means such as a vacuum evaporation process, a very stable oxide is formed on the surface of the formed film simultaneously with atmospheric exposure, and the heating to a high temperature of 800 to 900° C. in vacuo is necessary for removing the oxide film by diffusion to form the active surface (Japan J. Appl. Phys. Suppl. 2, Pt. 1, 49, 1974). Additionally, since after the activation operation the reaction of the simple body metal thin film and the residual gases in vacuo occurs usually at 200° C. or a higher temperature, the getter performance is hardly fulfilled around the room temperature.

Therefore, the non-evaporable getter can perform the activation operation at a lower temperature, and the getter material enables the getter function to be obtained at or near room temperature after the activation operation has been developed.

For example, the getter material of an alloy of 84 wt % of Zr-16 wt % of Al, disclosed in Japanese Patent Publication No. 46-39811, is a powder of a crushed alloy block obtained by melting Zr and Al (tradename: St-101, SAES Co. in Italy). When the Zr—Al alloy powder is used instead of the simple-body Zr powder, the surface oxide film can be diffused/removed at a low temperature, the particles can therefore be prevented from being sintered with one another, and a surface structure in which the surface area is relatively maintained is constructed. Moreover, the Zr—Al alloy is higher in safety than Zr which is highly reactive in the room-temperature atmosphere. It is disclosed that the weight ratio having a highest absorptivity is set to be Zr 84%-Al 16^ in SAES Co. by changing the weight ratio of Zr—Al in a range of Al 6 to 37% to prepare the alloy on trial and by comparing the getter characteristics (Proc. $4^{th}$ Int. Symp. on Residual Gases in Electron Tubes 221, 1972). However, the alloy does not have a high residual gases absorption rate, and has a problem that it takes much time to exhaust a large amount of gas at room temperature. To obtain a sufficient absorption rate from this alloy, the residual gases has to be absorbed by heating the activated alloy to 300° C. or a higher temperature.

Moreover, from the standpoint of prevention of reduction of the surface area by sintering the mixture of different types of powders, as disclosed in Japanese Patent Publication No. 53-1141, the getter material is obtained by mixing the simple-body metal powder of Zr, Ta, Hf, Nb, Ti, Th, U, and the like with the Zr—Al alloy powder, but the material has a disadvantage that a sufficient exhaust ability cannot be recognized in the room temperature.

Furthermore, U.S. Pat. No. 3,584,253 discloses a getter obtained by mixing Zr simple-body powder and graphite powder.

In this example, the alloy powder mixed with Zr powder has no getter ability or insufficient ability if any, and the main point is to sinter the powders with each other not to reduce the surface area. Therefore, since the alloy powder is added, the getter ability is deteriorated. If the alloy powder to mix is provided with the getter ability, the reduction of the surface area can be prevented, so that the deterioration of the getter ability can be avoided.

As the non-evaporable getter, as disclosed in U.S. Pat. No. 4,312,669, the non-evaporable getter material consisting of a three-element alloy of Zr, V, Fe, or Zr, Ni, Fe has been developed. The non-evaporable getter is obtained by mixing the Zr powder with the Zr—V—Fe alloy powder having the getter ability, or the Zr—Ni—Fe alloy powder so as to prevent the sintering of the powders. Additionally, the getter function is obtained even when activation occurs at a temperature lower than a conventional temperature because of the high reactivity (absorptivity) of the Zr—V—Fe alloy, or the Zr—Ni—Fe alloy.

However, in view of the material cost, it is unfavorable to use the alloy powder which causes many synthesis problems and which is difficult to form into powder. Moreover, it is troublesome and unfavorable to fix the mixed powder onto the base material by the rolling process or the like, sinter the materials in vacuo and further bond the materials. Moreover, since the getter function is obtained in the low temperature around the room temperature after the activation, the getter easily reacts, that is, the getter is quickly deteriorated. There is a disadvantage that desired characteristics cannot be maintained for a long time dependent on a use environment. For example, the member with the getter disposed thereon is subjected to a process in which a high temperature has to be obtained in a low vacuum atmosphere containing oxygen, moisture, and the like, and in this supposed situation, the desired characteristics cannot necessarily be maintained as occasion demands.

An image forming apparatus using the above-described getter will next be described.

In an apparatus in which a phosphor as an image-forming member is irradiated with the electron beam emitted from the electron source, and the phosphor is allowed to emit light to display an image, the inside of a vacuum chamber enveloping the electron source and the image-forming member has to be held in a high vacuum. When gas is generated inside the vacuum chamber, and pressure rises, influences differ with gas types, but the electron source is adversely affected, thereby lowering the electron emission amount, so that bright image display cannot be performed. Moreover, the generated gas is ionized by the electron beam to form an ion, accelerated by an electric field for accelerating the electron, and collides against the electron source to damage the electron source in some cases. Furthermore, electric discharge is caused inside, and the apparatus may be destroyed in certain cases.

The vacuum chamber of the image display is usually formed by combining glass members and bonding a combined part by a fritted glass, and the like. Once the bonding is completed, the pressure is maintained by the getter installed in the vacuum chamber.

As the material used as the getter, the material having a high absorption rate of the residual gases in vacuo and being able to keep the absorption rate long is preferable in order to keep the vacuum as long as possible in the system in which the getter is disposed.

As the getter, in a usual CRT, a deposition film is formed on a chamber inner wall by energizing or heating by a high frequency the alloy mainly containing Ba in the completely bonded vacuum chamber, and the gas generated inside is absorbed by the film to maintain a high vacuum. The getter like this Ba, which is evaporated by heating in vacuo to absorb the residual gases in vacuo with a clean metal surface, is usually referred to as the evaporating getter.

With respect to the usual CRT, at present, a plane type display has been advanced in development utilizing the electron source in which a large number of electron-emitters are disposed on a plane substrate. In this case, the volume of the vacuum chamber is reduced as compared with the CRT, but the area of the wall surface which generates the gases does not decrease. Therefore, when the gas is generated to the same degree as in the CRT, the pressure in the chamber largely rises, thereby exerting a serious influence onto the electron source.

Since the CRT has a characteristic shape, there is a sufficient wall surface part provided with neither electron source nor image-forming members such as the phosphors inside the vacuum chamber, and the above-described evaporating getter material can be deposited on the part. In the plane type display, however, most of the area of the vacuum chamber inner surface is occupied by the electron source and the image-forming member. When the above-described evaporating type getter film adheres to this part, adverse influences such as wiring short are generated. Therefore, a place where the getter film can be formed is limited to a place in which neither electron source nor image-forming member is disposed. Moreover, when the size of the plane type display increases to some degree, it is difficult to secure a sufficient area of the getter deposition film as compared with the gas emission amount.

To solve this problem, and to secure a sufficient getter deposition film area, in the plane type display, there are proposed: a method, as shown in FIG. 25A, comprising extending a wire getter outside an image display region between the phosphor and the electric field emitting device disposed opposite to each other in an envelope, that is, on an outer peripheral part, and depositing and forming the getter film on the wall surface of the outer peripheral part (Japanese Patent Application Laid-Open No. 5-151916); a method, as shown in FIG. 25B, comprising attaching a getter chamber having a getter material for forming a getter film to the side of the space between a face plate and a rear plate (Japanese Patent Application Laid-Open No. 4-289640); a method comprising forming a space between an electron source substrate and the rear plate of the vacuum chamber, and forming the getter film in the space (Japanese Patent Application Laid-Open No. 1-235152); and the like.

The problems of the gas generation inside the vacuum chamber in the flat panel display include the above-described problem, and a problem that the pressure easily rises locally. In the image display having the electron source and the image-forming member, inside the vacuum chamber, the gas is generated mainly in the image display region irradiated with the electron beam, and in the electron source itself.

In the conventional CRT, since the image-forming member is apart from the electron source, and between both the getter deposition film is formed on the inner wall of the vacuum chamber, the gas generated in the image display member is broadly diffused to reach the electron source, a part of the gas is absorbed by the getter film, and the pressure fails to rise excessively in the electron source. Moreover, since the getter film is also formed around the electron source itself, the excessive local pressure rise is not caused even by the gas emitted from the electron source itself.

In the flat panel display, however, since the image display member is close to the electron source, the gas generated from the image display member reaches the electron source before it is sufficiently diffused, thereby causing the local pressure rise. Particularly, in the middle part of the image display region, the gas cannot be diffused to the region with the getter film formed thereon, and it is therefore considered that the local pressure rise is remarkable as compared with the peripheral part. The generated gas is ionized by the electron emitted from the electron source, and accelerated by the electric field formed between the electron source and the image display member to damage the electron source or cause the electric charge, so that the electron source is destroyed in certain cases.

In view of this situation, in the flat panel display having a specific structure, the getter material is disposed in the image display region, and the gas generated in the image display region is immediately absorbed in the disclosed constitution.

For example, according to Japanese Patent Application Laid-Open No. 4-12436, in the electron source having a gate electrode for extracting the electron beam, a method of forming the gate electrode with the getter material is disclosed, and an electric-field emitting cathode using a conical protrusion as a cathode, and a semiconductor electron source having pn junction are illustrated.

Moreover, according to Japanese Patent Application Laid-Open No. 63-181248, in the plane type display with a structure in which an electrode (grid), and the like for controlling the electron beam are disposed between a cathode group and the vacuum chamber face plate, a method of forming the film of the getter material on the controlling electrode is disclosed.

Furthermore, U.S. Pat. No. 5,453,659 discloses that a getter member is formed in a gap between striped phosphors on the image display member (anode plate). In this example, the getter material is electrically separated from the phosphor and a conductor electrically connected to the phosphor, and the getter is activated by applying an appropriate potential to the getter to radiate/heat the electron emitted from the electron source, or by performing the energization heating of the getter.

Additionally, the plane type display having a simple structure and manufacture method is needless to say preferable from the standpoint of a production technique, manufacture cost, and the like. When the process of manufacturing the electron-emitter constituting the electron source is constituted of a thin film lamination and a simple processing, or when the large-size electron source is manufactured, the manufacture by the techniques, requiring no vacuum apparatus, such as a printing process is demanded.

In this respect, for the electron source disclosed in the Japanese Patent Application Laid-Open No. 4-12436 and having the gate electrode constituted of the getter material, the manufacture of the conical cathode chip, or the manufacture of the bonded semiconductor requires an intricate process in the vacuum apparatus, and the size enlargement is limited by the manufacture apparatus.

Moreover, in the apparatus in which the control electrode, and the like are disposed between the electron source and the face plate as disclosed in the Japanese Patent Application Laid-Open No. 63-181248, the structure is complicated, and the intricate processes such as the positioning of the members are required in the manufacture process.

Furthermore, in the method of forming the getter material on the anode plate as disclosed in the U.S. Pat. No. 5,453,659, the electric insulation needs to be taken between the getter material and the phosphor, and the getter material is formed by repeatedly performing patterning by a photolithography technique for a precise fine processing. Therefore, the process becomes intricate, and the size of the image display which can be manufactured is limited by the size of the apparatus for use in the photolithography.

With respect to the image displays, examples of the electron-emitter constituting the plane type display which can satisfy the above-described requirement of the easy manufacture process include a transverse electric field emitting device, and a surface conduction electron-emitter. The transverse electric field emitting type electron-emitter is formed by disposing the cathode having a protruded electron-emitting part on the plane substrate opposite to an anode (gate) for applying a high electric field to the cathode, and can be manufactured by thin film deposition processes such as deposition, sputtering, and plating, and the ordinary photolithography technique. Moreover, in the surface conduction electron-emitter, the electron is emitted by passing a current to the electroconductive thin film having a high resistance part, and one example is disclosed in Japanese Patent Application Laid-Open No. 7-235255 by the present applicant et al.

Since the electron source using the above emitters is not provided with the gate electrode shaped as disclosed in the Japanese Patent Application Laid-Open No. 4-12436, or the control electrode disclosed in the Japanese Patent Application Laid-Open No. 63-181248, the getter cannot be disposed in the image display region with the means similar to the disclosed means, and the getter is heretofore disposed outside the image display region. As described above, however, the gas generated in the image display region cannot efficiently be absorbed in the plane type display.

To solve the problem, Japanese Patent Application Laid-Open No. 9-82245 discloses that the getter is disposed in the image display region of the image display using the surface conduction electron-emitter. However, since a new wiring is necessary for activating the getter, the manufacture process becomes intricate. Since the getter is disposed in the vicinity of the electron-emitter, the electric conduction with the wiring or the electrode is feared. Additionally, since the evaporating Ba getter used as the getter on the wiring is formed by heating and evaporating the material stored in a container, the container is left after the evaporation, and the positioning of the Ba getter is necessary.

SUMMARY OF THE INVENTION

An object of the present invention is to realize a getter which has preferable characteristics.

One invention of the getter according to the present application is constituted as follows.

There is provided a getter which comprises a getter layer on a base surface containing at least one of Zr and Ti.

Here, the getter layer preferably contains at least a non-evaporable getter material, or the getter layer preferably contains at least Ti. Moreover, in the getter layer the evaporated materials are preferably deposited. Evaporating means include the heating of a material, and a sputtering process using a physical energy. Specifically, an electron beam deposition process, a jet printing process, and a sputtering process can be used. Additionally, here the jet printing process is a method of evaporating the material, conveying the material together with a conveying gas, and applying the material to an applied part.

Moreover, one invention of the getter according to the present application is constituted as follows.

There is provided a getter which comprises a getter layer on a base surface containing a non-evaporable getter material.

Here, the getter material on the base surface preferably contains at least one of Zr and Ti, and the getter layer preferably contains at least Ti.

In the above-described inventions, the base surface preferably has an undulation.

Moreover, in the above-described inventions, the base surface is preferably porous.

Furthermore, in the above-described invention, the base surface has an undulation, and the thickness of the getter layer is preferably smaller than the roughness of the undulation of the base surface.

Additionally, in the above-described inventions, the base surface is preferably formed by spray-coating a base surface composition.

Moreover, in the above-described inventions, the base surface is preferably formed by fixing a base surface composition powder to a base component by a adhesive material. Particularly, the adhesive material is preferably a hardened material by the bonding of a silicon atom and an oxygen atom, or the adhesive material is preferably formed by solidifying a liquid or gel adhesive. For example, concretely, the base surface is preferably obtained by mixing the adhesive with the powder containing at least the getter material to form a paste material, applying the material onto the base component, and calcining. The adhesive preferable for use is prepared by dissolving a ladder-like silicone-based oligomer in an organic solvent.

Moreover, the present application includes the invention of an airtight chamber which holds the inside to an atmospheric pressure or a lower pressure, and which comprises inside the getter according to any one of the above-described inventions.

Furthermore, the present application includes the invention of an image forming apparatus in which an electron source and an image-forming member for forming an image by irradiation of an electron from the electron source are disposed in an envelope holding the inside to an atmospheric pressure or a lower pressure, the image forming apparatus comprising: the getter according to any one of the above-described inventions in the envelope.

Here, the electron source may include a plurality of electron-emitters. A cold cathode device is preferably used as the electron-emitter. Particularly, a surface conduction electron-emitter is preferable.

Moreover, here, the invention of the above-described image forming apparatus can particularly preferably be applied to a constitution in which the electron source and the image-forming member substantially constitute planes, and are disposed opposite to each other.

Furthermore, the present application includes the following invention as the invention of a method of manufacturing the getter.

The method of manufacturing the getter comprises: a step of forming a base surface containing at least one of Zr and Ti; and a step of forming a getter layer on the base surface.

Additionally, the present application includes the following invention as the invention of the method of manufacturing the getter.

The method of manufacturing the getter comprises: a step of forming a base surface containing at least non-evaporable getter materials; and a step of forming a getter layer on the base surface.

In each invention of the method of manufacturing the getter, the base surface is preferably exposed to an atmosphere containing a substance to be absorbed by the base surface before the step of forming the getter layer on the base surface. This is because the substance absorbed by the base surface acts during the formation of the getter layer on the base surface and the state of the getter layer is set to be appropriate for the absorption. Particularly, the step of forming the getter layer on the base surface may comprise a step of evaporating and depositing the material to form the getter layer. Additionally, the exposure of the base surface to the atmosphere containing the substance to be absorbed by the base surface is preferably achieved, for example, by the exposure to the atmospheric air. Moreover, the exposure step is not limited to the step performed after the base surface is formed. The base surface may be formed in the atmosphere containing the substance to be absorbed.

Additionally, the airtight chamber of the present invention can be used as the envelope of image forming apparatuses such as a display using the electron-emitter, a plasma display, and a fluorescent display tube, or as the envelope of a vacuum tube. In the display using the electron-emitter, the fluorescent display tube, or the vacuum tube, the inside of the airtight chamber (envelope) is set to provide a high vacuum so that the emitted electron can reach the image-forming members such as phosphors, or the anode. The plasma display is different in that an electric discharge gas such as Ne, and Xe having the atmospheric pressure or a lower pressure is sealed, but is common in that the getter is used for absorbing an impurity gas in the chamber, so that the getter of the present invention is preferably used.

The image forming apparatus of the present invention can, as described above, take a form in which the image forming member is irradiated with an electron emitted from the electron-emitter in response to an input signal to form an image. Particularly, the image display in which the image-forming member is a phosphor can be constituted.

The electron-emitter can be provided with a passive matrix arrangement in which a plurality of cold cathode emitters are matrix-wired by a plurality of row-directional wirings and a plurality of column-directional wirings. Moreover, there can be provided a ladder-like arrangement in which a plurality of rows of cold cathode emitters are arranged by connecting opposite ends of a plurality of cold cathode emitters arranged in parallel (referred to as the row direction), and electrons from the cold cathode emitters are controlled by a control electrode (referred to also as the grid) arranged above the cold cathode emitters along a direction (referred to as the column direction) crossing at right angles to the row-directional wiring.

Furthermore, according to the idea of the present invention, the invention is not limited to the image display, and can also be used as a light-emitting source which is a substitute for a light-emitting diode of an optical printer constituted of a photosensitive drum, a light-emitting diode, and the like. Moreover, in this case, the invention can also be applied not only as the linear light-emitting source but also as a two-dimensional light-emitting source by appropriately selecting the above-described m row-directional wirings and n column-directional wirings. In this case, the image-forming member is not limited to the phosphor used in the following embodiment and other substances which directly emit light, and a member in which a latent image is formed by charging the electrons can also be used.

Moreover, according to the idea of the present invention, the present invention can also be applied, for example, to an electron microscope, in which the member to be irradiated with the electron emitted from the electron source is other than the image-forming members such as the phosphor. Therefore, the present invention can also take a form as a general electron beam apparatus in which the member to be irradiated is not specified.

DETAILED DESCRIPTION OF THE PREFERRED EMBODIMENTS

Figure 1A:
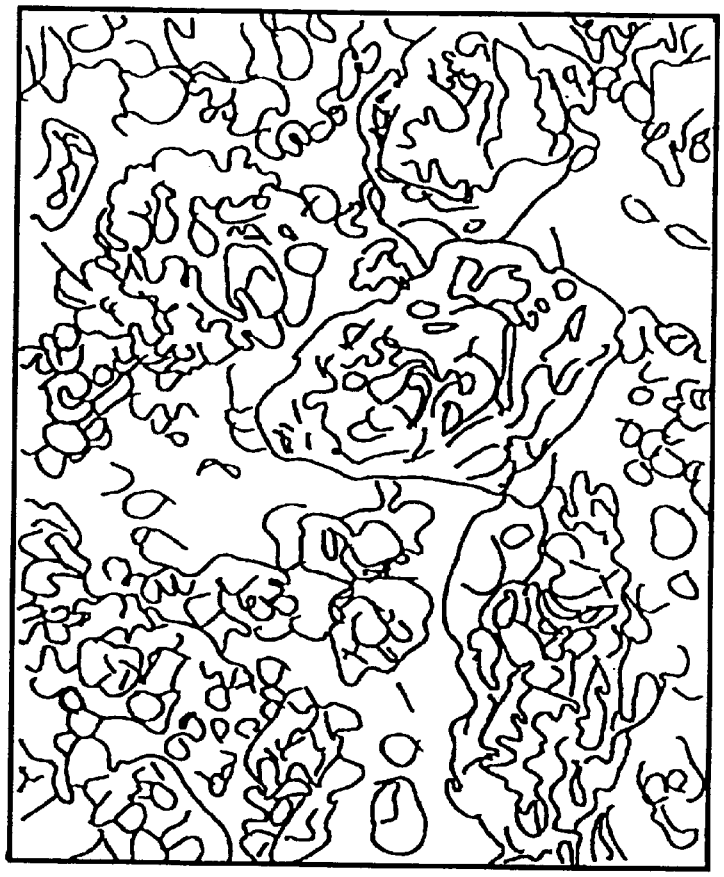
FIGS. 1A and 1B are schematic diagrams of electron microscopic photographs of a non-evaporable getter in which Ti is deposited on a base of a non-evaporable getter alloy mainly containing Zr.

Examples of concrete problems which can be solved by the following embodiments will first be described.

The above-described getter is used for various purposes, such as a plane type fluorescent lamp, a Braun tube, a vacuum bottle, and a flat panel display.

When the getter is used for this purpose, in the manufacture process, the getter itself has to be exposed to an atmospheric pressure or a vacuum degree close to the atmospheric pressure at a high temperature for a long time.

For example, in an image forming apparatus formed by attaching a glass plate having an electron source to a glass plate having an image-forming member disposed opposite to the glass plate, a getter material is disposed to keep the vacuum degree inside the attached glass plates. In this case, to bond two glass plates, a soft glass material called a fritted glass is used as an adhesive. The fritted glass contains a binder material consisting of organic substances, and in order to prevent the organic substances from forming an emission gas source in subsequent processes, the substances need to be evaporated by heating in an atmosphere in which oxygen is present.

However, for the heating in the atmosphere in which oxygen is present, with respect to the above-described non-evaporable getter, activation (=heating) for obtaining a getter function, and an action of absorbing the residual gases (oxygen, water, and the like) by the getter simultaneously take place, and the performance as the getter is remarkably deteriorated.

As means for solving the problem, there is provided a method of using the fritted glass from which the organic components are beforehand burnt/flied. However, since the binder is removed, the fluidity of the fritted glass is eliminated, and the glass is broken by a stress exerted during bonding in certain cases.

Moreover, developed as another means is a technique which comprises: attaching glasses with each other in vacuo; and evaporating the organic components contained in the fritted glass to bond the glasses with each other.

However, it is very difficult to position the electron source having a plurality of electron-emitters and the image-forming member disposed opposite to the electron source in vacuo.

On the other hand, as the getter whose absorption performance is not easily deteriorated even by heating in the atmosphere containing oxygen, a plurality of non-evaporable getters containing Ti have been manufactured/marketed by SAES GETTERS Co. These getters are called frittable getters, and SAES GETTERS Co. have declared that even after the heating in the atmosphere at 450° C. for one hour, the characteristics are not remarkably deteriorated.

The frittable getter is obtained by rolling and sintering a conventional non-evaporable getter powder mainly containing Zr, and a Ti powder on a base component such as a nichrome plate. In the getter manufactured in this method, the getter specific surface area decreases during the rolling, thereby deteriorating the absorbing rate. Moreover, since the non-evaporable getter powder mainly containing Zr is mixed with the Ti powder, Zr (or an alloy mainly containing Zr) having a higher reactivity than Ti to the atmosphere (oxygen) is present on the surface, and Zr on the surface is wastefully deteriorated by the heating in the atmosphere containing oxygen.

Moreover, as disclosed in U.S. Pat. No. 5,242,559, there is also proposed a manufacture method of attaching and sintering the non-evaporable getter mainly containing Zr and a $TiH_2$ powder onto the base component such as the nichrome plate by electrophoresis. The electrophoresis is a method of attaching the getter powder in a wet system, and is effective in that more surface area is obtained than in rolling, and the absorbing rate is not deteriorated. However, it is considered that much Zr (or the alloy mainly containing Zr) higher in reactivity than Ti to the atmosphere (oxygen) is present also on the surface, and Zr on the surface is wastefully deteriorated by the heating in the atmosphere containing oxygen. Moreover, in the electrophoresis method of attaching the getter powder in the wet system, since the wet system, that is, immersion in a liquid layer is performed, the getter prepared in this method cannot be applied in the process in certain cases.

Furthermore, the U.S. Pat. No. 5,456,740 discloses a three-layer structure getter in which a metal filter material is coated in a sandwich form centering on the getter. However, since the metal filter material is thick, and the sintering of 500 to 1000° C. needs to be repeatedly performed under a vacuum or an inactive atmosphere, the application to the process cannot be realized in certain cases.

As described above, a simple development of non-evaporable getter has been demanded which can maintain its absorbing ability as compared with the conventional non-evaporable getter, and can additionally secure sufficient characteristics even when a high-temperature low-vacuum state is experienced in the process.

The problem concerning the image display using the getter will next be described.

As a new getter disposition method in which residual gases molecules can be absorbed more efficiently than in the Japanese Patent Application Laid-Open No. 9-82245, there is newly proposed a method in which the non-evaporable getter is disposed in an image display region without requiring any container or requiring positioning. Different from the Ba getter (evaporating getter), in the non-evaporable getter, after bonding the image forming apparatus, the evaporation in vacuo for use is unnecessary, and the composition is usually Zr or an alloy mainly containing Zr.

The non-evaporable getter will further be described. For the non-evaporable getter, by applying an energy to the getter by means such as energization heating, metal oxide, carbide, nitride, and other coatings of the surface are diffused inside the getter, a metal surface is newly separated out on the surface, the getter can react with the residual gases in vacuo, and the vacuum degree is maintained. The operation of exposing the metal surface is referred to as the getter activation, and the getter can obtain the function of maintaining the vacuum by this operation. In view of the getter function, a larger surface area in contact with the gas is preferable, and in the construction in which the oxide, carbide, nitride, and the like on the metal surface are diffused inside to clean the metal surface, a powder having a certain degree of particle diameter is preferable.

As compared with the evaporating type, the conventional non-evaporable getter does not have a large difference in the ability of reacting with the residual gases in vacuo to maintain vacuum, but in the evaporating type, the interval between the getter and the opposite surface is preferably relatively long in order to gain the metal surface area by evaporating the metal on the opposite surface. On the other hand, the non-evaporable type has no such limitation. Moreover, in the non-evaporable type, after the residual gases is absorbed on the surface and the absorbing ability is saturated, by performing the activation again, the metal oxide, carbide, nitride, and the like on the surface are diffused inside again and the metal surface can newly be separated out, so that the repeated use can be realized in a range in which the activation is enabled. Additionally, the range in which the activation is enabled is governed by the environment in which the getter is used, and the activation is preferably performed in a higher vacuum.

Therefore, only by heating the non-evaporable getter to a certain temperature or a higher temperature in the atmosphere of a certain or higher vacuum degree, the getter is activated and provided with the absorbing ability, and even the emission gas in the image display region can sufficiently be absorbed.

As the place where the non-evaporable getter is disposed in the image display region, considered are the parts which do not directly contribute to electron emission, such as a part on the wiring connecting the electron-emitters and a part on the electrode, or the parts other than the electron-emitting part, having no fear of electric conduction (short).

Moreover, the getter can also be disposed in the periphery of the image display region, if the periphery is insulated from the extracting wiring, and the like.

As the getter disposition constitution, in view of the role as the getter, the disposition is preferably performed so as to occupy an area as large as possible in the envelope from the standpoint of vacuum maintenance, but in view of the cost and process intricacy, a case in which the non-evaporable getter is disposed only in the image display region, a case in which the non-evaporable getter is disposed only in the periphery of the image display region, and a case in which the non-evaporable getter is disposed both in the image display region and the periphery are considered in accordance with the size of the panel to be formed.

In the process of forming the envelope, the non-evaporable getter disposed in such site uses up the ability as the getter in the high temperature and low vacuum, and cannot sometimes fulfill its absorbing action after the vacuum chamber is formed. For example, when the glasses are bonded to each other by the fritted glass, and the like, a large amount of gas, such as the organic binder components generated by the molten fritted glass, is generated in the high-temperature process to waste the ability as the getter, and the getter exhaust rate cannot be kept for a long time in certain cases.

As a result, with the long use as the flat panel display, the luminance of the display lowers by the gas emitted in the envelope, and the pixel is sometimes destroyed to generate a part in which the image cannot be displayed. In view of this problem, in the image forming apparatus incorporating the conventional non-evaporable getter, the development of the getter whose ability fails to be deteriorated even in the high temperature and low vacuum has been demanded.

An embodiment of the present invention will be described hereinafter in detail with reference to the drawings.

Figure 2A:
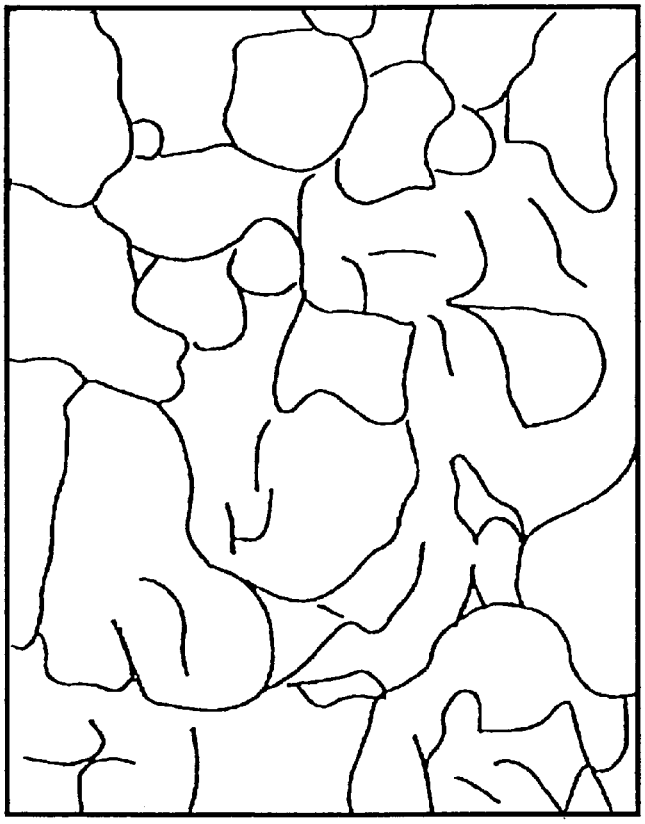
FIGS. 2A and 2B are schematic diagrams of electron microscopic photographs of the non-evaporable getter alloy which mainly contains Zr.
Figure 2B:
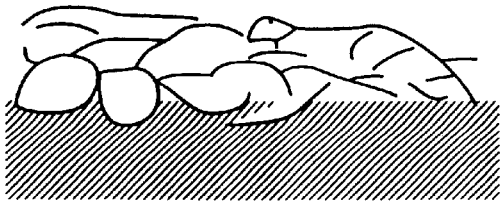

FIGS. 2A and 2B are diagrams schematically showing the state of the non-evaporable getter alloy mainly containing Zr (tradename: HS405, using the non-evaporable getter powder manufactured by Japan Getters Co.) observed by a scanning electron microscope (SEM), FIG. 2A is a plan view, and FIG. 2B is a sectional view. This getter is formed in a film on the nichrome substrate in a plasma spray coating process utilizing Ar plasma, and it is seen that the particles having diameters of about 20 to 40 $\mu$m are present with certain gaps.

Figure 1B:
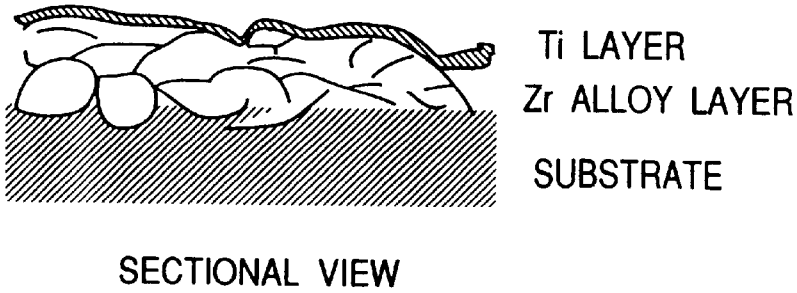

A state in which a film of Ti is formed in an electron beam deposition method on the non-evaporable getter alloy mainly containing Zr as shown in FIGS. 2A and 2B is schematically shown in FIGS. 1A and 1B. FIG. 1A is a plan view, and FIG. 1B is a sectional view. Although Ti is raised as if Ti grows in the periphery of the particles seen in FIGS. 2A and 2B, the voids of FIGS. 2A and 2B are entirely kept.

Figure 3:
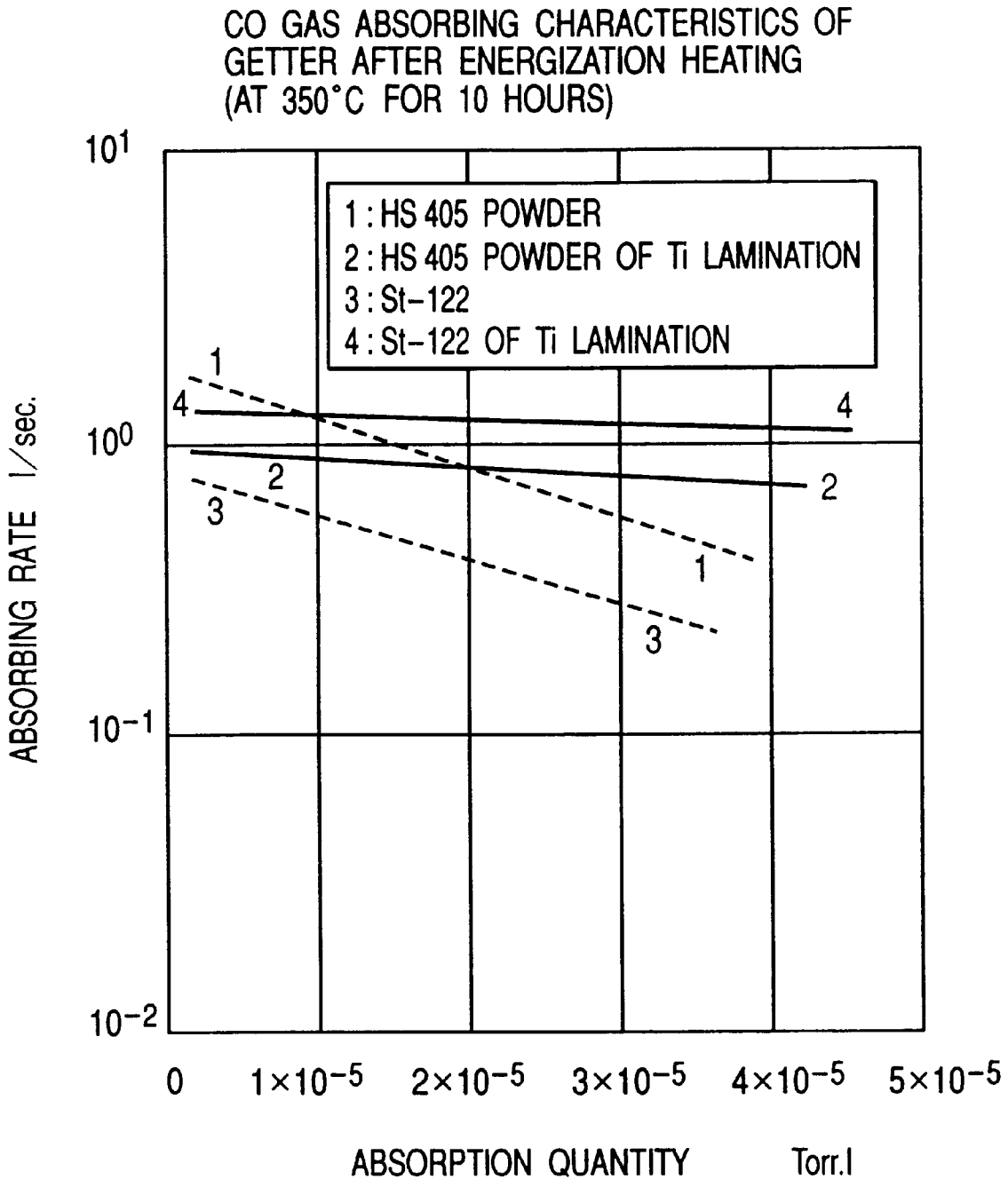
FIG. 3 is a comparison diagram of absorbing characteristics of the non-evaporable getter formed by depositing Ti on the non-evaporable getter alloy (HS405) mainly containing Zr, an HS405 alone, and a commercial non-evaporable getter St-122.

FIG. 3 shows a measurement result of the performance (absorbing characteristics) of the non-evaporable getter with Ti deposited thereon of FIGS. 1A and 1B per an arbitrary area. As compared with the master material only of the non-evaporable getter (HS405) mainly containing Zr, in the getter of the present invention, the inclination is moderate, and it is indicated that the absorbing rate is kept long, that is, the characteristics are scarcely deteriorated. Moreover, even as compared with the commercial non-evaporable getter (St-122) formed by mixing the non-evaporable getter mainly containing Zr and $TiH_2$ powder, the characteristics are found to be little deteriorated.

For the measurement result, not only in a case in which Ti is deposited on the non-evaporable getter formed in the film on the nichrome substrate and mainly containing Zr, but also in a case in which Ti is deposited on the sintered body of the non-evaporable getter particles mainly containing Zr, and in a case in which the non-evaporable getter particles mainly containing Zr are coated with Ti, similar results are obtained.

Moreover, FIG. 3 also shows the absorbing characteristics of a multilayered non-evaporable getter, in which Ti is deposited as a second metal or alloy layer by a vacuum evaporation process on the surface of the non-evaporable getter (tradename: St-122, manufactured by SAES Getters Co.) as a first metal or alloy layer consisting of a Ti—Zr—V—Fe alloy on the nichrome substrate. Although Ti of the second layer is contained in the first layer, the absorbing ability is higher than when only the first layer is formed.

Figure 4:
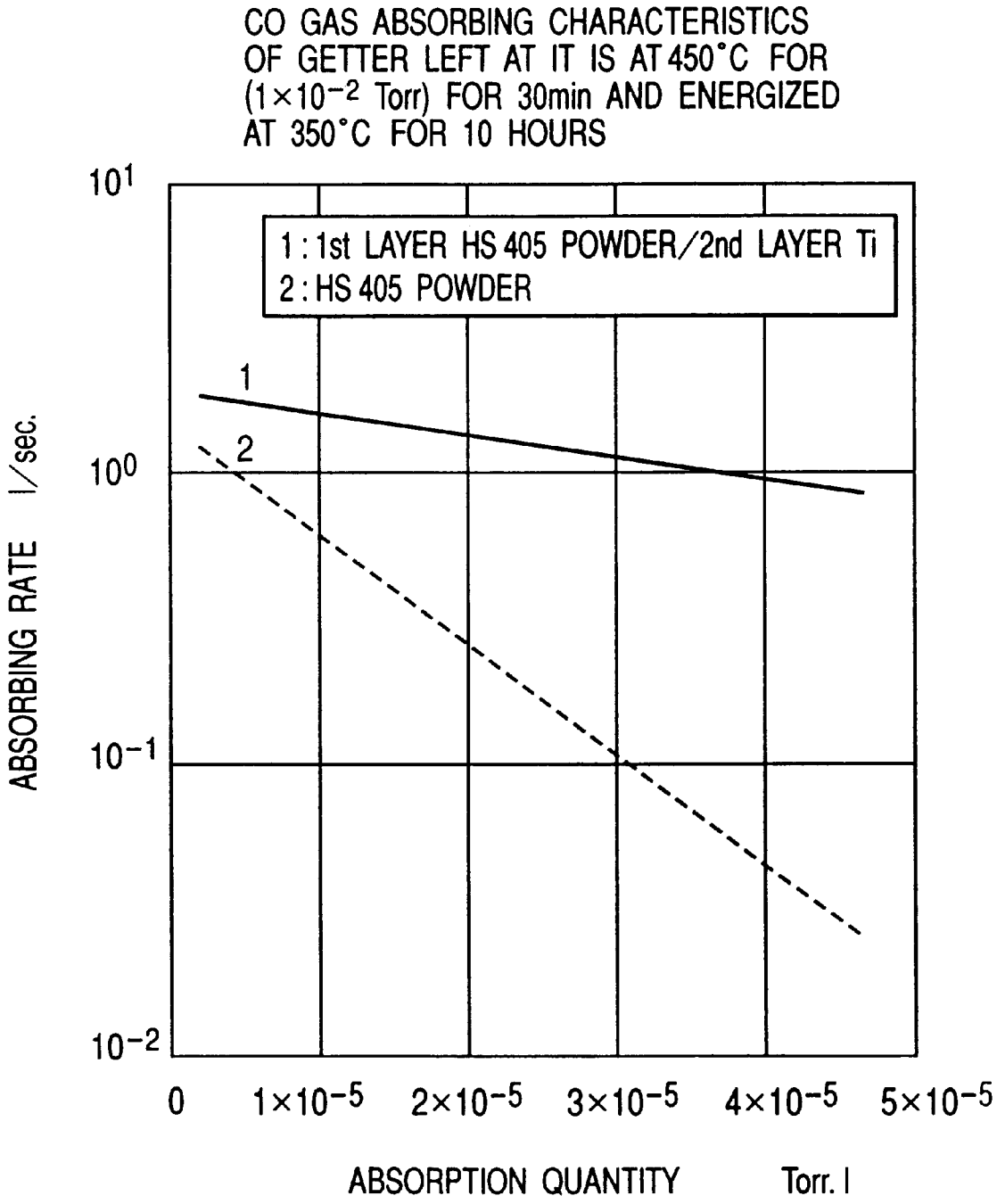
FIG. 4 is a diagram showing the comparison in the absorbing characteristics of the HS405 alone with the non-evaporable getter formed by depositing Ti on the non-evaporable getter alloy (HS405) mainly containing Zr and subsequently subjected to heating to 450° C. under an atmosphere of 1.33 Pa ($1\times10^{-2}$ Torr).

Furthermore, FIG. 4 shows that the non-evaporable getter obtained by forming Ti on the film of HS405 formed on the nichrome substrate by the vacuum evaporation process is heated to 450° C. on the condition of a high oxygen partial pressure, that is, under an atmosphere of 1.33 Pa ($1\times10^{-2}$ Torr), and subsequently the absorbing ability is compared. As shown in FIG. 4, the getter of the present invention maintains the absorbing rate longer than the conventional HS405, and boasts of a high absorption quantity.

For the reasons why the getter of the present invention can maintain a high vacuum in vacuo for a longer time than before, the deterioration of the characteristics is remarkably little even after the process of heating in the atmosphere as compared with the conventional non-evaporable getter, and the image forming apparatus of the present invention is less in the change of luminance (luminance deterioration) with the elapse of time and the occurrence of luminance dispersion with the elapse of time as compared with the conventional image forming apparatus, the present inventors et al. consider as follows so far.

Specifically, usually, when the reaction with the residual gases on the getter surface determines the rate, the initial gas absorbing rate and absorption quantity are proportional to the number of activation sites generated by the activation operation of the getter, and the subsequent absorbing rate depends on the diffusion rate of the gas absorbed into the getter material. Therefore, in the getter of the present invention, considering that there is a small difference in initial gas absorbing rate and absorption quantity and only the deterioration of the characteristics is little, it is considered that Ti present on the surface influences the diffusion of the absorbed residual gases.

Moreover, as a result, it is considered that in the image forming apparatus, the vacuum degree of the envelope constituting the image forming apparatus is remarkably enhanced as compared with the conventional art, and the influence of the residual gases on the electron source is reduced.

The image forming apparatus of the present invention will next be described.

In the basic form of the image forming apparatus of the present invention, the non-evaporable getter is disposed on the wiring connecting the respective electron-emitters on the substrate in which a plurality of surface conduction electron-emitters are arranged.

For the arrangement of the electron-emitters, various arrangements can be employed, but one example is a passive matrix arrangement. In the passive matrix arrangement, a plurality of electron-emitters are arranged in X and Y directions in matrix, one electrode of a plurality of electron-emitters disposed in the same row is connected in common to the X-directional wiring, and the other electrode of a plurality of electron-emitters disposed in the same column is connected in common to the Y-directional wiring. The electron source substrate in which the electron-emitters are disposed in the passive matrix will be described hereinafter in detail.

Figure 9:
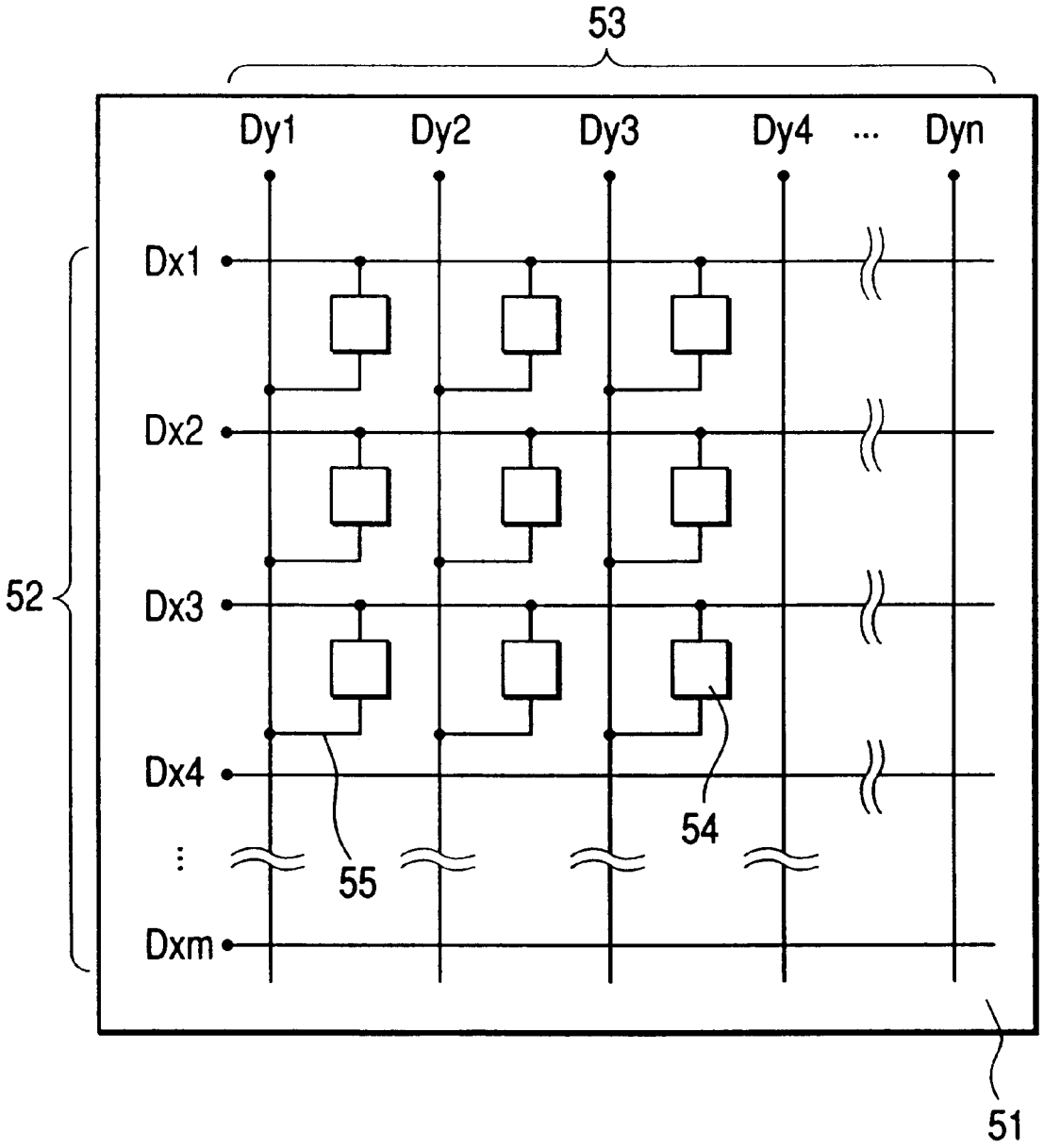
FIG. 9 is a schematic diagram showing an electron source in which a plurality of electron-emitters are matrix-wired.

FIG. 9 shows the electron source substrate in which the electron-emitters are subjected to the passive matrix arrangement. In FIG. 9, numeral 51 denotes an electron source substrate, 52 denotes an X-directional wiring, and 53 denotes a Y-directional wiring. Numeral 54 denotes an electron-emitter, and in this case, the surface conduction electron-emitter is described as an example, but the present invention is not limited to this. Moreover, numeral 55 denotes a connection.

The m X-directional wirings 52 are formed of Dx1, Dx2, . . . , Dxm, and can be constituted of a conductive metal, and the like formed using screen, offset, and other printing processes. The material, film thickness, and width of the wiring are appropriately designed. The Y-directional wiring 53 is constituted of n wirings Dy1, Dy2, . . . , Dyn, and formed in a similar manner as the X-directional wiring 52. An interlayer insulating layer (not shown) is disposed between the m X-directional wirings 52 and the n Y-directional wirings to electrically separate the wirings (m, n being both positive integers). Additionally, the X-directional wiring 52 and Y-directional wiring 53 are extracted as the respective external terminals.

The X-directional wiring 52 is connected to scanning signal applying means (not shown) to apply the scanning signal for selecting the row of the electron-emitters 54 arranged in the X direction. On the other hand, the Y-directional wiring 53 is connected to scanning signal applying means (not shown) to apply the scanning signal for selecting the respective columns of the electron-emitters 54 arranged in the Y direction. The drive voltage applied to each electron-emitter is supplied as a difference voltage between the scanning signal and modulating signal applied to the emitter.

In the above-described constitution, the individual elements are selected, and can individually be driven using the passive matrix wiring.

Figure 7:
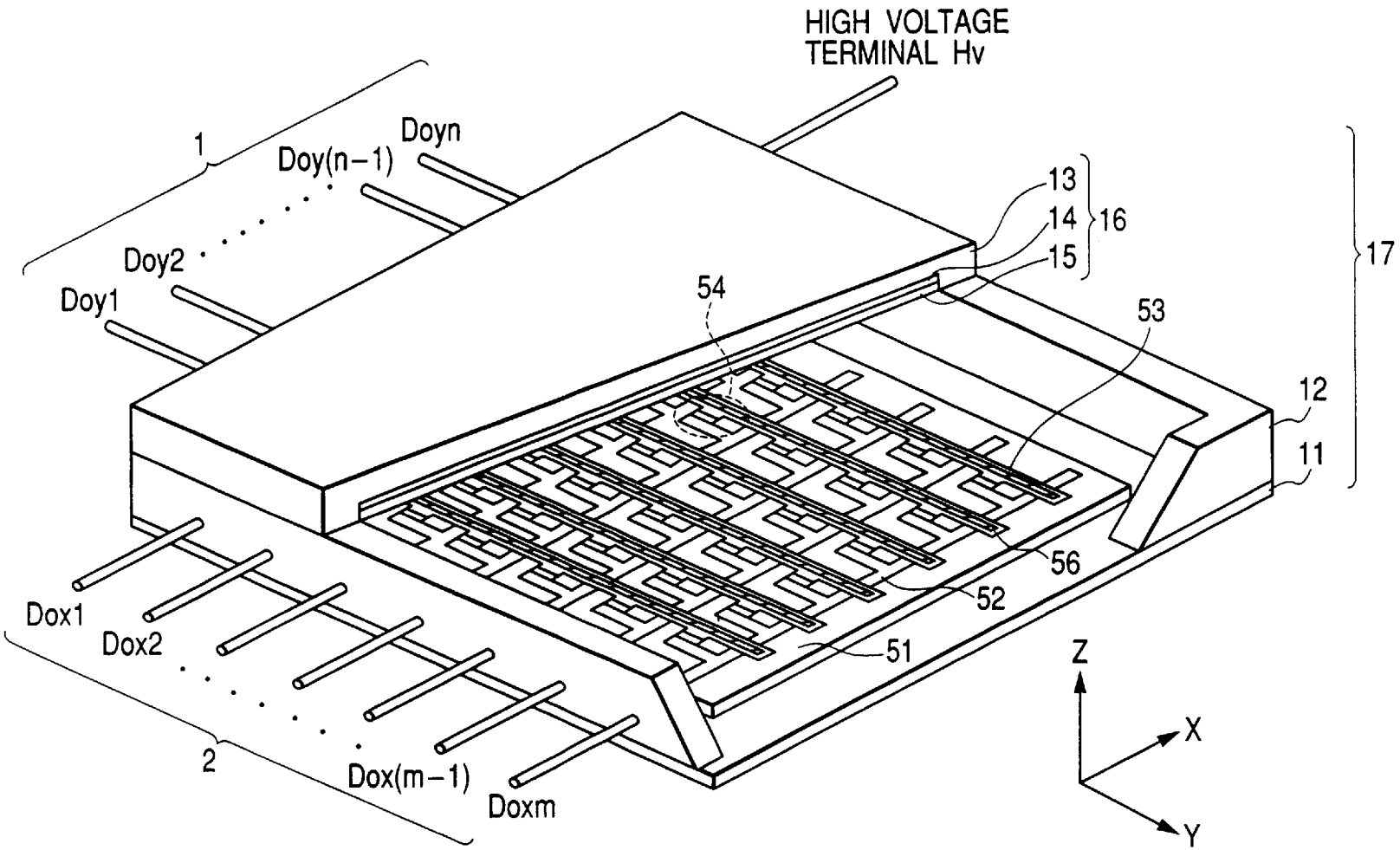
FIG. 7 is a partially cut perspective view showing the structure of an envelope according to a first embodiment of the image forming apparatus of the present invention.
Figure 8A:
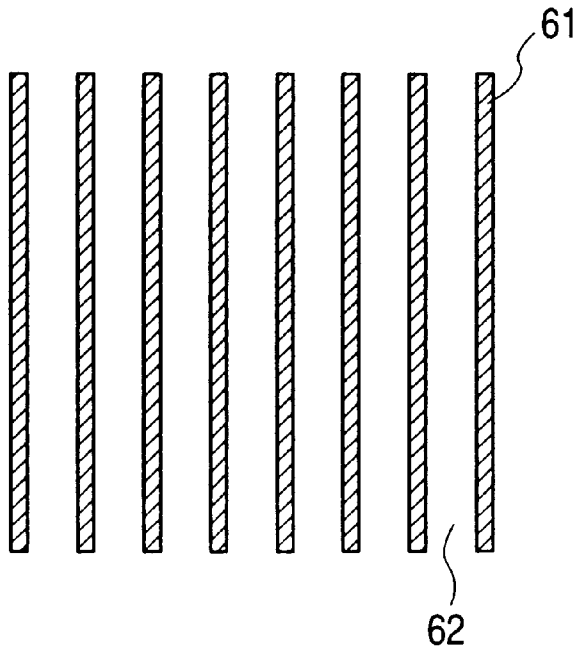
FIGS. 8A and 8B are explanatory views showing the structure of a fluorescent film.
Figure 8B:
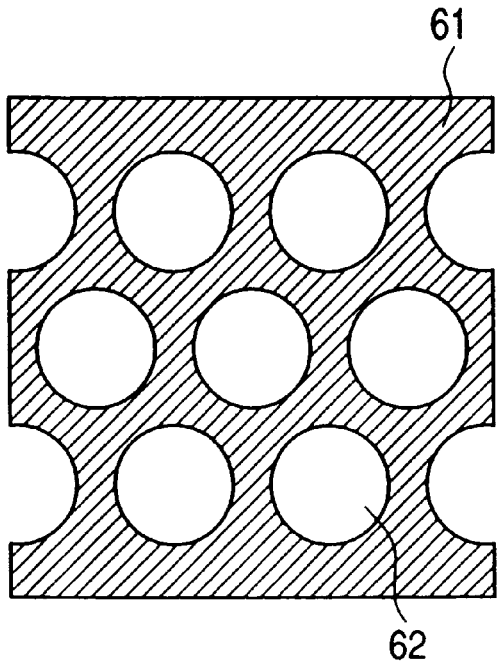
Figure 11:
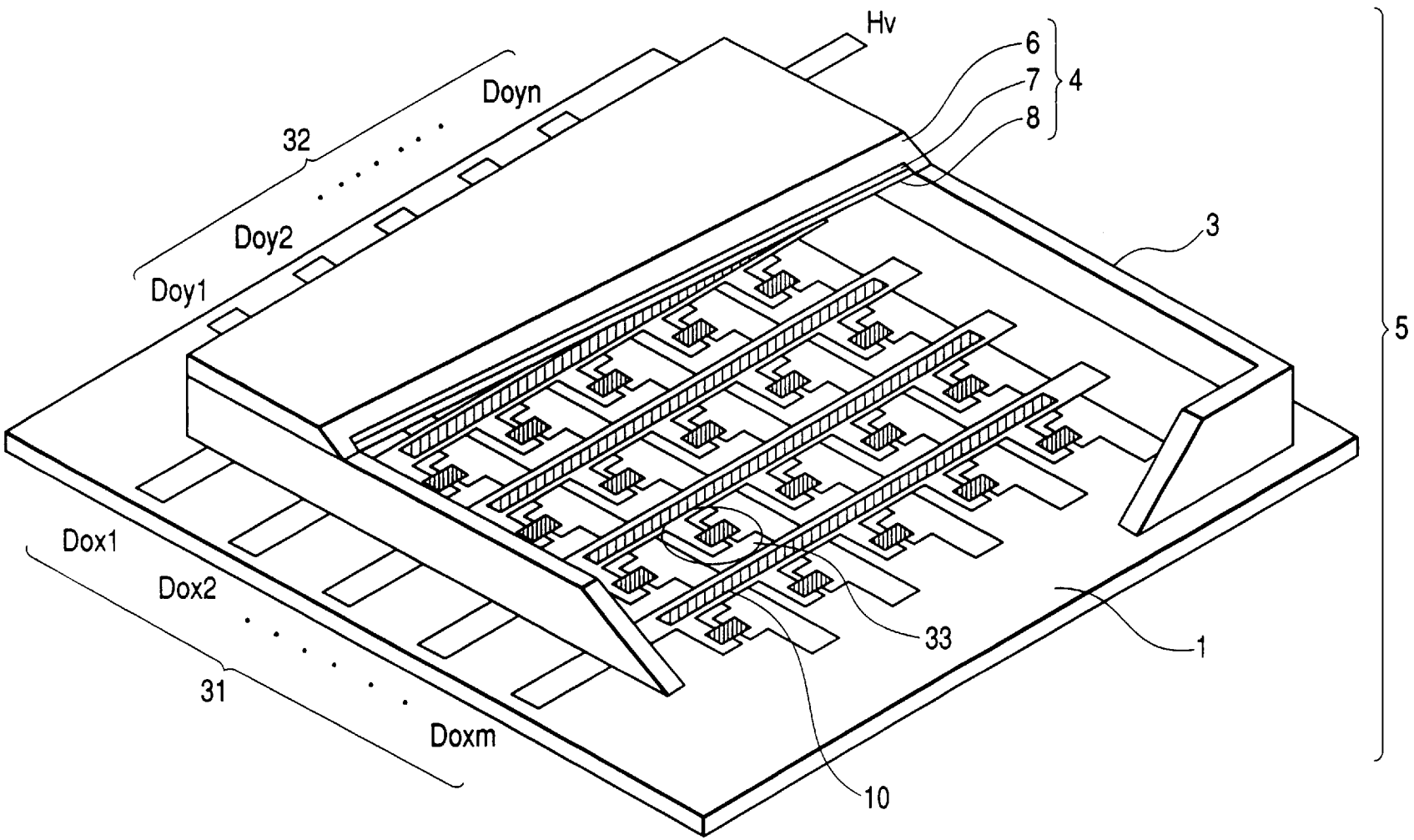
FIG. 11 is a diagram showing another constitution of the image forming apparatus of the present invention.
Figure 12:
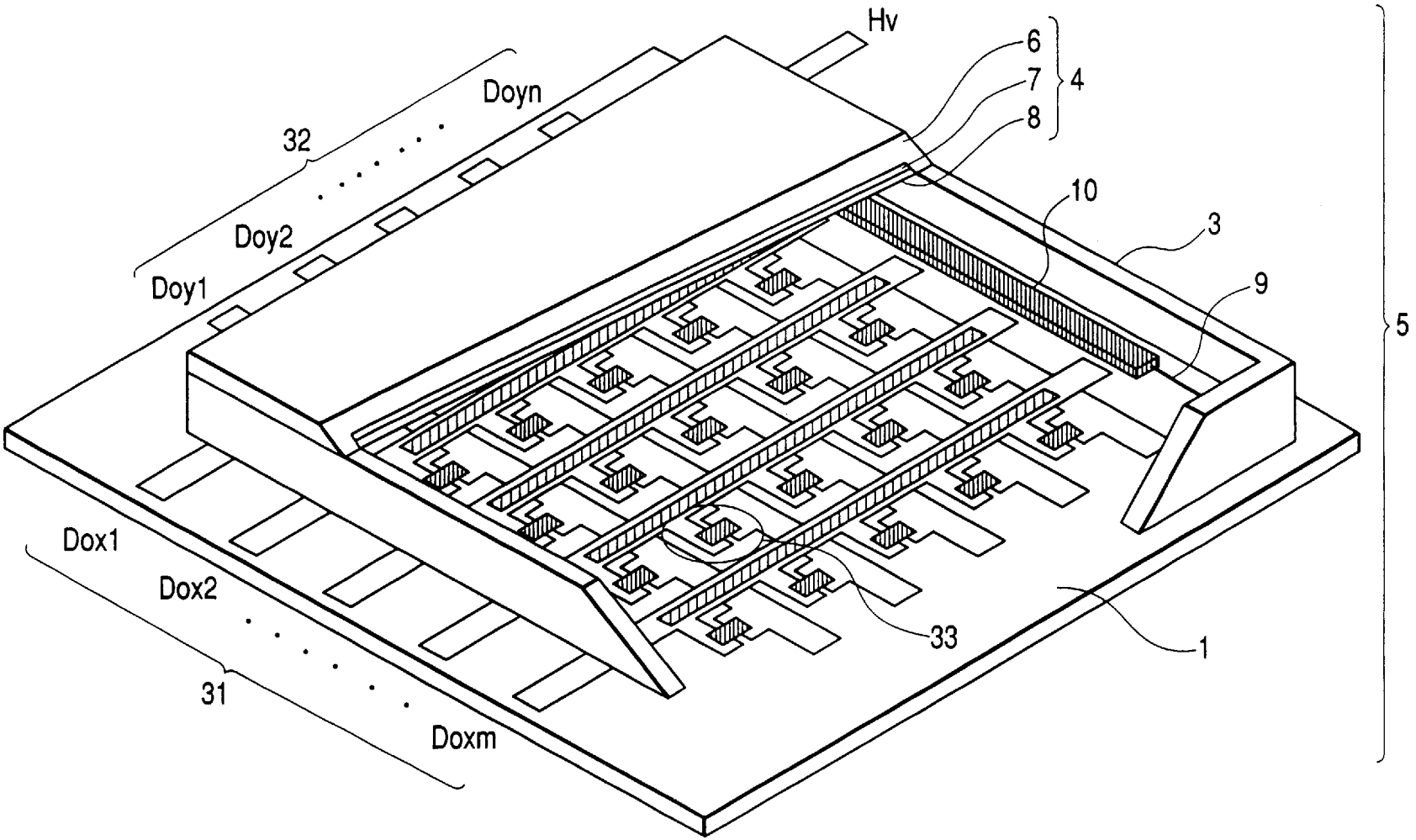
FIG. 12 is a diagram showing still another constitution of the image forming apparatus of the present invention.
Figure 13:
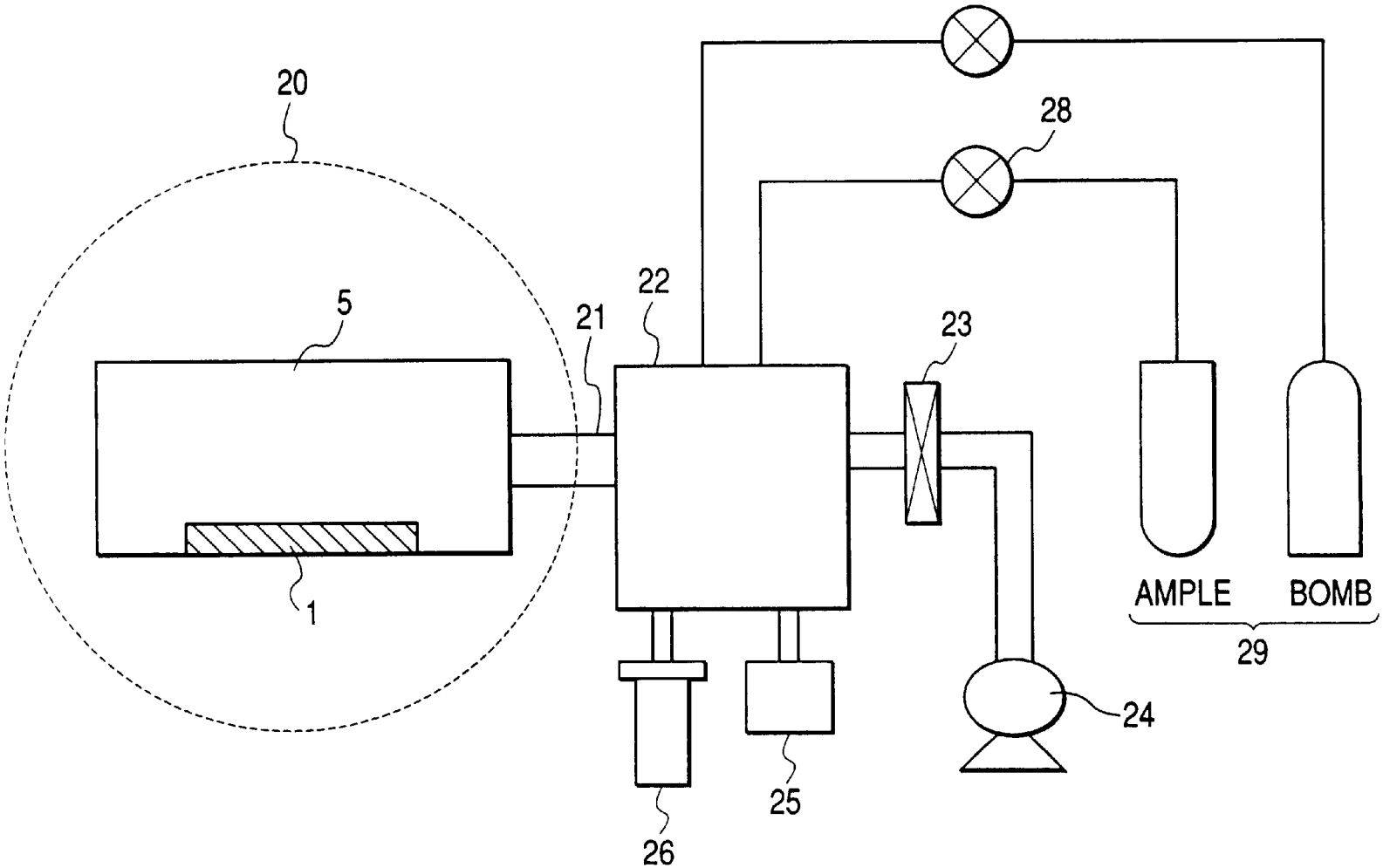
FIG. 13 is a schematic diagram showing the outline of a vacuum processor for use in the manufacture of the image display.
Figure 14:
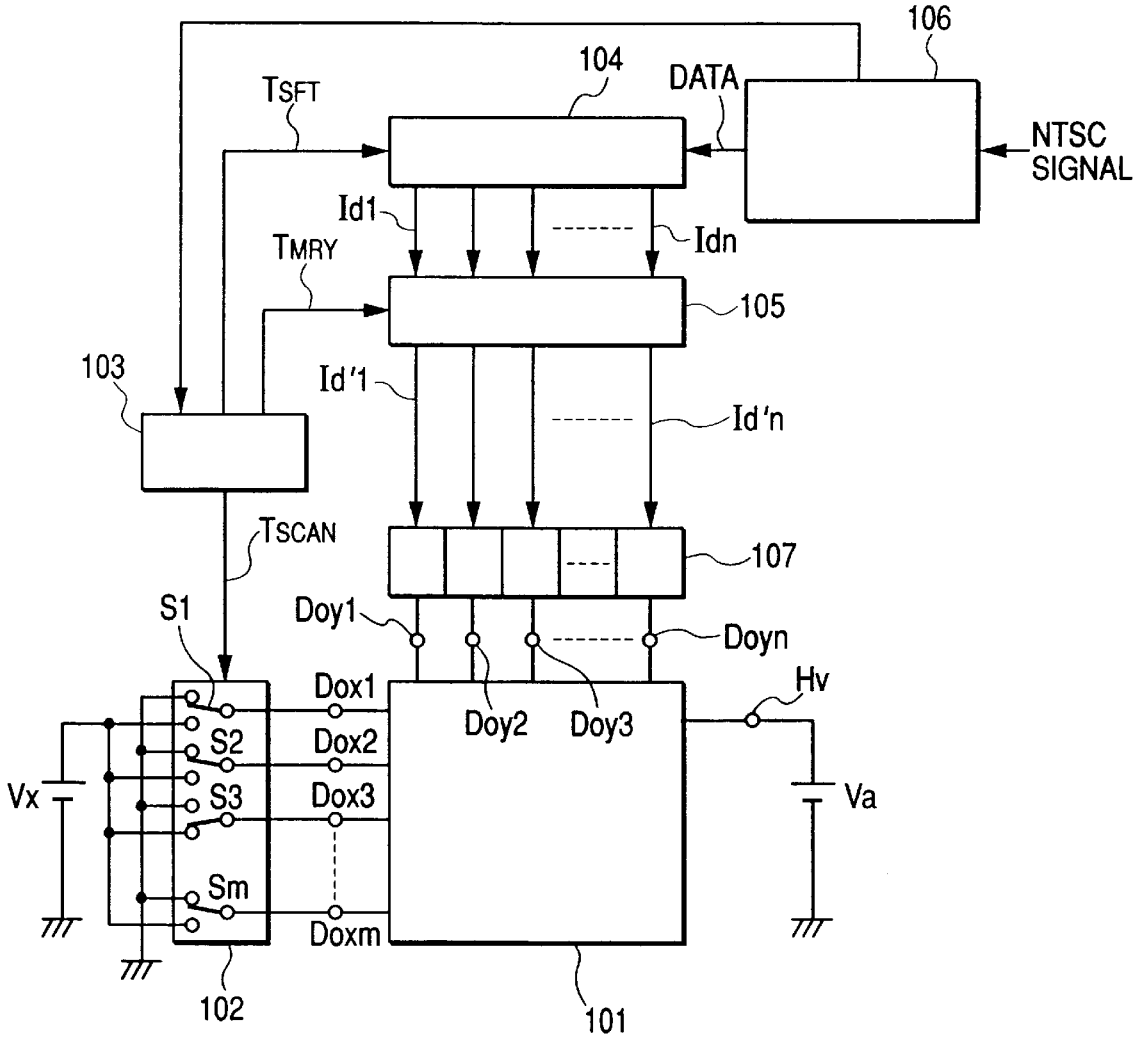
FIG. 14 is a block diagram showing the constitution example of a drive circuit for performing television display based on an NTSC system television signal by the image display constituted using the electron source with a matrix arrangement.

The image forming apparatus constituted using the electron source of the passive matrix arrangement will be described with referent to FIGS. 7, 8A, 8B, 10A, 10B, 11 to 14. FIG. 7 is a schematic view showing one example of the display panel of the image forming apparatus, and FIGS. 8A and 8B are schematic views of a fluorescent film for use in the image forming apparatus of FIG. 7. FIGS. 10A, 10B, 11 and 12 show the typical examples of the form which can be taken by the image forming apparatus incorporating the deposited non-evaporable getter, FIG. 13 is a block diagram showing the manufacture apparatus of the image forming apparatus, and FIG. 14 is a block diagram showing one example of a drive circuit for performing display in accordance with an NTSC system television signal.

In FIG. 7, numeral 51 denotes the electron source substrate in which a plurality of electron-emitters are arranged and is also referred to as the rear plate. When the electron source substrate 51 has an insufficient strength, a reinforcing plate 11 may be added, and in this case, the electron source substrate 51 and reinforcing plate 11 are referred to as the rear plate. Numeral 16 denotes a face plate in which a fluorescent film 14, a metal back 15, and the like are formed on the inner surface of the glass plate 13. Numeral 12 denotes a support frame, and the support frame 12 is bonded to the rear plate 51, and the face plate 16 using a low-melting fritted glass, and the like.

The bonding of the fritted glass is usually performed in a range of 400 to 500° C., which varies with the type. The bonding is mostly performed in the atmosphere in which oxygen is present (atmospheric air) to remove the binder components in the fritted glass, but this is not limited, and, for example, the bonding may be performed in a range of 400 to 500° C. in the inert gases atmosphere after the binder component is burnt beforehand around 300° C. (this operation is referred to as tentative calcining). In this case, the non-evaporable getter disposed on the electron source substrate necessarily experiences the temperature of 400 to 500° C., and is activated to obtain a function of absorbing gas.

Numeral 54 denotes the electron-emitter on the electron source substrate. Numerals 52, 53 denote X-directional wiring and Y-directional wiring connected to a pair of device electrodes of the electron-emitter.

An envelope 17 is constituted of the face plate 16, support frame 12, and rear plate 11 as described above. By installing a support member called a spacer (not shown) between the face plate 16 and the rear plate 11, the envelope 17 having a sufficient strength against the atmospheric pressure can be constituted.

A first embodiment of the getter of the present invention is formed as follows.

A non-evaporable getter 56 obtained by forming a film of Ti on the non-evaporable getter mainly containing Zr is disposed on the Y-directional wiring. In the forming method, first the layer of the non-evaporable getter mainly containing Zr is formed. For example, when the film of the non-evaporable getter mainly containing Zr is formed by the plasma spray coating process, a metal mask, a photosensitive material, and the like are used to apply masking before forming the layer, to prevent the electric conduction of the wiring and electrode and the destruction of the device constituting member.

Furthermore, while the masking is applied, the film of Ti is formed in the vacuum evaporation process. The vacuum evaporation process includes not only an electron beam deposition process, but also sputtering, and resistance heating, and the film forming process is not limited as long as the film of Ti can be formed.

Additionally, the non-evaporable getter is sometimes installed on the X-directional wiring 52 and Y-directional wiring 53 at the same time, and in this case, the layer of the non-evaporable getter is formed by making openings both in the X-directional wiring and Y-directional wiring, and masking the other parts.

Moreover, another embodiment of the getter of the present invention is formed as follows.

The non-evaporable getter 56 is disposed on the Y-directional wiring 53. The powder of Zr or the non-evaporable getter mainly containing Zr is bonded to the Y-directional wiring using the adhesive material.

In this case, the powder of the non-evaporable getter preferably has an average particle diameter of several micrometers or more so that the surface is sufficiently cleaned by the internal diffusion of the oxide, carbide, and nitride on the metal surface during the getter activation.

Since the non-evaporable getter requires the ability of absorbing the emitted gas during the driving of the electron source, it is undesirable to absorb the gas in the high temperature during the activation process of the non-evaporable getter before the driving and deteriorate the absorbing ability.

Therefore, the adhesive material preferably has little gas emission in the high temperature during the getter activation.

Moreover, for the non-evaporable getter a larger surface area of the metal surface as the getter is preferable, and it is preferable that the adhesive material cannot easily cover the surface of the metal powder as the getter and the bonding can be performed with a small amount. Examples include a silicon-based inorganic adhesive for adhesion with the polymerization reaction of silicon.

Subsequently, the film of Ti is formed on the powder of the non-evaporable getter bonded with the adhesive material. The film thickness of Ti is preferable of the order of several angstroms to several micrometers on the conditions of the non-evaporable getter deterioration factors such as the surface shape of the bonded non-evaporable getter part, and the temperature and vacuum degree during sealing described later.

Moreover, after the film of Ti is formed beforehand on the powder of the non-evaporable getter, the powder may be formed on the wiring with the adhesive.

FIGS. 8A and 8B are schematic views showing the fluorescent film. The fluorescent film 14 can be constituted only of the phosphor for monochrome. The color fluorescent film can be constituted of a black conductive material 61 and phosphor 62 called a black stripe or a black matrix by the arrangement of phosphors. In the color display, the purposes of disposing the black stripe or the black matrix are not to clearly show the mixed color by blackening a paint dividing part between the respective phosphors 62 of three primary color phosphors, and to suppress a drop in contrast by external light reflection in the fluorescent film 14. As the material of the black stripe, in addition to the usually used material mainly containing graphite, the material having a conductivity and little light transmission or reflection can be used.

In order to further enhance the conductivity of the fluorescent film 14, the face plate 16 may be provided with a transparent electrode (not shown) on the outer surface of the fluorescent film 14.

To perform the above-described sealing, in the color display, the respective color phosphors and electron-emitters need to be matched, and a sufficient positioning is indispensable.

One example of the method of manufacturing the image forming apparatus shown in FIG. 7 will be described hereinafter.

By combining various methods such as a printing method and a photolithography method to form an electrode and a wiring pattern on a glass substrate, and arranging electron-emitting materials, the electron source substrate (rear plate) 51 provided with a plurality of electron-emitters is formed. On the formed electron source substrate, a plasma spray coating process and a vacuum evaporation process are used to form the layered non-evaporable getter 56 on the matrix wiring.

Moreover, another embodiment of the electron source substrate is formed as follows. By combining various methods such as the printing method and the photolithography method to form the electrode and wiring pattern on the glass substrate, and arranging the electron-emitting materials, the electron source substrate (rear plate) 51 provided with a plurality of electron-emitters is formed. On the formed electron source substrate, the paste obtained by dissolving the non-evaporable getter powder in the organic solvent and mixing with the above-described liquefied or gelled silicon-based inorganic adhesive is applied to the matrix wiring using the dispenser or the printing process.

The silicon-based inorganic adhesive is bonded by the polymerization reaction of silicon and oxygen atoms, and the polymerization reaction rate is accelerated in high temperatures. Moreover, since the organic solvent as the solvent of the adhesive is evaporated, calcining is preferable after the applying. In this case, since the getter is activated possibly to absorb the gas originated from the members during the calcining and deteriorate the getter ability, the calcining is performed in vacuo of $1.33\times10^{-4}$ Pa ($1\times10^{-6}$ Torr) or less or in an inert gases. Moreover, in view of the vaporization temperature of the solvent, the temperature for calcining the above-described paste is determined.

Subsequently, the film of Ti is formed on the non-evaporable getter powder bonded by the adhesive material.

After the photolithography, and the masking using the metal mask in which the site with the non-evaporable getter bonded thereto is opened, the film is formed by the sputtering or the electron beam deposition. Additionally, a direct drawing jet print process without using the plasma spray coating process or the mask, and other processes can be used.

The non-evaporable getter is formed on the Y-directional wiring as described above.

Additionally, the above-described patterning of the non-evaporable getter powder and adhesive is not limited to the dispenser or the printing, and by using the metal mask and photosensitive material to apply the masking, coating the wiring part and entire surface, further forming the film of Ti, and peeling the masking, the formation can be realized.

Moreover, in addition to the installation on the Y-directional wiring, and simultaneously with the installation on the Y-directional wiring, the non-evaporable getter may be installed on the X-directional wiring 52 and the image display region peripheral part, and in this case, the non-evaporable getter is applied and formed by drawing the desired pattern with the dispenser or the printing process, or making the desired opening and masking the other part.

On the other hand, by disposing not only the phosphor but also the image-forming member on a separate glass substrate, the face plate 16 is formed. The envelope 17 is formed by the above-described rear plate 51, support frame 12, and face plate 16. These structure members are bonded using the fritted glass in vacuo or in the inert gases in a range of about 400 to 500° C., so that the envelope 17 is formed.

In the present example, the non-evaporable getter is formed on the wiring in the image display region, but the above-described method and process can be used also when the getter is formed in the periphery of the image display region outside the image display region, in the vicinity of the support frame, or on the face plate.

Thereafter, the inside of the envelope 17 is once evacuated (vacuum forming process), and a necessary treatment is applied to the electron source formed of a plurality of electron-emitters, so that electrons can be emitted. When the electron-emitter is a surface conduction electron-emitter, by performing the treatment disclosed in the Japanese Patent Application Laid-Open No. 7-235255 (electron source activation process), and applying a necessary voltage, the electron is emitted from the electron source. Subsequently, a sufficient vacuum is secured inside the envelope 17 by the evacuation and heating degassing (baking process). In this case, by the heating degassing process, the non-evaporable getter 56 disposed on the electron source substrate is activated, and the gas absorbing function is obtained. Thereafter, a vacuum exhaust tube (not shown) is further heated with a burner and sealed. Subsequently, the getter activation operation may be performed anew, and in this case, the non-evaporable getter 56 is activated by the thermal treatment of 250° C. or more.

The representative example of the form which can be taken by the image forming apparatus incorporating the non-evaporable getter will next be described in more detail with reference to the drawings.

Figure 10A:
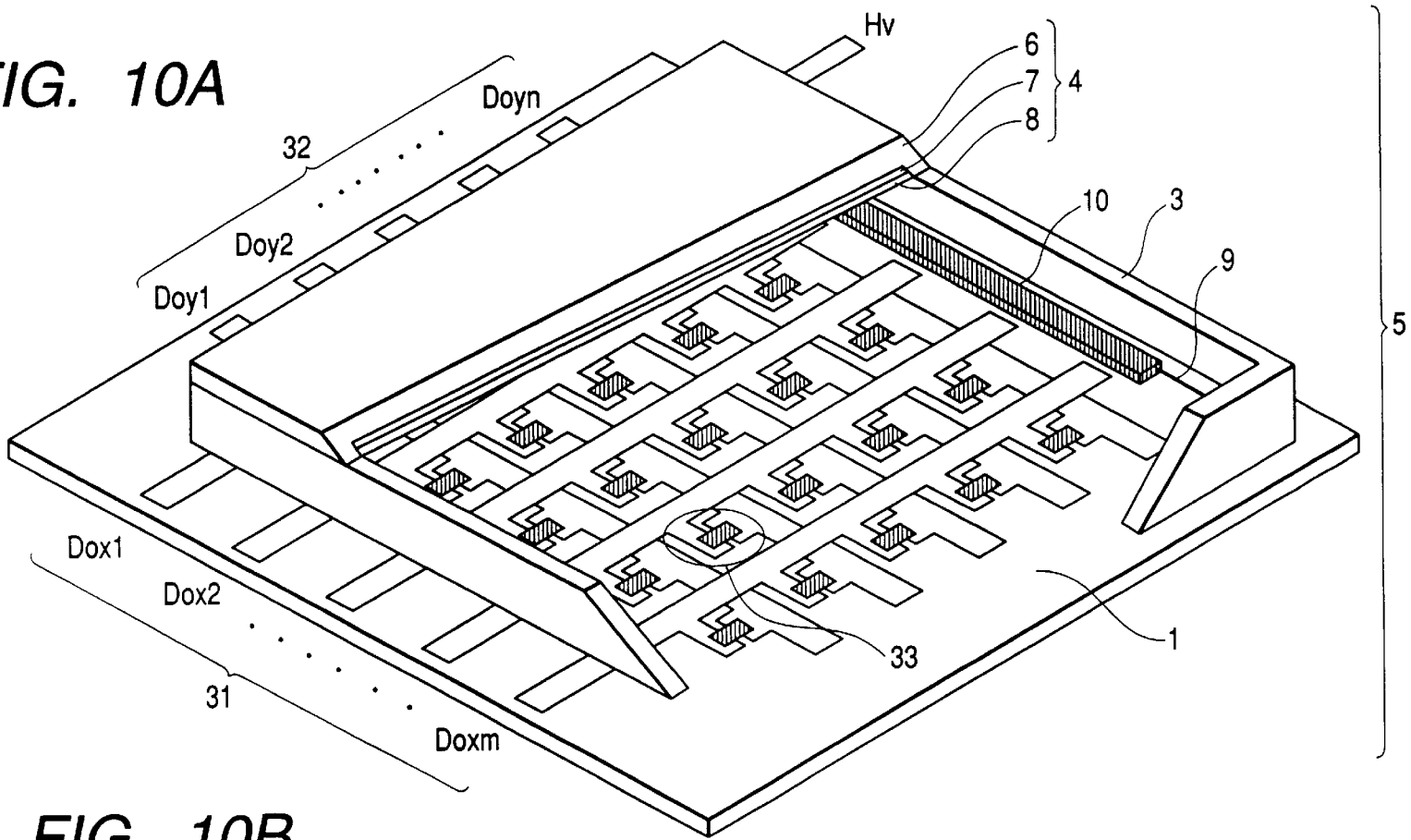
FIGS. 10A and 10B are diagrams showing the constitution of the image forming apparatus of the present invention and one form of the non-evaporable getter.
Figure 10B:
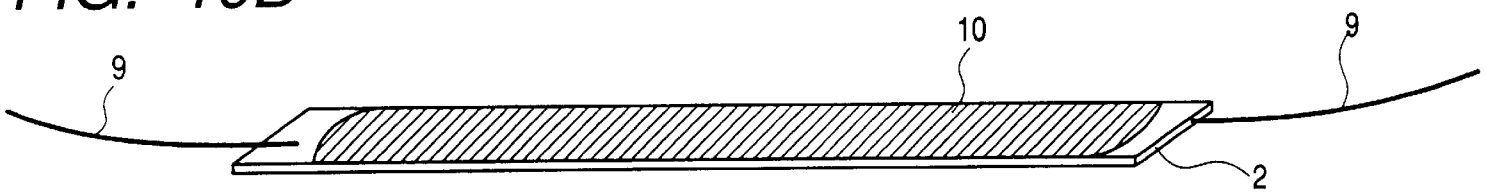

In a first example of the form which the present invention can take, the non-evaporable getter disposed on the base component such as the nichrome plate is installed outside the image display region of the image forming apparatus. FIG. 10A is a schematic view of a plane type image forming apparatus in which the non-evaporable getter is disposed. In FIG. 10A, an electron source substrate 1 is provided with a multiplicity of electron-emitters 33, and forms an envelope 5 together with a support frame 3 and a face plate 4. Additionally, the constitution of the electron source substrate 1 will be described later. In the face plate 4, a fluorescent film 7 and a metal back 8 are formed on a glass base 6. In the structure, a row selecting terminal 31 and a signal input terminal 32 can be extracted to the outside of the envelope 5, the electron-emitter 33 can be driven by applying a signal via the terminals, and the emitted electron is accelerated by a high voltage terminal Hv and allowed to collide against the fluorescent film 7, so that the image is displayed. In a range of the face plate 4 in which the fluorescent film 7 and metal back 8 are present, the part against which the electron collides is a so-called image display region. As shown in FIG. 10B, a non-evaporable getter 10 is formed on the nichrome substrate 2, and fixed to the support frame 3 together with the nichrome substrate using a getter support member 9. Additionally, in FIG. 10A, the non-evaporable getter is drawn only on one side outside the image display region, but may be drawn on any one of four sides outside the image display region, or on a plurality of arbitrary sides among the four sides.

A second example of the form which the present invention can take has been described with reference to FIG. 7, and the non-evaporable getter is directly formed on the member in the image display region. The example will be described with reference to FIG. 11. In FIG. 11, the members denoted by the same reference numerals as those of FIGS. 10A and 10B are the same members. FIG. 11 illustrates a constitution in which the non-evaporable getter 10 is disposed on the X-directional wiring in the image display region. In this case, the non-evaporable getter 10 as the conductive substance adheres to the desired plate (other than the wiring part here), the short is caused, and attention is therefore necessary during the forming. For example, after preparing the metal mask provided with the wiring-shaped openings, and performing the sufficient positioning, the non-evaporable getter is formed using the plasma spray coating process and electron beam deposition process in a combined manner.

In an example 3 of the form which the present invention can take, the non-evaporable getter is disposed inside and outside the image display region of the image forming apparatus. FIG. 12 illustrates that the non-evaporable getter 10 is disposed on one side outside the image display region and on the X-directional wiring in the image display region. In FIG. 12, the getter is drawn only on one side outside the image display region, but may be drawn on any one of four sides outside the image display region, or on a plurality of arbitrary sides among the four sides. Moreover, the non-evaporable getter 10 installed in the image display region is formed with due attention to prevent the short from occurring as described above.

The method of manufacturing the image forming apparatus shown in FIG. 12 as the example will next be described.

First the envelope 5 shown in FIG. 12 is formed. For the arrangement of the electron-emitters of the electron source substrate 1 constituting the envelope 5, various arrangements can be employed.

In the electron source substrate of FIG. 12 the passive matrix arrangement is illustrated as the arrangement of the electron-emitters. In the passive matrix arrangement, a plurality of electron-emitters are arranged in X and Y directions in matrix, one electrode of a plurality of electron-emitters disposed in the same row is connected in common to the X-directional wiring, and the other electrode of a plurality of electron-emitters disposed in the same column is connected in common to the Y-directional wiring.

In the electron source substrate of FIG. 12, m X-directional wirings are formed of Dx1, Dx2, . . . , Dxm, and can be constituted of a conductive metal, and the like formed using the vacuum evaporation, printing, sputtering, and other processes. The material, film thickness, and width of the wiring are appropriately designed. The Y-directional wiring is constituted of n wirings Dy1, Dy2, . . . , Dyn, and formed in a similar manner as the X-directional wiring. An interlayer insulating layer (not shown) is disposed between the m X-directional wirings and the n Y-directional wirings to electrically separate the wirings (m, n being both positive integers).

The interlayer insulating layer (not shown) is constituted of $SiO_2$, and the like formed using the vacuum evaporation, printing, sputtering, and other processes. For example, a desired shape is partially formed on the entire surface of the electron source substrate 1 on which the X-directional wiring is formed, and the film thickness, material, and manufacture process are appropriately set particularly to withstand the potential difference of the crossing part of the X-directional wiring and Y-directional wiring. The X-directional wiring and Y-directional wiring are extracted as the respective external terminals 31, 32.

A pair of electrodes (not shown) constituting the electron-emitter 33 are electrically connected to the m X-directional wirings and n Y-directional wirings by the connection constituted of the conductive metal, and the like.

In the above-described constitution, individual emitters are selected, and can independently be driven using the passive matrix wiring.

The non-evaporable getter 10 is disposed on the X-directional wiring and Y-directional wiring. As a first layer of the non-evaporable getter 10, the commercial non-evaporable getter (e.g., HS-405 powder (manufactured by Japan Getters), St-707 (manufactured by SAES), and the like), or the simple body metals such as Zr and Ti can also be applied, and the layer is formed, for example, by the plasma spray coating process. In a second layer various simple body metals such as Ti are formed into films by the vacuum evaporation process. When the non-evaporable getter 10 is disposed, by using the metal mask having the wiring-shaped opening, and the like, due consideration is given not to attach the getter to the places other than the desired place.

Subsequently, the non-evaporable getter 10 disposed on the nichrome substrate is installed outside the image display region. The nichrome substrate with the non-evaporable getter formed thereon is cut in accordance with the size of the substrate, one end of the getter support member 9 is fixed to the nichrome plate with the multilayered non-evaporable getter disposed thereon by a spot welding process, and the like, and the other end is fixed to the support frame 3 by the fritted glass, and the like.

The face plate 4 of the envelope 5 shown in FIG. 12 will next be described.

FIGS. 8A and 8B are schematic views of the fluorescent film for use in the image forming apparatus of FIG. 12. The fluorescent film 7 can be constituted only of the phosphor for monochrome. The color fluorescent film can be constituted of the black conductive material 61 and phosphor 62 called the black stripe or the black matrix by the arrangement of phosphors. In the color display, the purposes of disposing the black stripe or the black matrix are not to clearly show the mixed color by blackening the paint dividing part between the respective phosphors 62 of necessary three primary color phosphors, and to suppress a drop in contrast by external light reflection in the fluorescent film 7. As the material of the black stripe, in addition to the usually used material mainly containing graphite, the material having a conductivity and little light transmission or reflection can be used.

In order to further enhance the conductivity of the fluorescent film 7, the face plate 4 may be provided with the transparent electrode (not shown) on the outer surface of the fluorescent film 7.

The electron source substrate 1 and face plate 4 formed as described above are sealed by the fritted glass via the support frame 3, so that the envelope 5 is formed. To perform the sealing, in the color display, the respective color phosphors and electron-emitters need to be matched, and a sufficient positioning is indispensable.

Additionally, by installing the support member called the spacer (not shown) between the face plate 4 and the electron source substrate 1, the envelope 5 having a sufficient strength against the atmospheric pressure can be constituted.

Subsequently, the envelope 5 is subjected to a necessary treatment using the apparatus schematically shown in FIG. 13.

An image forming apparatus 20 is connected to a vacuum chamber 22 via an exhaust tube 21, and further connected to an exhaust apparatus 24 via a gate valve 23. The vacuum chamber 22 is attached to a pressure indicator 25, a quadrupole mass analyzer 26, and the like to measure the inside pressure and each component partial pressure in the atmosphere. Since it is difficult to directly measure the pressure inside the envelope 5 of the image forming apparatus 20, the pressure inside the vacuum chamber 22, and the like are measured, and the treatment condition is controlled.

The vacuum chamber 22 is further connected to a gas introduction line 27 to introduce necessary gas into the vacuum chamber and control the atmosphere. The other end of the gas introduction line is connected to an introduction substance source 29, in which the substance to be introduced is placed in an ample or a cylinder and stored. The gas introduction line is midway provided with introduction amount control means 28 for controlling the rate of introducing the introduction substance. Concretely as the introduction amount control means, valves which can control the flow rate such as a slow leak valve, mass flow controller, and the like can be used in accordance with the type of the substance to be introduced.

The inside of the envelope 5 is evacuated by the apparatus of FIG. 13, and for example, by performing energization application, the forming is performed to form the electron-emitter. By successively applying (scrolling) pulses whose phases deviate to a plurality of X-directional wirings, the emitters connected to the plurality of X-directional wirings can be formed altogether.

After the forming ends, the activation operation is performed. After the sufficient evacuation, organic substances are introduced into the envelope 5 via the gas introduction line 27. By applying a voltage to each electron-emitter in the atmosphere containing the organic substances, carbon or a carbon compound, or a mixture of both is deposited in the electron-emitting part, and the electron emission amount strikingly rises. In this case, the method of applying the voltage may comprise applying simultaneous voltage pulses to the devices connected to the wirings of one direction by the connection similar to that for the above-described forming.

After the activation process ends, the stabilization process is preferably performed in a similar manner as in the individual emitters.

By heating and holding the envelope 5 in a range of 250 to 350° C., and performing evacuation by the exhaust apparatus 24 using no oil such as an ion pump and a sorption pump via the exhaust tube 21, the atmosphere is obtained in which there are a sufficiently small amount of organic substances. In this case, the non-evaporable getter 10 disposed in the image forming apparatus 20 is also heated and activated, and the exhaust ability is obtained. Thereafter, the exhaust tube is heated with a burner, dissolved and sealed.

The constitution example of a drive circuit for performing a television display based on an NTSC system television signal on the display panel constituted using the electron source with the passive matrix arrangement will next be described with reference to FIG. 14. In FIG. 14, numeral 101 denotes an image display panel, 102 denotes a scanning circuit, 103 denotes a control circuit, and 104 denotes a shift register. Numeral 105 denotes a line memory, 106 denotes a synchronizing signal separation circuit, 107 denotes a modulation signal generator, and Vx and Va denote direct-current voltage sources.

The display panel 101 is connected to the external electric circuit via terminals Dox1 and Doxm, terminals Doy1 and Doyn, and high-voltage terminal Hv. Applied to the terminals Dox1 to Doxm are scanning signals for successively driving the electron source disposed in the display panel, that is, the electron-emitter group matrix-wired in a matrix having M rows and N columns by each row (N devices).

Modulation signals for controlling the output electron beams of the respective devices in one row of electron-emitters selected by the scanning signal are applied to the terminals Doy1 to Doyn. A direct-current voltage, for example, of 10 kV is supplied to the high-voltage terminal Hv from the direct-current voltage source Va, and the voltage is an acceleration voltage to apply an energy sufficient for energizing the phosphor to the electron beam emitted from the electron-emitter.

The scanning circuit 102 will be described. The circuit is provided inside with M switching devices (schematically shown as S1 to Sm in the drawing). Each switching device selects either one of the output voltage of the direct-current voltage source Vx and OV (ground level), and is electrically connected to the terminals Dox1 to Doxm of the display panel 101. Each of the switching elements S1 to Sm operates based on a control signal Tscan outputted by the control circuit 103, and can be constituted by combining the switching elements such as FET.

In the present example, the direct-current voltage source Vx is set based on the characteristics (electron emission threshold value voltage) of the surface conduction electron-emitter described later to output a constant voltage so that the drive voltage applied to a not scanned element becomes equal to or less than the electron emission threshold value voltage.

The control circuit 103 has a function of matching respective part operations so-that appropriate display is performed based on the image signal inputted from the outside. The control circuit 103 generates control signals Tscan, Tsft and Tmry to the respective sections based on a synchronizing signal Tsync transmitted from the synchronizing signal separation circuit 106.

The synchronizing signal separation circuit 106 is a circuit for separating synchronous and luminance signal components from the NTSC system television signal inputted from the outside, and can be constituted using a general frequency separation (filter) circuit, and the like. The synchronizing signal separated by the synchronizing signal separation circuit 106 is constituted of a vertical synchronizing signal and a horizontal synchronizing signal, and the Tsync signal is shown here for the convenience of description. The image luminance signal component separated from the television signal is represented as DATA signal for the convenience. The DATA signal is inputted to the shift register 104.

The shift register 104 performs serial/parallel conversion of the DATA signal serially inputted in time series by each line of the image, and operates based on the control signal Tsft transmitted from the control circuit 103 (i.e., the control signal Tsft can be said to be a shift clock of the shift register 104). The image one line of data subjected to the serial/parallel conversion (corresponding to the drive data for N electron-emitters) are outputted from the shift register 104 as N parallel signals Id1 to Idn.

The line memory 105 is a storage apparatus for storing the image one line of data only for a necessary time, and appropriately stores the content of Idl to Idn in accordance with the control signal Tmry transmitted from the control circuit 103. The stored content is outputted as I'd1 to I'dn, and inputted to the modulation signal generator 107.

The modulation signal generator 107 is a signal source for appropriately driving/modulating the respective electron-emitters in response to the respective image data I'd1 to I'dn, and the output signal is applied to the electron-emitters in the display panel 101 via the terminals Doy1 to Doyn.

Here, the characteristics of the surface conduction electron-emitter will be described.

When the surface conduction electron-emitter is used as the electron-emitter constituting the electron source in the present invention, during the driving the basic characteristics are utilized to display the image. Specifically, for the basic characteristics of the surface conduction electron-emitter, a clear threshold value voltage Vth for electron emission is present, and the electron emission occurs only when the voltage of Vth or more is applied. With respect to the voltage equal to or more than the electron emission threshold value, the emission current also changes with the change of the voltage applied to the device. Therefore, when the pulse-like voltage is applied to the present device, and for example, even when the voltage less than the electron emission threshold value is applied, no electron emission occurs, but when the voltage equal to or more than the electron emission threshold value is applied, the electron beam is outputted. In this case, by changing a pulse crest value Vm, the intensity of the outputted electron beam can be controlled. Moreover, by changing a pulse width Pw, the total amount of electric charges of the outputted electron beam can be controlled.

Therefore, as a system of modulating the surface conduction electron-emitter in response to the input signal, a voltage modulation system, a pulse width modulation system, and the like can be employed. To perform the voltage modulation system, as the modulation signal generator 107, a voltage modulation system circuit can be used in which a constant length voltage pulse is generated and the pulse crest value is appropriately modulated in accordance with the inputted data.

To perform the pulse width modulation system, as the modulation signal generator 107, a pulse width modulation system circuit can be used in which a constant crest value voltage pulse is generated and the voltage pulse width is appropriately modulated in accordance with the inputted data.

For the shift register 104 and line memory 105, a digital signal system and an analog signal system can both be employed. This is because the serial/parallel conversion and storage of the image signal may only be performed at a predetermined rate.

When the digital signal system is used, the output signal DATA of the synchronizing signal separation circuit 106 needs to be converted to a digital signal, and for this purpose the output section of the synchronizing signal separation circuit 106 may only be provided with an A/D converter. In this respect, dependent on whether the output signal of the line memory 105 is a digital signal or an analog signal, the circuit for use in the modulation signal generator 107 slightly differs. Specifically, when the voltage modulation system uses the digital signal, for example, a D/A conversion circuit is used in the modulation signal generator 107, and an amplification circuit, and the like are added as occasion demands. In the pulse width modulation system, the modulation signal generator 107 uses, for example, a circuit formed by combining a high-rate oscillator, a counter for counting the number of waves outputted by the oscillator, and a comparator for comparing the output value of the counter with the output value of the memory. As occasion demands, an amplifier can be added for amplifying the voltage of the modulation signal outputted from the comparator and subjected to the pulse width modulation to provide the drive voltage of the surface conduction electron-emitter.

In the voltage modulation system using the analog signal, for example, the amplification circuit using an operation amplifier, and the like can be employed in the modulation signal generator 107, and a level shift circuit, and the like can be added as occasion demands. In the pulse width modulation system, for example, a voltage control type oscillation circuit (VOC) can be employed, and the amplifier for amplifying the voltage to provide the drive voltage of the surface conduction electron-emitter can be added as occasion demands.

In the image display to which the present invention constituted as described above can be applied, by applying voltages to the respective electron-emitters via the chamber external terminals Dox1 to Doxm, Doy1 to Doyn, the electron-emitters are generated. By applying a high voltage to the metal back 15 or the transparent electrode (not shown) via the high-voltage terminal Hv, the electron beam is accelerated. The accelerated electron collides against the fluorescent film 14, and light is emitted to form an image.

The constitution of the image forming apparatus having the non-evaporable getter described herein is one example of the image forming apparatus to which the present invention can be applied, and various modifications are possible based on the technical idea of the present invention. Particularly, the surface conduction electron-emitter has been described as the electron-emitter constituting the electron source, but the device constituting the electron source is not limited to this, and the present invention can be applied to the image forming apparatus in which a multiplicity of electron-emitters such as an electric-field emission electron-emitter and a metal/insulating layer/metal type (MIN type) are arranged and used. Moreover, the passive matrix arrangement has been described as the method of arranging the electron-emitters, but the arrangement method is not limited to this, and the invention can also be applied to the ladder-like arrangement, and the like.

Furthermore, with respect to the input signal, the NTSC system has been exemplified, but the input signal is not limited to this, and in addition to PAL and SECAM systems, a TV signal (e.g., a high-grade TV such as MUSE system) system comprising more scanning lines can also be employed.

Moreover, the image forming apparatus of the present invention can be used not only as the television broadcasting display described herein, and the displays of a television conference system, computer, and the like, but also as the image forming apparatus as an optical printer constituted using a photosensitive drum, and the like.

The present invention will be described hereinafter in detail by concrete examples, but the present invention is not limited to these examples, and includes the replacement and design change of each element in a range in which the object of the present invention is attained.

EXAMPLE 1

(Step-a)

A layer of a non-evaporable getter HS405 powder (composition: Zr 80%, V 15.6%, Mn 4%, Al 0.4%) of Japan Getters Co. was formed on a nichrome substrate with a width of 2 mm and a length of 100 mm by a plasma spray coating process using Ar plasma. The thickness of the formed film was about 50 $\mu$m. The surface with the film formed thereon was porous by particles with particle diameters of 20 to 40 $\mu$m as shown in FIGS. 2A and 2B.

(Step-b)

After the step-a, and the exposure to the atmospheric air, a film of Ti was formed in about 2.5 $\mu$m on the plasma spray coated HS405 powder formed in the step-a by an electron beam deposition process. For the surface with the film formed thereon, as shown in FIGS. 1A and 1B, Ti grew around the HS405 powder particles, and the porous state was kept. Additionally, the mathematical surface roughness Ra of the plasma spray coated HS405 powder layer formed in the step-a substantially indicated around Ra=10, and this value had no large difference even after the Ti film was formed in the step-b.

(Step-c)

The Ti coat getter formed in the step-b was subjected to the activation operation in the atmosphere equal to or less than $1.33\times10^{-7}$ Pa ($1\times10^{-9}$ Torr) at 350° C. for ten hours, cooling was performed to obtain the room temperature, and subsequently the gas absorbing performance was measured. The gas absorbing performance was measured using CO gas in a throughput process.

Comparative Example 1

In a similar manner as the step-c, the plasma spray coated HS405 powder to the step-a was subjected to the activation operation in the atmosphere equal to or less than $1.33\times10^{-7}$ Pa ($1\times10^{-9}$ Torr) at 350° C. for ten hours, the cooling was performed to obtain the room temperature, and subsequently the gas absorbing performance was measured. The gas absorbing performance was measured using CO gas in the throughput process.

Comparative Example 2

A non-evaporable getter St-122 manufactured by SAES GETTERS Co. (composition: Ti 70%, Zr 21%, V 7.389, Fe 1.62%) was prepared, and in a similar manner as the step-c, subjected to the activation operation in the atmosphere equal to or less than $1.33\times10^{-7}$ Pa ($1\times10^{-9}$ Torr) at 350° C. for ten hours, then the cooling was performed to obtain the room temperature, and subsequently the gas absorbing performance was measured. The gas absorbing performance was measured using CO gas in the throughput process. Additionally, in the used St-122, the layer was formed on both surfaces of nichrome with a width of 2 mm and length of 100 mm in a total thickness of 100 $\mu$m.

The three types of non-evaporable getters measured as described above indicated the absorbing performances as shown in FIG. 3. As apparent from FIG. 3, the Ti-coated plasma spray-coated HS405 powder of the present example was little in the characteristics deterioration of the absorbing rate as compared with the non-evaporable getters of the comparative examples 1 and 2.

EXAMPLE 2

The present example was performed to check the absorbing ability of the getter after the low vacuum state was kept in the high temperature.

Step-a and step-b were performed in a similar manner as the example 1.

Step-c

The Ti-coated plasma spray-coated HS405 formed in the step-b was placed in a sealed chamber having two openings with a diameter of 4 mmϕ, Ar gas was introduced at a rate of 1 1/s via one opening, and exhausted via the other end and the entire chamber was heated to a temperature of 450° C. In this step, the process of bonding the glasses with each other was regenerated under the atmosphere of Ar gas flow in a pseudo manner.

Step-d

The Ti coated getter subjected to the Ar flow high-temperature process in the step-c was subjected to the activation operation in the atmosphere equal to or less than $1.33\times10^{-7}$ Pa $1\times10^{-9}$ Torr) at 350° C. for ten hours, the cooling was performed to obtain the room temperature, and subsequently the gas absorbing performance was measured. The gas absorbing performance was measured using CO gas in the throughput process.

Comparative Example 3

Step-c'

In a similar manner as the step-c, the plasma spray-coated HS405 formed in the step-a was placed in the sealed chamber having two openings with a diameter of 4 mmϕ, Ar gas was introduced at a rate of 1 1/s via one opening, and exhausted via the other end and the entire chamber was heated to a temperature of 450° C. In this step, the process of bonding the glasses with each other was regenerated under the atmosphere of Ar gas flow in a pseudo manner.

Step-d'

The plasma spray-coated HS405 formed in the step-c' was subjected to the activation operation in the atmosphere equal to or less than $1.33\times10^{-7}$ Pa ($1\times10^{-9}$ Torr) at 350° C. for ten hours, the cooling was performed to obtain the room temperature, and subsequently the gas absorbing performance was measured. The gas absorbing performance was measured using CO gas in the throughput process.

Figure 6:
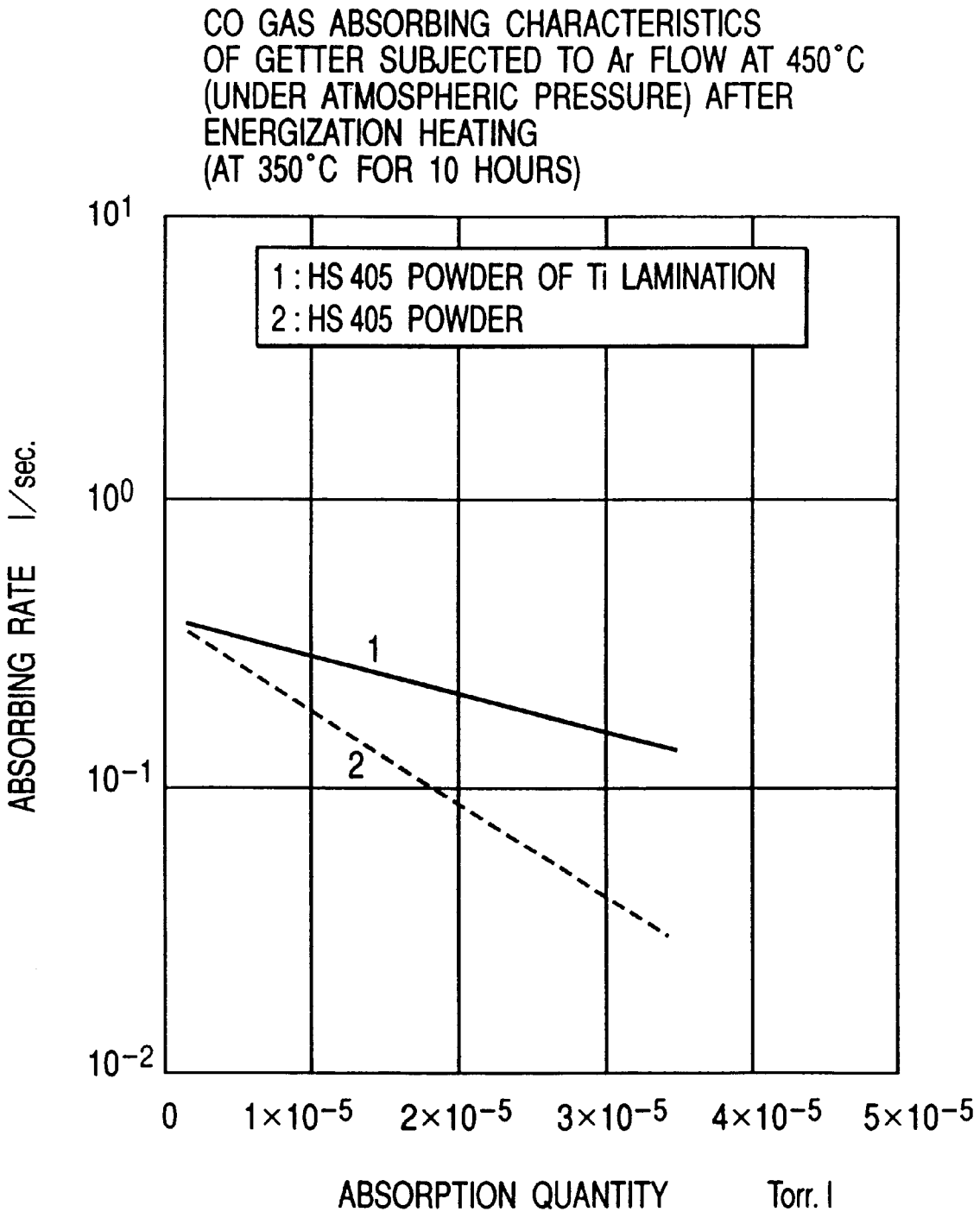
FIG. 6 is a diagram showing the comparison in the absorbing characteristics of the non-evaporable getter alloy formed by depositing Ti on the non-evaporable getter alloy (HS405) mainly containing Zr and subjected to a temperature rise to 450° C. under an atmospheric pressure in an atmosphere of Ar flow with the HS405 alone.

The two types of non-evaporable getters measured as described above indicated the absorbing performances as shown in FIG. 6. As apparent from FIG. 6, the Ti-coated plasma spray-coated HS405 powder of the present example was little in the characteristics deterioration of the absorbing rate as compared with the non-evaporable getter of the comparative example 3, and it has been found that the absorbing ability is far superior to that of the conventional art even after the exposure to the high-temperature low-vacuum state.

EXAMPLE 3

(Step-a)

A film of a non-evaporable getter St-707 powder (composition: Zr 70%, V 24.6%, Fe 5.4%) of SAES Getters was formed on a nichrome substrate with a width of 2 mm and a length of 100 mm by the plasma spray coating process using Ar plasma. The thickness of the formed film was about 50 μm. The surface with the film formed thereon was porous by particles with particle diameters of 20 to 40 μm.

(Step-b)

After the step-a, and the exposure to the atmospheric air, a film of Ti was formed in about 2.5 μm on the plasma spray coated St-707 powder formed in the step-a by the electron beam deposition process. For the surface with the film formed thereon, Ti was deposited around the St-707 powder particles, and the porous state was kept. Additionally, the mathematical surface roughness Ra of the plasma spray coated St-707 powder layer formed in the step-a substantially indicated around Ra=10, and this value had no large difference even after the Ti film was formed in the step-b.

(Step-c)

The multilayered structure getter formed in the step-b was subjected to the activation operation in the atmosphere equal to or less than $1.33\times10^{-7}$ Pa ($1\times10^{-9}$ Torr) at 350° C. for ten hours, cooling was performed to obtain the room temperature, and subsequently the gas absorbing performance was measured. The gas absorbing performance was measured using CO gas in a throughput process.

Comparative Example 4

In a similar manner as the step-c, the plasma spray coated St-707 powder to the step-a was subjected to the activation operation in the atmosphere equal to or less than $1.33\times10^{-7}$ Pa ($1\times10^{-9}$ Torr) at 350° C. for ten hours, the cooling was performed to obtain the room temperature, and subsequently the gas absorbing performance was measured. The gas absorbing performance was measured using CO gas in the throughput process.

Figure 5:
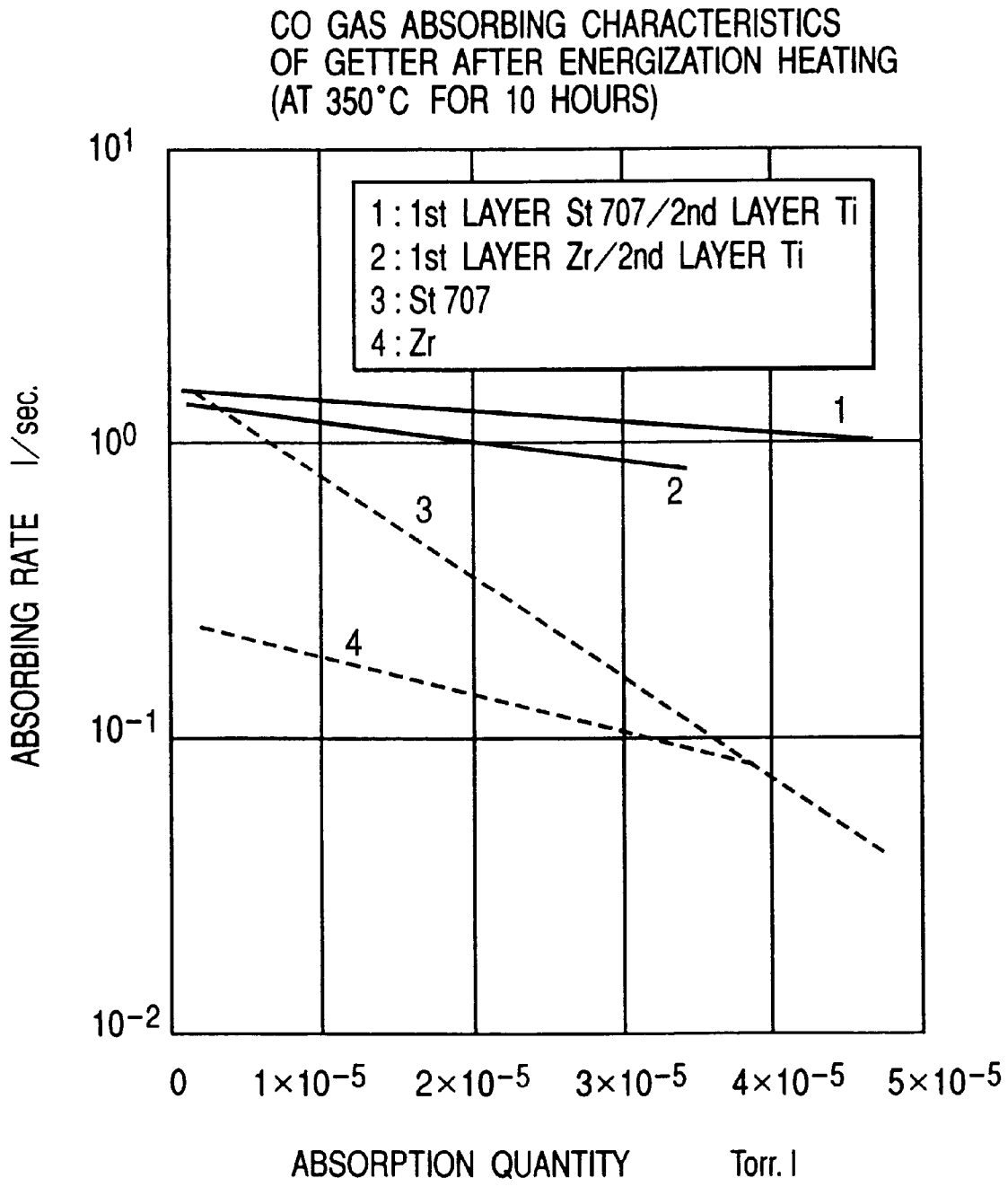
FIG. 5 is a diagram showing the comparison in the absorbing characteristics of the non-evaporable getter alloy formed by depositing Ti on the non-evaporable getter alloy (St-707) mainly containing Zr or on Zr simple-body powder with the non-evaporable getter alloy or the Zr simple-body powder alone.

For the measurement result, the absorbing performance was indicated as shown in FIG. 5. As apparent from FIG. 5, the non-evaporable getter with the Ti film formed thereon of the present example can stand comparison with the getter of the example 1 in the absorbing rate characteristics. Moreover, as compared with the non-evaporable getter of the comparative example 4 only of the plasma spray coated St-707 powder layer, the characteristics deterioration of the absorbing rate was little.

EXAMPLE 4

(Step-a)

A film of a Zr powder (manufactured by Kabushiki Kaisha Kojundo Kagaku Kenkyusho, a particle diameter of 325 meshes or less) was formed on the nichrome substrate with the width of 2 mm and length of 100 mm by the plasma spray coating process using Ar plasma. The thickness of the formed film was about 50 μm. The surface with the film formed thereon was porous by particles with particle diameters of 20 to 40 μm.

(Step-b)

After the step-a, and the exposure to the atmospheric air, a film of Ti was formed in about 2.5 μm on the plasma spray coated Zr powder formed in the step-a by the electron beam deposition process. For the surface with the film formed thereon, Ti was deposited around the Zr particles, and the porous state was kept. Additionally, the mathematical surface roughness Ra of the plasma spray coated Zr powder formed in the step-a substantially indicated around Ra=10, and this value had no large difference even after the Ti film was formed in the step-b.

(Step-c)

The multilayered structure getter formed in the step-b was subjected to the activation operation in the atmosphere equal to or less than $1.33\times10^{-7}$ Pa ($1\times10^{-9}$ Torr) at 350° C. for ten hours, cooling was performed to obtain the room temperature, and subsequently the gas absorbing performance was measured. The gas absorbing performance was measured using CO gas in a throughput process.

For the measurement result, the absorbing performance was indicated as shown in FIG. 5. As apparent from FIG. 5, the non-evaporable getter with the Ti film formed thereon of the present example can stand comparison with the getters of the examples 1 and 3 in the absorbing rate characteristics, and it has been found that a sufficient getter ability is provided.

EXAMPLE 5a (Step-a)

A film of metal Zr was formed on the cleaned nichrome substrate by the sputtering process.

(Step-b)

The Zr surface of the substrate formed in the step-a was subjected to a blast processing in the atmospheric air, and the surface shape was undulated. Additionally, the mathematical surface roughness Ra substantially indicated around Ra=10.

(Step-c)

A film of metal Ti was formed on the Zr surface of the substrate treated in the step-b using the electron beam deposition process. The mathematical average roughness Ra of the surface with the film formed thereon had no large difference from that before the Ti film was formed, and was substantially around Ra=10. The multilayered structure getter was formed on the nichrome substrate in this manner.

(Step-d)

The getter formed in the step-c was subjected to the activation operation in the atmosphere equal to or less than $1.33\times10^{-7}$ Pa ($1\times10^{-9}$ Torr) at 350° C. for ten hours, cooling was performed to obtain the room temperature, and subsequently the gas absorbing performance was measured. The gas absorbing performance was measured using CO gas in a throughput process.

EXAMPLE 5b

In the present example 5b, the film of metal Zr was formed on the nichrome substrate by the sputtering process, subsequently the film of metal Ti was formed using the electron beam deposition process, and no surface blast processing was performed. The mathematical average roughness Ra of the surface was Ra=0.1 to 0.2.

This substrate was subjected to the activation operation in the atmosphere equal to or less than $1.33\times10^{-7}$ Pa ($1\times10^{-9}$ Torr) at 350° C. for ten hours, the cooling was performed to obtain the room temperature, and subsequently the gas absorbing performance was measured. The gas absorbing performance was measured using CO gas in a throughput process.

Figure 26:
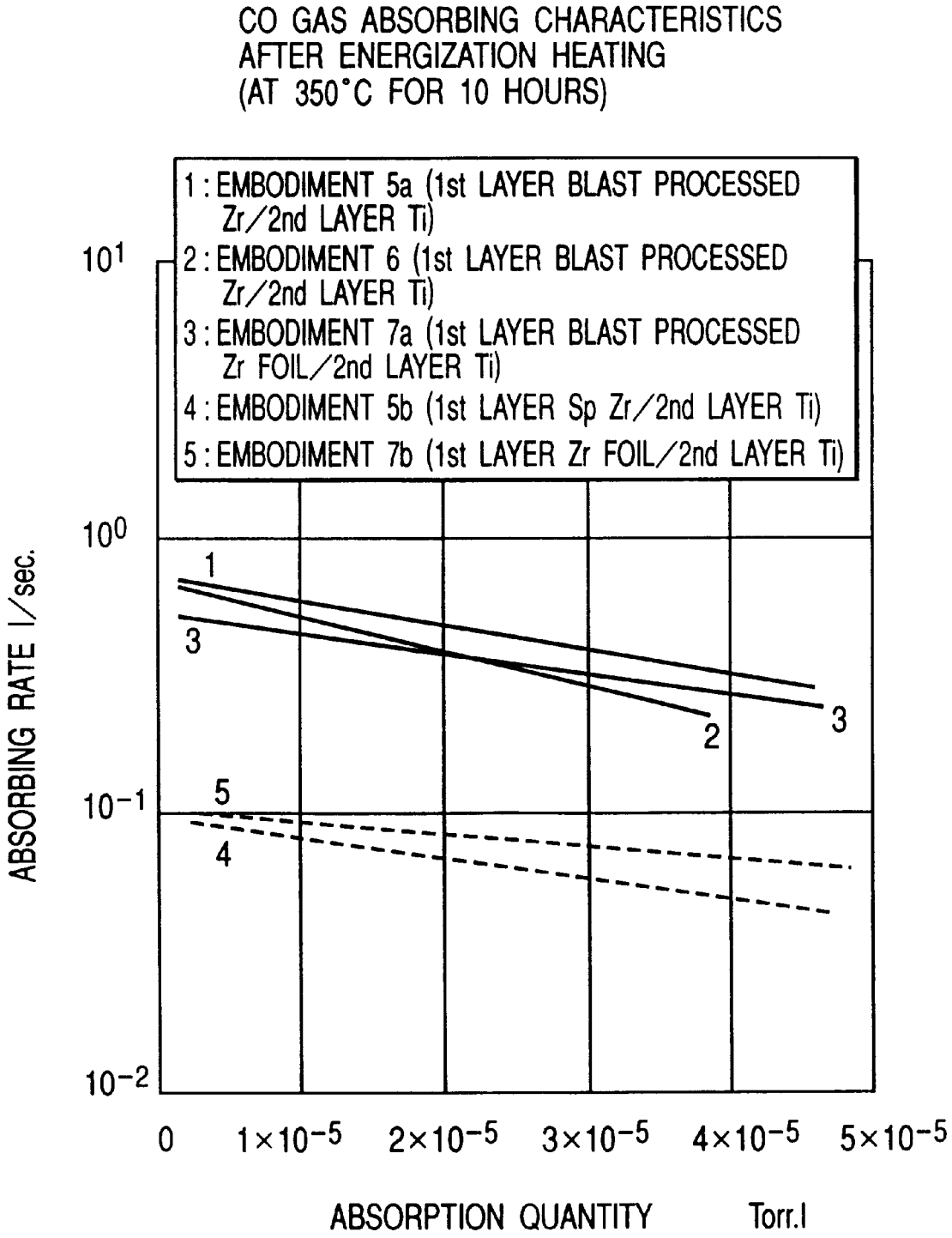
FIG. 26 is a diagram showing the absorbing characteristics of the non-evaporable getter in which Ti is deposited on a surface undulated by a blast processing, the non-evaporable getter in which Ti is deposited on a Zr film formed on a substrate undulated by the blast processing, the non-evaporable getter in which Ti is deposited on a Zr foil surface undulated by the blast processing, and the non-evaporable getter in which Ti is deposited without subjecting the Zr surface to the blast processing.

The measured getter absorptivity is shown in FIG. 26. As apparent from FIG. 26, the multilayered non-evaporable getter of the example 5a in which Ti was deposited by the blast processing after the undulation treatment had a large absorbing ability as compared with the example 5b in which the film was formed without performing the blast processing.

EXAMPLE 6

(Step-a)

The cleaned nichrome substrate was subjected to the blast processing, and the surface shape was undulated.

Additionally, the mathematical surface roughness Ra substantially indicated around Ra=10.

(Step-b)

A film of metal Zr was formed on the surface of the undulated substrate formed in the step-a by the sputtering process.

(Step-c)

After the step-b, and the exposure to the atmospheric air, a film of metal Ti was further formed on the substrate formed in the step-b using the electron beam deposition process. The mathematical average roughness Ra of the surface with the film formed thereon had no large difference from that before the film was formed, and was substantially around Ra=10. The multilayered structure getter was formed on the nichrome substrate in this manner.

(Step-d)

The getter formed in the step-c was subjected to the activation operation in the atmosphere equal to or less than $1.33\times10^{-7}$ Pa ($1\times10^{-9}$ Torr) at 350° C. for ten hours, the cooling was performed to obtain the room temperature, and subsequently the gas absorbing performance was measured. The gas absorbing performance was measured using CO gas in a throughput process.

The measured getter absorptivity is shown in FIG. 26. As apparent from FIG. 26, the non-evaporable getter of the present example in which the Zr and Ti films were formed after the undulation treatment of the substrate by the blast processing had a large absorbing ability as compared with when the films were formed without performing the blast processing (similar to the example 5b).

EXAMPLE 7a (Step-a)

A cleaned Zr foil (manufactured by Niraco Co., Ltd.) was prepared, and subjected to the blast processing in the atmospheric air, and the surface shape was undulated. Additionally, the mathematical surface roughness Ra substantially indicated around Ra=10.

(Step-b)

A film of metal Zr was formed on the undulated surface of the Zr foil by the electron beam deposition process. The mathematical average roughness Ra of the surface with the film formed thereon had no large difference from that before the film was formed, and was substantially around Ra=10. The multilayered structure getter was formed in this manner.

(Step-c)

The getter formed in the step-b was subjected to the activation operation in the atmosphere equal to or less than $1.33\times10^{-7}$ Pa ($1\times10^{-9}$ Torr) at 350° C. for ten hours, the cooling was performed to obtain the room temperature, and subsequently the gas absorbing performance was measured. The gas absorbing performance was measured using CO gas in a throughput process.

EXAMPLE 7b

In the present example 7b, the film of metal Ti was directly formed on the cleaned Zr foil (manufactured by Niraco Co., Ltd.) by the electron beam deposition process, and no surface blast processing was performed. The mathematical average roughness Ra of the surface was Ra=0.1 to 0.2.

This substrate was subjected to the activation operation in the atmosphere equal to or less than $1.33\times10^{-7}$ Pa ($1\times10^{-9}$ Torr) at 350° C. for ten hours, the cooling was performed to obtain the room temperature, and subsequently the gas absorbing performance was measured. The gas absorbing performance was measured using CO gas in a throughput process.

The measured getter absorptivity is shown in FIG. 26. As apparent from FIG. 26, the non-evaporable getter of the present example in which the Zr foil was subjected to the undulation treatment by the blast processing and then the film of Ti was formed had a large absorbing ability as compared with the comparative example in which the film was formed without performing the blast processing.

EXAMPLE 8

The image forming apparatus of the present example has a constitution similar to that of the apparatus schematically shown in FIG. 7, and the non-evaporable g etter is disposed on the X-directional wiring (upper wiring) 52 and Y-directional wiring (lower wiring) 53 formed by the printing process (only the non-evaporable getter 56 on the Y-directional wiring 53 is shown in FIG. 7).

Moreover, the image forming apparatus of the present example is provided, on the substrate, with the electron source in which a plurality of (100 rows×300 columns) surface conduction electron-emitters are subjected to the passive matrix wiring.

Figure 15:
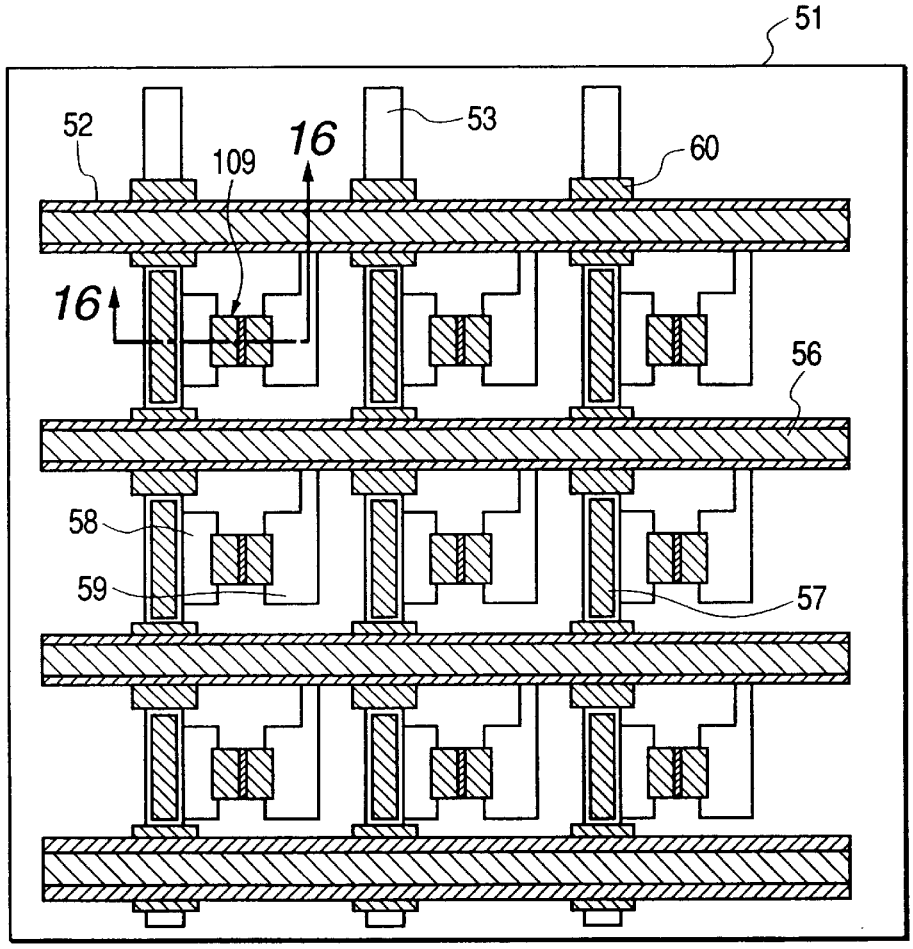
FIG. 15 is a schematic diagram showing the electron source according to the first embodiment of the present invention.
Figure 16:
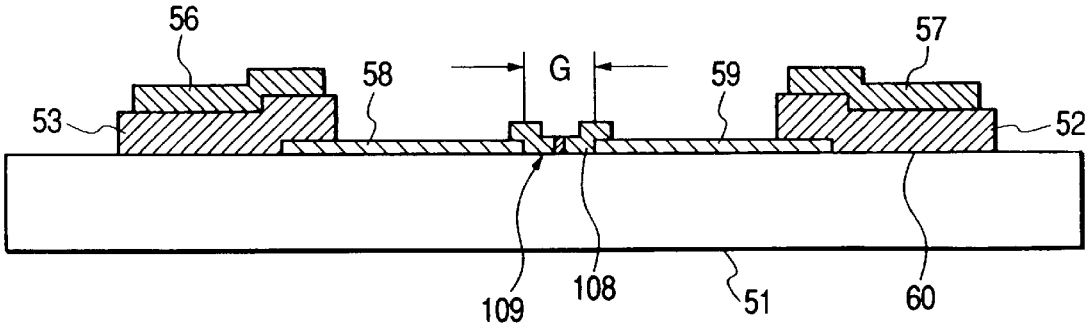
FIG. 16 is a sectional view along line 16—16 of the electron source shown in FIG. 15.

A partial plan view of the electron source is shown in FIG. 15. Moreover, a sectional view along 16—16 in the drawing is shown in FIG. 16. Additionally, in FIGS. 15 and 16, the members denoted with the same reference numerals indicate the same members. Here, numeral 51 denotes a electron source substrate, 52 denotes an X-directional wiring (referred to also as the upper wiring, scanning-side wiring) corresponding to Doxm of FIG. 7, 53 denotes a Y-directional wiring (referred to also as the lower wiring, signal-side wiring) corresponding to Doyn of FIG. 7, 108 denotes an electroconductive film including the electron-emitting part of the surface conduction electron-emitter, 109 denotes an electron-emitting part partially disposed on the electroconductive film 108, 58, 59 denote device electrodes, 60 denotes an interlayer insulating layer, and 56, 57 denote non-evaporable getters on the X-directional wiring and the Y-directional wiring, respectively.

The method of manufacturing the image forming apparatus of the present example will be described hereinafter with reference to FIGS. 17A to 17F.

Step-a

A substrate was sufficiently cleaned using a detergent, pure water and organic solvent. On the substrate a 0.5 $\mu$m thick silicon oxide film was formed by the sputtering process, and the electron source substrate 51 was formed.

Figure 17A:
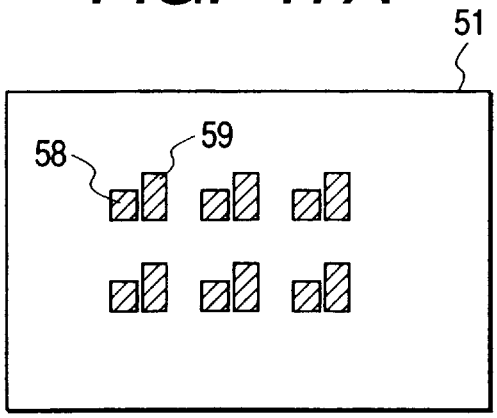
FIGS. 17A, 17B, 17C, 17D, 17E and 17F are explanatory views showing the manufacture process of the electron source shown in the first embodiment of the present invention.

Thereafter, a pattern to form the device electrodes 58, 59 and a gap G between the device electrodes was formed on the electron source substrate by a photo resist (RD-2000N-41 manufactured by Hitachi Chemical Co., Ltd.), and 5 nm thick Ti, and 100 nm thick Ni were successively deposited by the vacuum evaporation process. The photo resist pattern was dissolved in the organic solvent, the Ni/Ti deposition film was lifted off, the gap G between the device electrodes was set to 3 $\mu$m, the width of the device electrode was set to 300 $\mu$m, and the device electrodes 58, 59 were formed (FIG. 17A).

Step-b

Figure 17D:
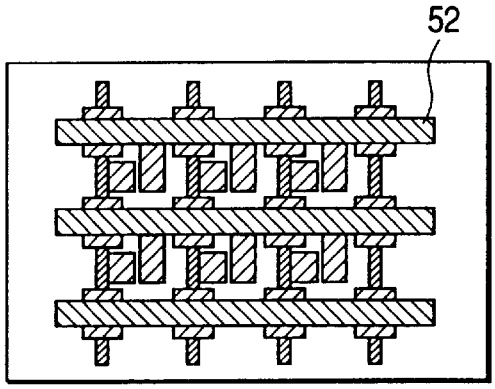
Figure 17B:
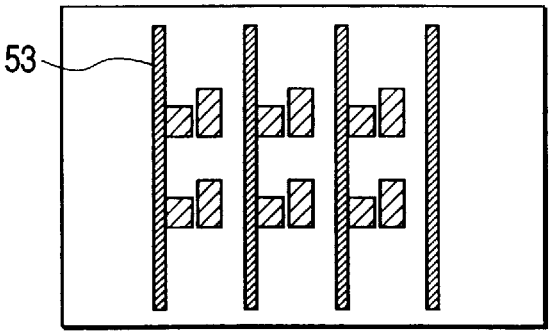

Thereafter, the screen printing process was used to form the lower wiring (e.g., silver wiring) 53 to contact one device electrode 58, and calcining was performed at 400° C. to form the desired shaped lower wiring 53 (FIG. 17B).

Step-c

Figure 17E:
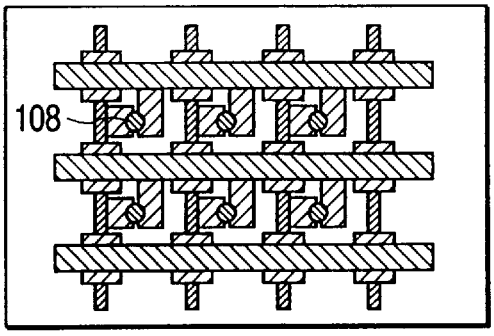
Figure 17C:
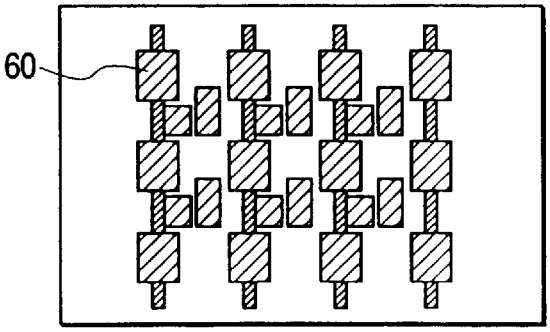

Thereafter, the screen printing process was used to print the desired interlayer insulating layer 60 in the crossing part of the upper and lower wirings, calcined at 400° C., and formed (FIG. 17C).

Step-d

The upper wiring (e.g., silver wiring) 52 was printed by the screen printing process to contact the device electrode 59 not contacting the lower wiring, calcined at 400° C. and formed (FIG. 17D).

Step-e

A 100 nm thick Cr film was deposited/patterned by the vacuum evaporation, the film was spin-coated with a Pd amine complex body solution (ccp4230 manufactured by Okuno Pharmaceutical Co., Ltd.) with a spinner, and a heating/calcining treatment was performed at 300° C. for ten minutes. Moreover, the thickness of the electroconductive film 108, formed in this manner, for forming the electron-emitting part formed of fine particles mainly containing the element of Pd was 8.5 nm, and the sheet resistance value was $3.9\times10^4$ Ω/□. Additionally, the fine particle film described herein is a film formed by an aggregate of a plurality of fine particles, examples of the fine structure include not only the state in which fine particles are individually dispersed/arranged, but also the film in which the fine particles are adjacent to one another, or overlapped with one another (including an insular state), and the particle diameter refers to the diameter of the fine particle whose shape can be recognized in the above-described state.

The Cr film and the calcined electroconductive film 108 for forming the electron-emitting part were etched by an acid etchant to form a desired pattern (FIG. 17E).

By the above-described process the electroconductive film 108 for forming a plurality of (100 rows×300 columns) electron-emitting parts on the electron source substrate 51 was connected to the passive matrix formed of the lower wiring 53 and the upper wiring 52.

Step-f

Figure 17F:
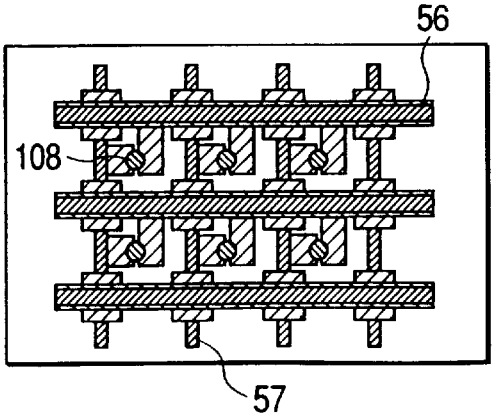

A metal mask having the upper wiring pattern formed by the step-d in the opening was prepared, the respective upper wirings were sufficiently aligned with the openings and the electron source substrate and metal mask were fixed. Thereafter, the non-evaporable getter mainly containing Zr: HS405 powder (manufactured by Japan Getters Co., Ltd.) was formed into a film on the metal mask by the argon plasma spray coating process. Thereafter, after the exposure to the atmospheric air, a film of Ti was further formed on the electron source substrate provided with the metal mask by the electron beam deposition process, the metal mask was peeled off, and the non-evaporable getter was formed on the upper wiring of the electron source substrate (FIG. 17F).

Step-g

The face plate 16 shown in FIG. 7 was next formed as follows.

The fluorescent film 14 was formed on the surface of the glass substrate 13 by the printing process. Additionally, in the fluorescent film 14, the striped phosphors (R, G, B) 62 and black conductive materials (black stripes) 61 were alternately arranged as shown in the fluorescent film of FIG. 8A. Furthermore, the metal back 15 formed of an Al thin film was formed in a thickness of 50 nm on the fluorescent film 14 by the sputtering process.

Step-h

The envelope 17 shown in FIG. 7 was next formed as follows.

The electron source substrate 51 formed in the above-described step, the support frame 12, and the above-described face plate 16 were combined, the lower wiring 53 and upper wiring 52 of the electron source were connected to the row selecting terminal 1 and signal input terminal 2, respectively, and the positions of the electron source substrate 51 and face plate 16 were strictly adjusted, and sealed to form the envelope 17. The sealing method comprised: applying the fritted glass to the bonded part, and performing tentative calcining in the atmosphere at 300° C.; subsequently combining the respective members; and performing the thermal treatment in Ar gas at 400° C. for ten minutes to perform bonding.

Before describing the next step, a vacuum operation apparatus use in the subsequent steps will be described with reference to FIG. 13. The envelope 5 of FIG. 13 corresponds to the envelope 17.

The image forming apparatus 20 is connected to the vacuum chamber 22 via the exhaust tube 21, the vacuum chamber 22 is connected to the exhaust apparatus 24, and the gate valve 23 is interposed. The vacuum chamber 22 is attached to the pressure indicator 25, and the quadrupole mass analyzer (Q-mass) 26 so that the inside pressure and each residual gases partial pressure can be monitored. Since it is difficult to directly measure the pressure inside the envelope 17 and the partial pressure, the pressure of the vacuum chamber 22 and the partial pressure are measured, and the value is regarded as the value inside the envelope 17. The exhaust apparatus 24 is an ultrahigh vacuum exhaust apparatus comprising the sorption pump and the ion pump. The vacuum chamber 22 is connected to a plurality of gas introduction apparatuses, and the substances stored in the substance source 29 can be introduced. The cylinder or the ample is filled with the introduction substances according to the type, and the introduction amount can be controlled by the gas introduction amount control means 28. For the gas introduction amount control means 28, a needle valve, a mass flow controller, and the like are used in accordance with the type, flow rate, and necessary control precision of the introduction substance. In the present example, benzonitrile $C_6H_5CN$ placed in the glass ample was used as the substance source 29, and the slow leak valve was used as the gas introduction amount control means 28.

The above vacuum operation apparatus was used to perform the subsequent steps.

Step-i

The inside of the envelope 17 was evacuated, the pressure was set to $1\times10^{-3}$ Pa (pascal) or less, and the above-described electroconductive film, arranged on the electron source substrate 51, for forming a plurality of electron-emitting parts was subjected to the following forming operation to form the electron-emitting parts.

Figure 18:
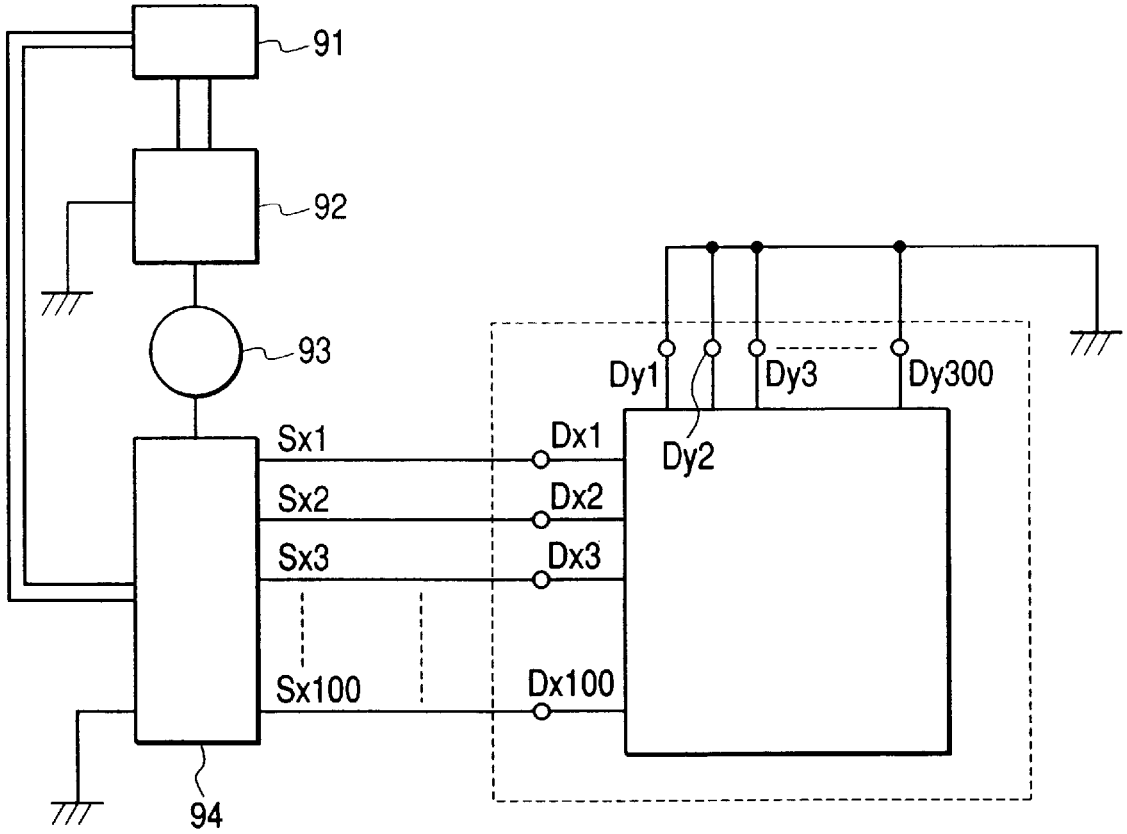
FIG. 18 is a schematic diagram showing the constitution of a circuit for use in a forming operation and an activation operation in the manufacture process of the image display.
Figure 19A:
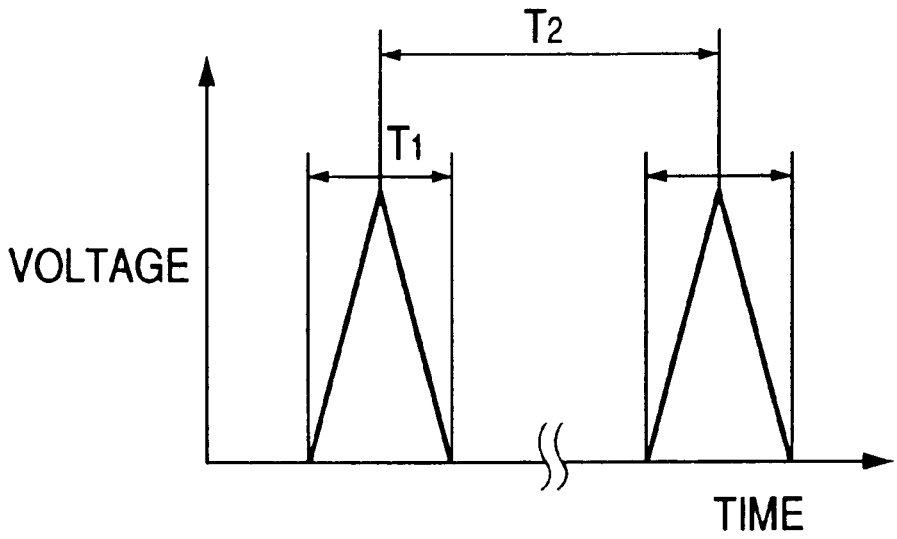
FIGS. 19A and 19B are graphs showing the examples of voltage waveform for use in the forming operation and activation operation.

As shown in FIG. 18, the Y-directional wirings are connected in common to the ground. Numeral 91 denotes a control apparatus for controlling a pulse generator 92 and a line selecting apparatus 94. Numeral 93 denotes an ammeter. The line selecting apparatus 94 selects one line from the X-directional wiring, and a pulse voltage is applied to the line. The forming operation was performed on X-directional device rows by each row (300 devices). For the applied pulse waveform, a triangular wave pulse was applied as shown in FIG. 19A, and the crest value was gradually raised. The pulse width T1=1 msec., the pulse interval T2=10 msec. were set. Moreover, by inserting a rectangular wave pulse with a crest value of 0.1 V between the triangular wave pulses to measure the current, each row resistance value was measured. When the resistance value exceeded 3.3 kΩ (1 MΩ per device), the forming of the row was finished, and the next row operation was performed. By performing this operation on all the rows, and completing the forming of all the electroconductive films (electroconductive films 108 for forming the electron-emitting parts), the electron-emitting parts were formed on the electroconductive films. The electron source substrate 51 with a plurality of surface conduction electron-emitters subjected to the passive matrix wiring was formed in this manner.

Step-j

Figure 19B:
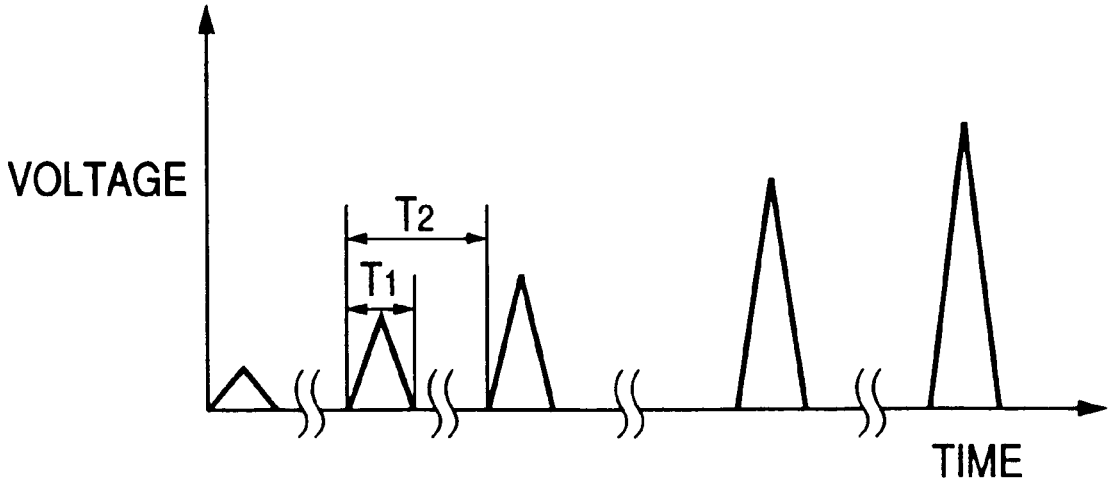

While benzonitrile $C_6H_5CN$ was introduced into the vacuum chamber 123, the partial pressure was adjusted to $1.3\times10^{-3}$ Pa (pascal), and the device current If was measured, the pulse was applied to the above-described electron source and the activation operation of each electron-emitter was performed. The pulse waveform generated by the pulse generator 92 is a rectangular wave shown in FIG. 19B, the crest value is 14V, the pulse width T1=100 μsec., and the pulse interval is 167 μsec. The line selecting apparatus 94 successively changes over the selected line from Dx1 to Dx100 each 167 μsec., and as a result, a rectangular wave of T1=100 μsec., T2=16.7 msec. is applied to each device row by slightly shifting the phase for each row.

The ammeter 93 is used in the mode for detecting the average of the current values while the rectangular pulse is in an on state (when the voltage is 14V). When this value reached 600 mA (2 mA per emitter), the activation operation was finished, and the envelope 17 was evacuated.

Step-k

While the evacuation was continued, the image display 20 and vacuum chamber 22 were entirely held at 300° C. for 24 hours by the heating apparatus (not shown). It could be confirmed by observation with the Q-mass 26 that benzonitrile $C_6H_5CN$ supposedly absorbed by the envelope 17 and the inner wall of the vacuum chamber 22 and the decomposed substances were removed by the operation. Additionally, the partial pressure of the major inorganic gas in the envelope 17 decreased as compared with before the step-k was performed. It has been found that the heating operation of this step-k also serves as the getter activation operation, and that the non-evaporable getter 56 disposed on the upper wiring 52 of the electron source substrate 51 absorbs the gas in the envelope 17.

Step-l

Subsequently, the step for displaying the image on the image display of the example 8 was performed.

The electron source is successively driven by each line, and the electron emission of 60 Hz is caused in each row device. First, Va=4 kV was applied to the high voltage terminal Hv connected to the metal back 15. Thereafter, the voltage was raised to Va=6 kV, thereby allowing the phosphor to emit gas. The apparatus of the present example is supposed to be used at Va=5 kV, and by performing irradiation beforehand with a higher voltage, the gas emission during the actual use is decreased.

Step-m

After confirming that the pressure reached $1.3\times10^{-5}$ Pa or less, the exhaust tube was heated with the burner and sealed out.

The image display of the present example was formed as described above.

Comparative Example 7

In this comparative example, the image forming apparatus provided with the non-evaporable getter according to the above-described example 8 is compared with the image forming apparatus provided with no getter. In this comparative example, the steps similar to those of the example 8 were performed until the step-e, and subsequently, the step g and the subsequent steps were performed, so that the image forming apparatus with no non-evaporable getter disposed thereon was formed.

The partial pressure of the envelope of the image forming apparatus formed in this manner and provided with no non-evaporable getter was measured with the Q-mass 26, and compared with that of the image forming apparatus provided with the non-evaporable getter of the example 8.

As a result, for the partial pressure of the major inorganic gas in the envelope (mass number: 2, 18, 28, 32, 44), the image forming apparatus of the example 8 with the non-evaporable getter disposed thereon indicated a lower value by one digit or more as compared with the image forming apparatus of the comparative example 7 with no getter disposed thereon.

Thereafter, after confirming that the pressure reached $1.3\times10^{-5}$ Pa or less, the exhaust tube was heated with the burner and sealed out, and the image display of the comparative example 7 was formed.

Comparative Example 8

In this comparative example, the image forming apparatus provided with the non-evaporable getter is compared with the image forming apparatus provided with the conventional non-evaporable getter. In this comparative example, the steps similar to those of the example 8 were performed except that the non-evaporable getter: HS405 was formed into the film on the upper wiring in the step-f (Ti was not deposited). Thereafter, the step g and the subsequent steps were performed, so that the image display was formed.

The partial pressure of the envelope constituting the image forming apparatus of the comparative example 8 was measured with the Q-mass 26. However, the partial pressure of the major inorganic gas (mass number: 2, 18, 28, 32, 44) indicated no large difference from the image forming apparatus with the deposited non-evaporable getter of the example 8 disposed thereon. Moreover, the partial pressure of the envelope of the comparative example 8 indicated a lower value than that of the image forming apparatus of the comparative example 7 with no getter disposed thereon.

Thereafter, the exhaust tube of the image forming apparatus of the comparative example 8 was heated with the burner and sealed out.

The comparison/evaluation of the image displays of the example 8, comparative examples 7 and 8 was performed. In the evaluation, passive matrix driving was performed, the entire surface of the image display was continuously lit, and the change of luminance was observed with the elapse of time. The luminance in the initial driving was different, but when the continuous lighting was continued for a long time, first, the drop in luminance of the image display of the comparative example 7 became conspicuous, and subsequently the image display of the comparative example 8 was darkened. On the other hand, for the image display of the example 8, the drop in luminance was found, but the proportion was little as compared with the image displays of the comparative examples 7 and 8, and further driving for a long time was enabled.

EXAMPLE 9

In the present example, the deposited non-evaporable getter is disposed in the periphery of the image display region.

In the present example, during the step-a to step-e, the steps similar to those of the example 8 were performed.

Step-f

A film of Ti was formed on the surface of the non-evaporable getter: HS405 ribbon (manufactured by Japan Getters Co., Ltd.) mainly containing Zr by the electron beam deposition process, to form the non-evaporable getter. Additionally, the base material of HS405 ribbon was prepared by forming a layer of HS405 powder on a 2 mm wide nichrome plate by an argon plasma spray coating process. This non-evaporable getter was fixed to the part corresponding to the periphery of the image display region of the electron source substrate formed to the step-e. The fixing was performed by fixing, to the support frame, the nichrome wire attached to both ends of the non-evaporable getter (ribbon) by spot welding. During the fixing, due attention was paid to avoid the contact with the extracted wiring of the electron source substrate, and to avoid the protruding to the image display region.

For the step-g and the subsequent steps, the steps similar to those of the example 8 were performed, to complete the image display.

EXAMPLE 10

In the present example, the non-evaporable getter is disposed both in the periphery of the image display region and the inside of the image display region. The present example is applied when the image display region is enlarged. In the present example, for the step-a to step-e, the steps similar to those of the example 8 were performed.

Step-f

In a similar manner as the step-f of the example 8, the non-evaporable getter was formed into a film on the upper wiring of the electron source substrate. Subsequently, in a similar manner as the step-f of the example 9, the non-evaporable getter (ribbon) was fixed to the periphery of the image display region.

For the step-g and the subsequent steps, the steps similar to those of the example 8 were performed, to complete the image display.

The luminance evaluation of the image displays of the examples 9, 10 was performed. In the evaluation, the passive matrix driving was performed, the entire surface of the image display was continuously lit, and the change of luminance was observed with the elapse of time. The luminance gradually lowers as the lighting continues, but the proportion of the drop was remarkably low as compared with the proportion of the luminance drop in the comparative examples 7 and 8, and further driving for a long time was enabled.

Since in the examples 8 to 10, the non-evaporable getter of the present example is disposed, the vacuum of the envelope can be kept for a long time, the influence of the emission gas is reduced, and the luminance drop is supposedly prevented.

Particularly, as compared with the comparative example 8 with the conventional non-evaporable getter disposed therein, the prevention of the luminance drop after the long-time driving was recognized.

Moreover, it has been recognized that even when the place and area for disposing the non-evaporable getter are changed as in the examples 8 to 10, the getter is sufficiently satisfactory against the luminance drop after the long-time driving, and it has been found that the place for disposing the non-evaporable getter can be selected in accordance with the size of the image display.

EXAMPLE 11

The present example shows a case in which the non-evaporable getter according to a preparing method different from that of the example 8 is used. During the step-a to step-e, the steps similar to those of the example 8 were performed.

Step-f

Figure 20A:
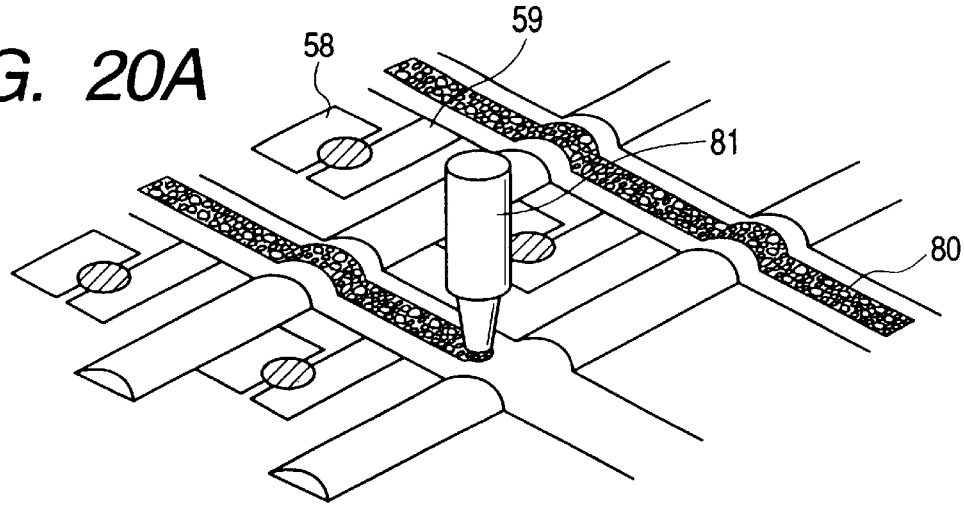
FIGS. 20A, 20B and 20C are schematic views showing that a dispenser is used to apply a paste containing the non-evaporable getter and adhesive to an upper wiring, formation is performed, and Ti is further formed.
Figure 20B:
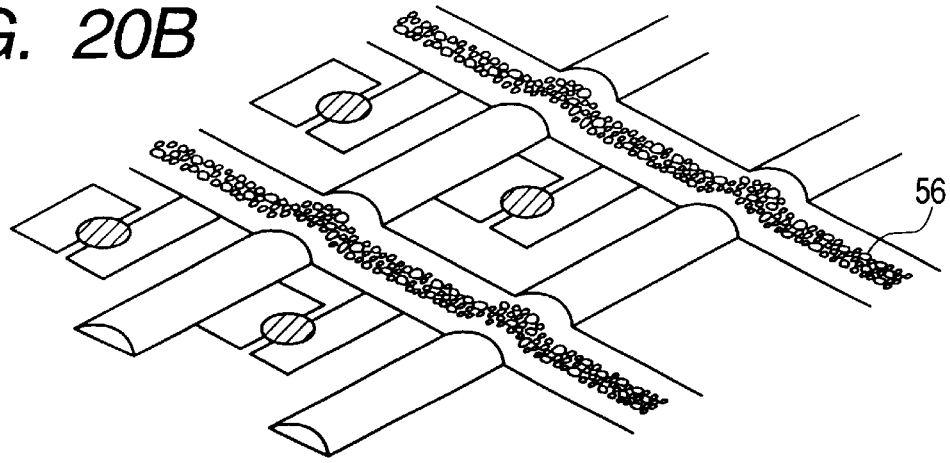
Figure 20C:
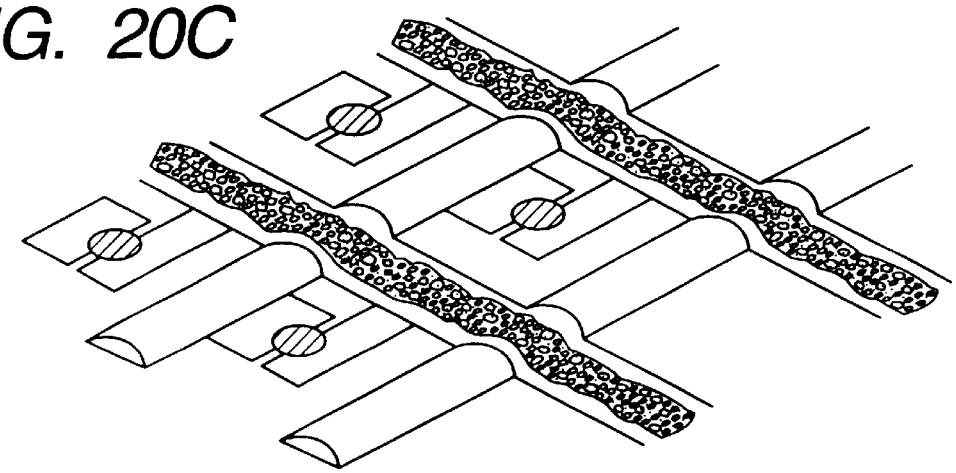

FIGS. 20A, 20B and 20C are process diagrams in which the paste containing the non-evaporable getter and adhesive is used to form the non-evaporable getter on the upper wiring.

A dispenser 81 was used on the upper wiring pattern formed in the step-d to apply a paste 80 containing the non-evaporable getter powder and adhesive (FIG. 20A). For the non-evaporable getter, the non-evaporable getter: HS405 powder (manufactured by Japan Getters Co., Ltd.) mainly containing Zr passed through a 50 $\mu$m mesh sieve and having an average particle diameter of 20 $\mu$m was used, and the adhesive formed by dissolving and liquefying a ladder-like silicon-based oligomer: GR650 (manufactured by U.S. OI-NEG TV Products, Inc.) in an organic solvent of cyclohexanol was used. This non-evaporable getter powder was mixed with the adhesive and formed into the paste. The weight ratio was set to the non-evaporable getter: GR650 : cyclohexanol=10:1:10.

Thereafter, calcining was performed in the atmosphere of $1.33\times10^{-4}$ Pa ($1\times10^{-6}$ Torr) or less at 280° C. to evaporate cyclohexanol, and the bonding reaction of the silicon and oxygen atoms of the adhesive was promoted to bond the non-evaporable getter on the upper wiring (FIGS. 17F, 20B). This silicon-based adhesive scarcely emitted gas, and the ability of the non-evaporable getter was hardly deteriorated.

When the formation was performed with this ratio, the adhesion of the non-evaporable getter and wiring was sufficient, there was no falling, and the metal surface of the non-evaporable getter was not coated with silicon.

After the exposure to the atmospheric air, subsequently by covering the metal mask in which the site with the non-evaporable getter bonded thereto was opened, Ti was formed into a 2 $\mu$m film on the non-evaporable getter by the electron beam deposition (FIG. 20C).

The above-described method of applying the paste containing the non-evaporable getter and adhesive is not limited to the dispenser, and the printing processes such as the screen process and the offset process, or the method of aligning the metal mask having the opening with the wiring part, attaching the mask to the electron source substrate and applying the paste thereon can be used. Furthermore, since the metal mask is used for patterning during Ti film formation, the alignment of the metal mask may be performed once.

During the step-g to step-m, the steps similar to those of the example 8 were performed, and the image display of the present example was prepared.

The partial pressure of the envelope of the image forming apparatus provided with the non-evaporable getter of the present example was measured with the Q-mass 26, and compared with the partial pressure of the envelope of the image forming apparatus of the comparative example 7 with no getter disposed thereon. As a result, for the partial pressure of the major inorganic gas (mass number: 2, 18, 28, 32, 44) inside the envelope, the image forming apparatus of the example 11 with the non-evaporable getter disposed thereon indicated a lower value by one digit or more as compared with the image forming apparatus of the comparative example 7 with no getter disposed thereon.

The evaluation/comparison was performed on the image display of the example 11, and the image display of the comparative example 7 after the exhaust tube was heated with the burner and sealed out. In the evaluation, the passive matrix driving was performed, the entire surface of the image display was continuously lit, and the change of luminance was observed with the elapse of time. The luminance in the initial driving was different, but when the continuous lighting was continued for a long time, the drop in luminance of the image display of the comparative example 7 became conspicuous, but in the image display of the example 11, the drop in luminance was found, but the proportion was little as compared with the image display of the comparative example 7, and further the driving for a long time was enabled. As described above, the non-evaporable getter was formed in the envelope using the adhesive, the vacuum degree in the envelope could be maintained to be low, and the effect of suppressing the drop of the luminance was confirmed.

Moreover, as compared with when Ti is not formed on the non-evaporable getter, when Ti is formed, the partial pressure of the major inorganic gas (mass number: 2, 18, 28, 32, 44) in the envelope is low in many cases, and the luminance drop of the image display is further reduced. Therefore, it is found that by forming Ti, the deterioration of the absorbing ability of the non-evaporable getter by the process of forming the envelope is suppressed.

EXAMPLE 12

In the present example, Ti is formed into a film on the non-evaporable getter beforehand, the non-evaporable getter with the film of Ti formed thereon is formed on the wiring, and the steps similar to those of the example 8 were performed during the step-a to step-e.

Step-f

The non-evaporable getter: HS405 powder (manufactured by Japan Getters Co., Ltd.) mainly containing Zr passed through the 50 $\mu$m mesh sieve and having the average particle diameter of 20 $\mu$m, and the adhesive formed by dissolving and liquefying the ladder-like silicon-based oligomer: GR650 (manufactured by U.S. OI-NEG TV Products, Inc.) in the organic solvent of cyclohexanol were mixed, and further colloid of titanium dioxide (Japan Aerogel Co., Ltd. titanium dioxide P25 13463-67-7) was mixed to form the paste. In this case, the weight ratio was set to the non-evaporable getter: GR650 : cyclohexanol:titanium dioxide colloid=10:1:10:0.1. This paste was applied to the upper wiring pattern formed in the step-d using the dispenser 81, and calcined in the atmosphere of $1.33\times10^{-4}$ Pa ($1\times10^{-6}$ Torr) or less at 280° C. to evaporate cyclohexanol, and the bonding reaction of the silicon and oxygen atoms of the adhesive was promoted to bond the non-evaporable getter onto the upper wiring.

In the step-g and subsequent steps, the steps similar to those of the example 8 were performed, to complete the image display.

When the image display formed as described above was subjected to the luminance evaluation similar to that of the example 11, in a similar manner as the example 11, the proportion of the luminance drop was small as compared with the comparative example 7, the vacuum degree in the envelope could be maintained to be low, and the effect of suppressing the drop of the luminance was confirmed.

Moreover, in the present example, Ti colloid was used to form Ti on the non-evaporable getter particles, but this is not limited, and even by forming Ti beforehand on the non-evaporable getter particles by the film forming process such as deposition, and forming the getter on the wiring using the adhesive, the similar effect can be obtained.

EXAMPLE 13

Figure 21A:
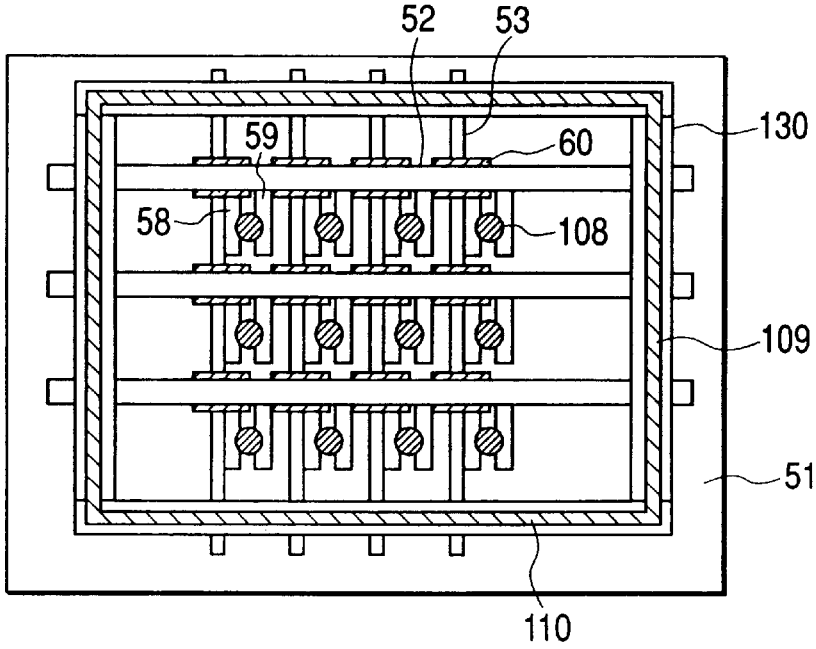
FIGS. 21A and 21B are arrangement diagrams of the non-evaporable getters of examples 13, 14.

In the present example, the non-evaporable getter is disposed in the periphery of the image display region, and an arrangement diagram is shown in FIG. 21A. In the present example, the steps similar to those of the example 8 were performed during the step-a to step-e.

Step-f

The screen printing process was used to print an insulating film 130 on the peripheral wiring as shown in FIG. 21A, and the film was calcined at 400° C. and formed.

In a similar manner as the step-f of the example 11 the paste 80 of the non-evaporable getter and adhesive was applied to the above-described insulating layer 130 using the dispenser 81, and calcined in the atmosphere of $1.33\times10^{-4}$ Pa ($1\times10^{-6}$ Torr) at 280° C., to bond the non-evaporable getter onto the insulating film 130.

Subsequently, after the exposure to the atmospheric air, the film of Ti was formed on the non-evaporable getter by the sputtering process.

In the step-g and subsequent steps, the steps similar to those of the example 8 were performed, to complete the image display.

When the image display formed as described above was subjected to the luminance evaluation similar to that of the example 11, the proportion of the luminance drop was small as compared with the comparative example 7, the vacuum degree in the envelope could be maintained to be low, and the effect of suppressing the luminance drop was confirmed.

EXAMPLE 14

Figure 21B:
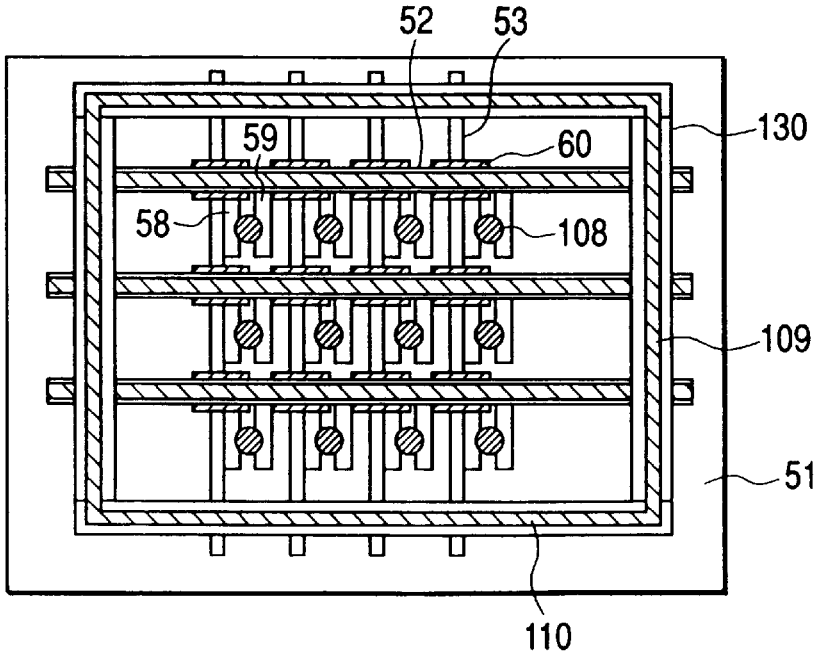

In the present example, the non-evaporable getter is disposed both in the periphery of the image display region and the inside of the image display region, and an arrangement diagram is shown in FIG. 21B. The present example is applied when the image display region is enlarged. In the present example, the steps similar to those of the example 8 were performed during the step-a to step-e.

Step-f

In a similar manner as the step-3 of the example 13, the screen printing process was used to print the insulating film 130 on the peripheral wiring as shown in FIG. 21A, and the film was calcined at 400° C. and formed.

Subsequently, in a similar manner as the step-f of the example 11 the paste 80 of the non-evaporable getter and adhesive was applied to the upper wiring, the lower wiring, and the above-described insulating layer using the dispenser 81, and calcined in the atmosphere of $1.33\times10^{-4}$ Pa ($1\times10^{-6}$ Torr) at 280° C., to bond the non-evaporable getter onto the insulating film.

Subsequently, after the exposure to the atmospheric air, the film of Ti was formed on the non-evaporable getter by the jet print system process.

In the step-g and subsequent steps, the steps similar to those of the example 8 were performed, to complete the image display.

The image display of the example 14 was subjected to the luminance evaluation in a similar manner as the examples 11, 12, 13. The proportion of the luminance drop was remarkably small as compared with the comparative example 7, and the examples 11, 12, and further the driving could be performed for a long time.

In the examples 11 to 14, since the non-evaporable getter is disposed, the vacuum in the envelope can be kept for a long time, the influence of the emission gas is reduced, and the luminance drop is supposedly prevented. Moreover, by using the adhesive, the non-evaporable getter can be formed in the envelope without using the vacuum film forming or the photolithography process.

Furthermore, it has been recognized that even when the place and area for disposing the non-evaporable getter are changed as in the examples 11 to 14, the getter is sufficiently satisfactory against the luminance drop after the long-time driving, and it has been found that the place for disposing the non-evaporable getter can be selected in accordance with the size of the image display.

EXAMPLE 15

The image forming apparatus of the present example has a constitution similar to that of the apparatus schematically shown in FIGS. 10A and 10B, and the non-evaporable getter is disposed on the X-directional wiring (lower wiring) and Y-directional wiring (upper wiring) formed in the printing process.

In the present example, during the step-a to step-e, the steps similar to those of the example 8 were performed.

Step-f

A nichrome substrate with a thickness of 50 $\mu$m, width of 2 mm and length of 100 mm was prepared, the layer of the non-evaporable getter HS405 powder manufactured by Japan Getters Co. was formed on the nichrome substrate by the vacuum plasma spray coating process by the argon plasma, and a first layer of the non-evaporable getter was formed. The thickness of the first layer was about 50 $\mu$m. After the exposure to the atmospheric air, a film of Ti was formed in about 2 $\mu$m as a second layer by the electron beam deposition process. As described above, the non-evaporable getter 10 was formed, and attached to the support frame 3 using the getter fixing jig 9.

The electron source substrate provided with the non-evaporable getter was formed in this manner.

Step-g

Subsequently, the face plate 4 shown in FIGS. 10A and 10B was formed as follows. The glass base material 6 was sufficiently cleaned using the detergent, pure water and organic solvent. The fluorescent film 7 was applied on the base material by the printing process, the surface was subjected to a smoothing treatment (usually referred to as "filming"), and a phosphor part was formed. Additionally, the fluorescent film 7 was formed like the fluorescent film shown in FIG. 8A in which the striped phosphors (R, G, B) 14 and the black conductive materials (black stripes) 15 are alternately arranged (FIG. 8A shows the phosphor 62 and the black conductive material 61). Furthermore, the 0.1 $\mu$m thick metal back 8 by the Al thin film was formed on the fluorescent film 7 by the sputtering process.

Step-h

The envelope 5 shown in FIGS. 10A and 10B was prepared as follows.

After fixing the electron source substrate 1 formed in the above-described step to a reinforcing plate (not shown), the support frame 3 with the non-evaporable getter 10 attached thereto, and the above-described face plate 4 were combined, the lower wiring 52 and upper wiring 53 of the electron source substrate 1 were connected to the row selecting terminal and signal input terminal, respectively, and the positions of the electron source substrate 1 and face plate 4 were strictly adjusted, and sealed to form the envelope 5. The sealing method comprised: applying the fritted glass to the bonded part; and performing the thermal treatment in Ar gas at 450° C. for 30 minutes to perform bonding. Additionally, the electron source substrate 1 was fixed to the reinforcing plate by a similar operation.

Figure 22:
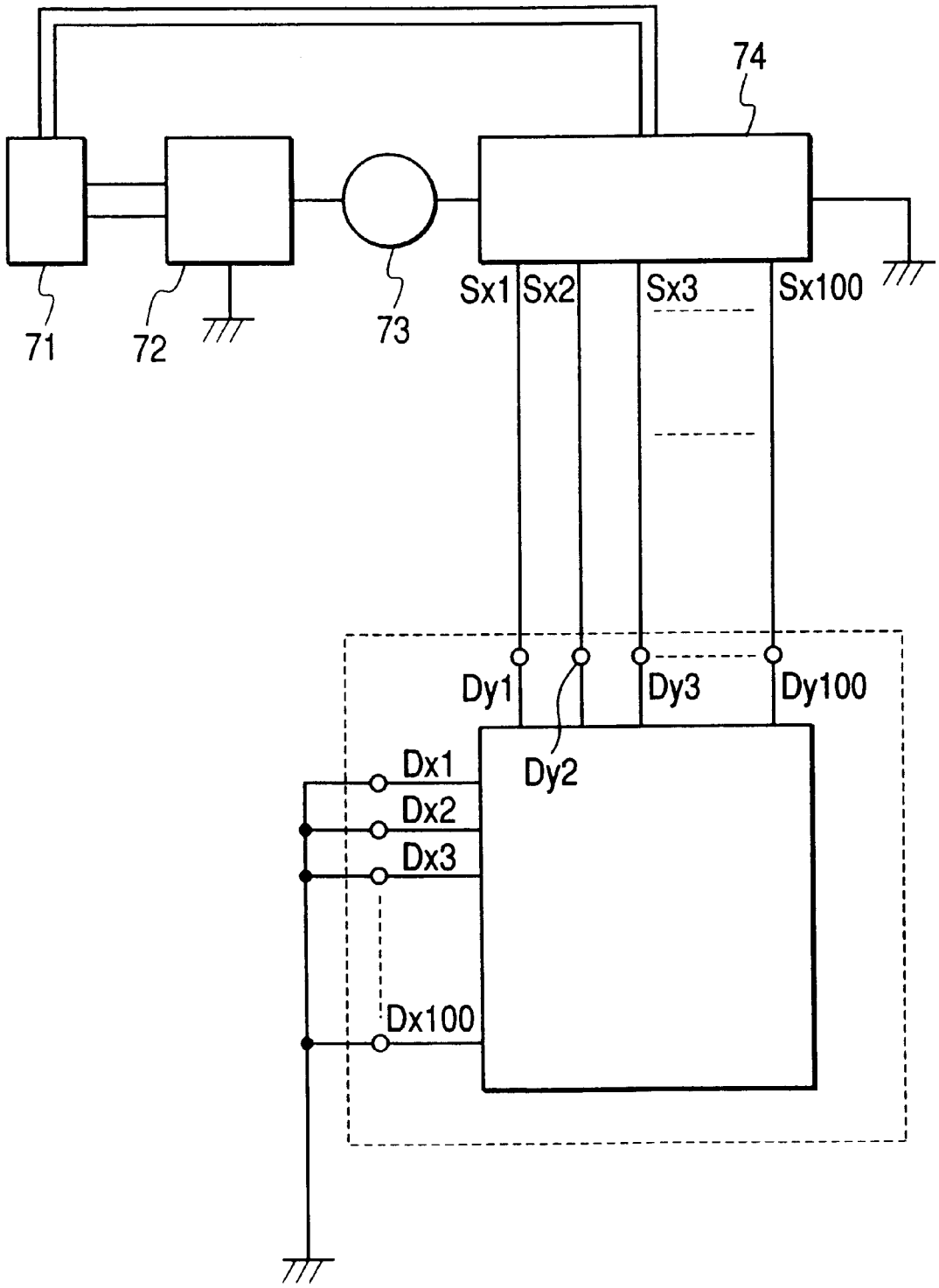
FIG. 22 is a schematic diagram showing a manufacture evaluation apparatus which is connected to various apparatuses for manufacturing the image forming apparatus of the present invention.

Subsequently, the vacuum apparatus shown in FIG. 13 was used, and the necessary apparatuses were connected as shown in FIG. 22 to perform the following step.

Step-i

The inside of the envelope 5 was evacuated, the pressure was set to $1\times10^{-3}$ Pa or less, and the above-described electroconductive film, arranged on the electron source substrate 1, for forming a plurality of electron-emitting parts was subjected to the following operation (referred to as forming) to form the electron-emitting parts.

As shown in FIG. 22, the X-directional wirings are connected in common to the ground. In FIG. 22, numeral 71 denotes a control apparatus for controlling a pulse generator 72 and a line selecting apparatus 74. Numeral 73 denotes an ammeter. The line selecting apparatus 74 selects one line from the Y-directional wiring 3, and a pulse voltage is applied to the line. The forming operation was performed on Y-directional device rows by each row (300 devices). For the applied pulse waveform, a triangular wave pulse was applied, and the crest value was gradually raised. The pulse width T1=1 msec., the pulse interval T2=10 msec. were set. Moreover, by inserting a rectangular wave pulse with a crest value of 0.1 V between the triangular wave pulses to measure the current, each row resistance value was measured. When the resistance value exceeded 3.3 kΩ (1 MΩ per device), the forming of the row was finished, and the next row operation was performed. By performing this operation on all the rows, and completing the forming of all the electroconductive films (electroconductive films for forming the electron-emitting parts), the electron-emitting parts were formed on the electroconductive films, and the electron source substrate 1 with a plurality of surface conduction electron-emitters subjected to the passive matrix wiring was formed.

Step-j

While benzonitrile placed beforehand in the substance source 29 was introduced into the vacuum chamber 22, the pressure was adjusted to $1.3\times10^{-3}$ Pa, and the device current If was measured, the pulse was applied to the above-described electron source and the activation operation of each electron-emitter was performed. The pulse waveform generated by the pulse generator 72 is a rectangular wave, the crest value is 14V, the pulse width T1=100 $\mu$sec., and the pulse interval is 167 $\mu$sec. The line selecting apparatus 74 successively changes over the selected line from Dy1 to Dy100 each 167 $\mu$sec., and as a result, a rectangular wave of T1=100 $\mu$sec., T2=16.7 msec. is applied to each device row by slightly shifting the phase for each row.

The ammeter 73 is used in the mode for detecting the average of the current values while the rectangular pulse is in the on state (when the voltage is 14V), and when this value reached 600 mA (2 mA per device), the activation operation was finished, and the envelope 5 was evacuated.

Step-k

While the evacuation was continued, the image display 20 and vacuum chamber 22 were entirely held at 300° C. for 10 hours by the heating apparatus (not shown). By this operation, benzonitrile supposedly absorbed by the envelope 5 and the inner wall of the vacuum chamber 22 and the decomposed substances were removed. This was confirmed by the observation with the Q-mass 26.

In this step, by the heating/evacuation holding of the image forming apparatus, not only the removal of gas from the inside is performed, but also the activation operation of the non-evaporable getter is performed.

In this case, the heating was performed at 300° C. for ten hours, but this is not limited, and even by performing the heating at a higher temperature in a range in which no adverse influence is exerted to the member, the similar effect can needless to say be obtained. Moreover, even in a low temperature of 300° C. or less, by lengthening the heating time, the similar effect is obtained in the removing of benzonitrile and the activation of the non-evaporable getter.

Step-m

After confirming that the pressure reached $1.3\times10^{-5}$ Pa or less, the exhaust tube 21 was heated with the burner and sealed out.

The image display of the present example was formed as described above.

Comparative Example 9

Figure 23:
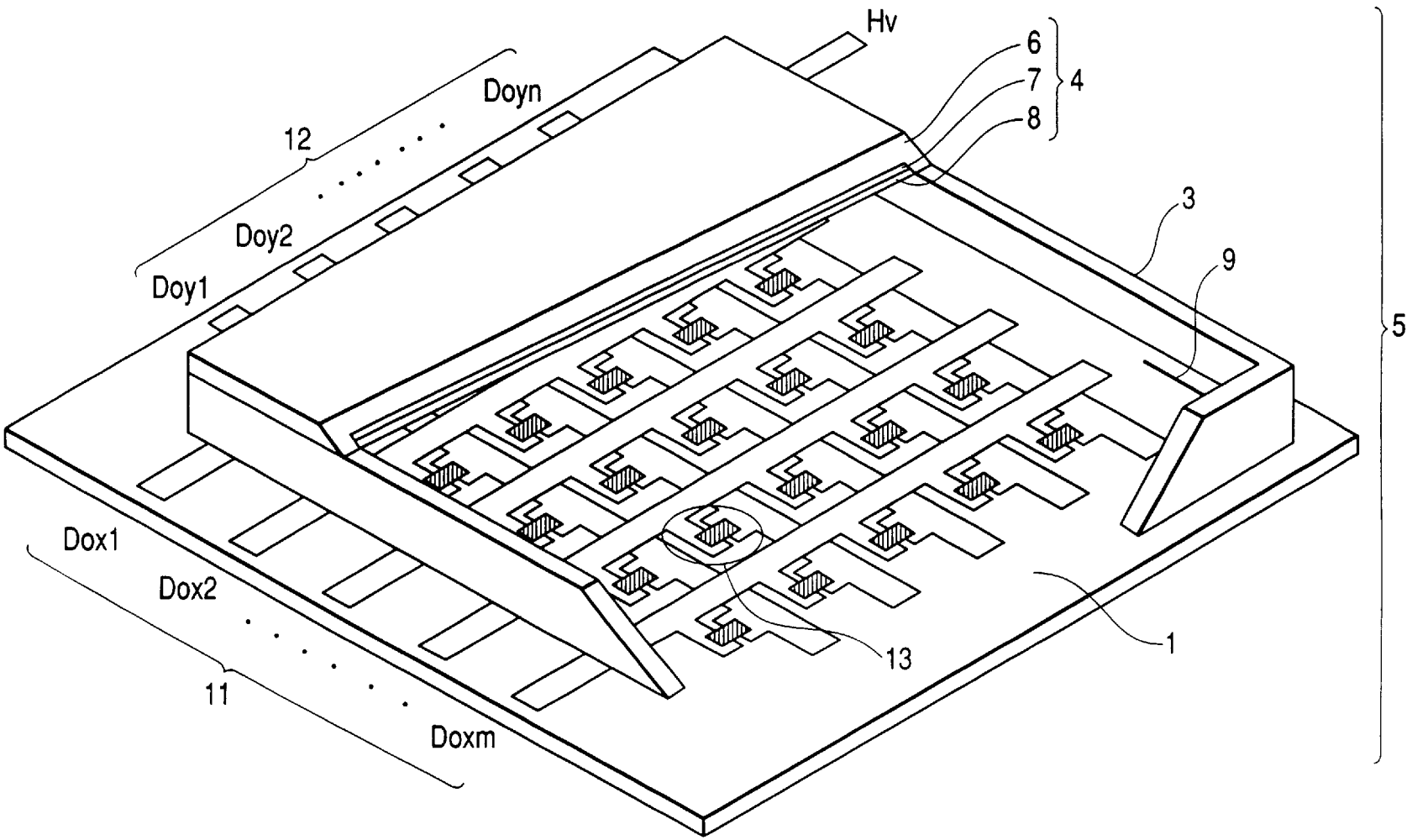
FIG. 23 is a diagram showing the constitution of the image forming apparatus of a comparative example.

The image forming apparatus similar to that of the example 15 and shown in FIG. 23 was formed. Additionally, in this comparative example, the constitution is similar to that of the image forming apparatus of FIGS. 10A and 10B, but the non-evaporable getter of the example 15 is not disposed. The image forming apparatus of this comparative example was formed in the constitution and method similar to those of the example 15.

Comparative Example 10

The image forming apparatus similar to that of the example 15 was formed. In this comparative example, the constitution is similar to that of the image forming apparatus of FIGS. 10A and 10B, but instead of the non-evaporable getter of the example 15, the commercial non-evaporable getter is disposed in the constitution. The image forming apparatus of this comparative example was formed in the constitution and method similar to those of the example 15.

Comparative Example 11

Figure 24:
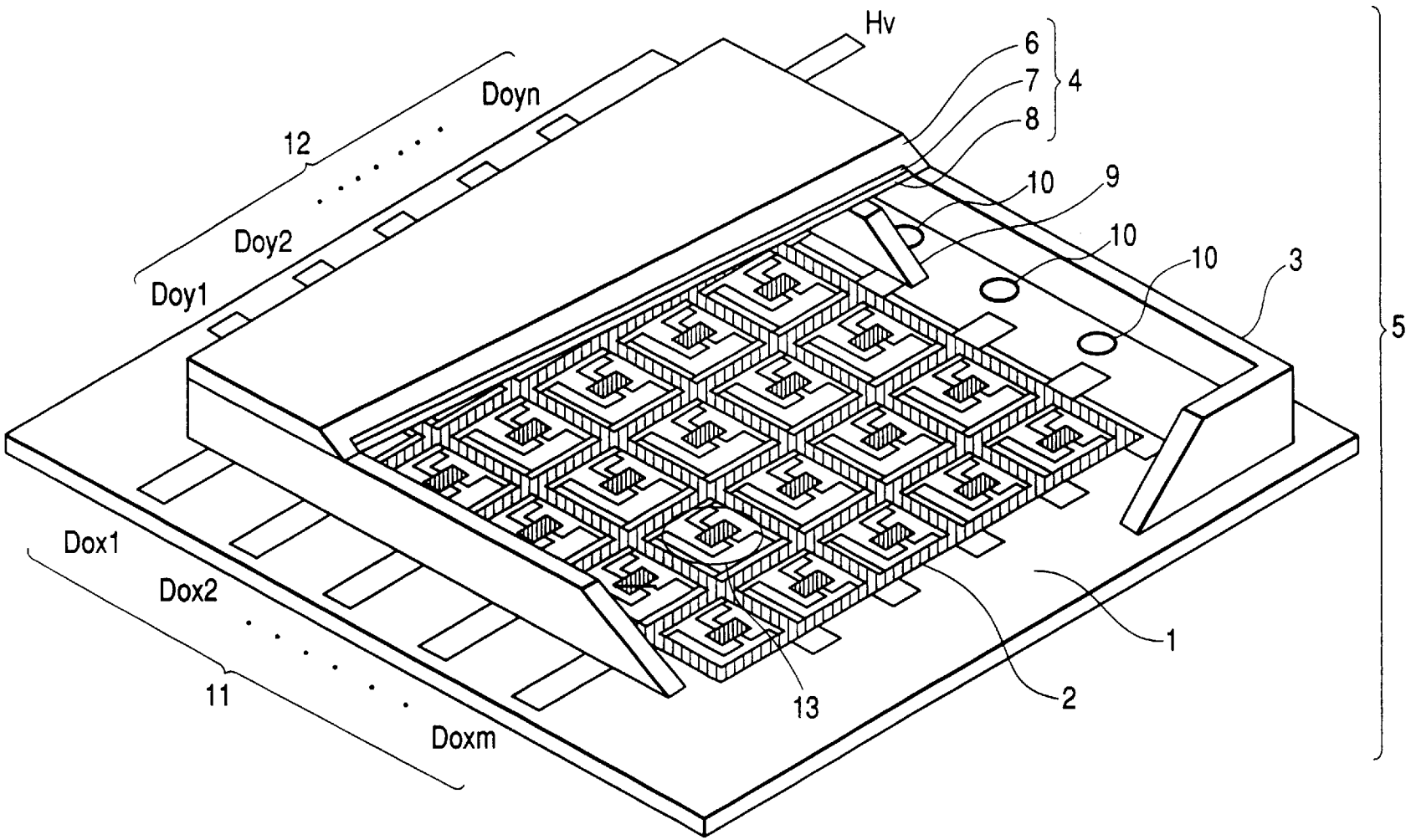
FIG. 24 is a diagram showing another constitution of the image forming apparatus of the comparative example.
Figure 25A:
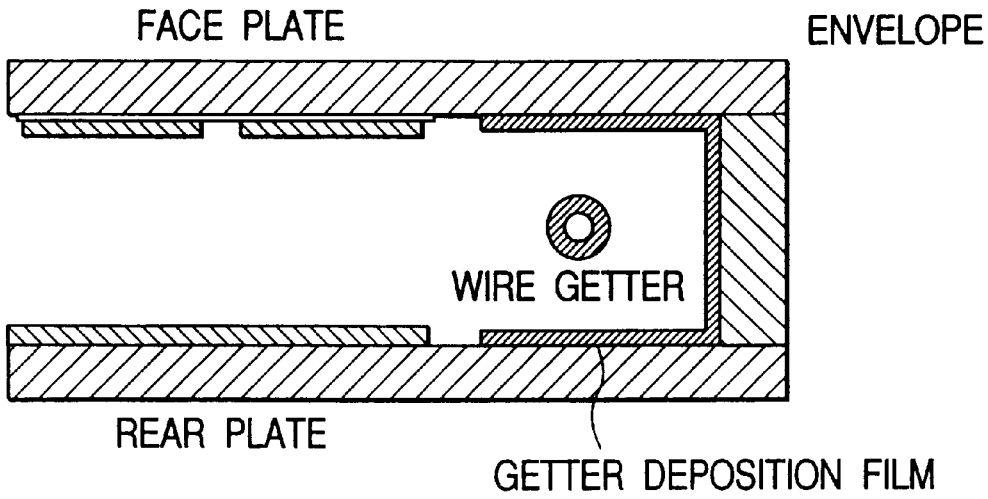
FIGS. 25A and 25B are sectional views of parts related with the getter treatment of a conventional flat panel display.
Figure 25B:
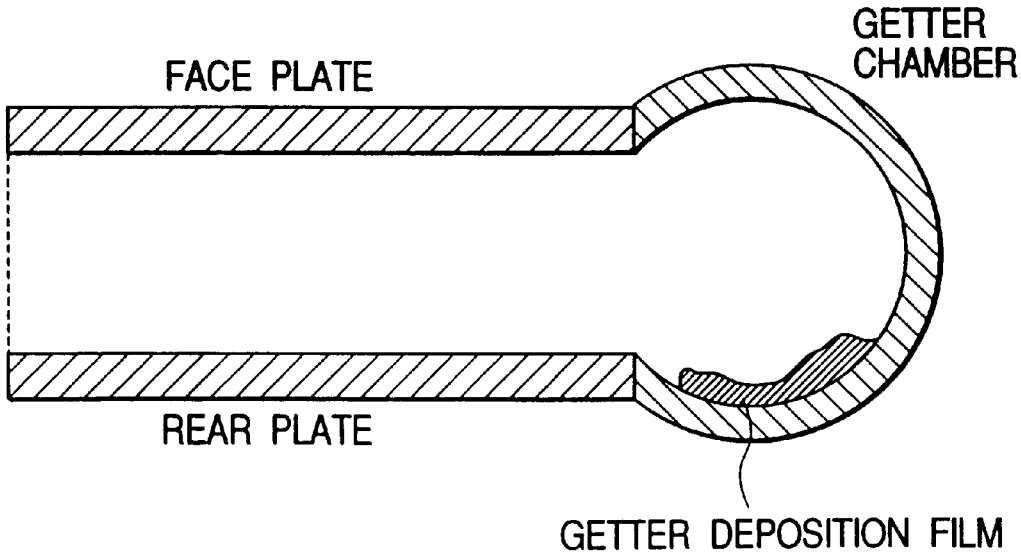

The image forming apparatus of FIG. 24 similar to that of the example 15 was formed. Additionally, in this comparative example, the constitution is similar to that of the image forming apparatus of FIGS. 10A and 10B, but instead of the non-evaporable getter of the example 15, the commercial non-evaporable getter is disposed in the constitution. In this comparative example, after the sealing, a step of flushing the non-evaporable getter by high-frequency heating to form the getter film was performed. Excluding this respect, the image forming apparatus of this comparative example was formed in the constitution and method similar to those of the example 15.

EXAMPLE 16

FIG. 11 shows a perspective view showing the characteristics of the present example most. A difference from the example 15 lies in that the multilayered non-evaporable getter is formed on the X-directional wiring and Y-directional wiring.

The present example is common to the example 15 except that instead of the step-f of the example 15, the following described step f was performed.

Step-f

After a metal mask having the opening shaped like the upper wiring and lower wiring was prepared, and sufficient positioning was performed, the non-evaporable getter HS405 powder manufactured by Japan Getters Co. was formed into a film by the vacuum plasma spray coating process by argon plasma, so that a first layer of the non-evaporable getter was formed. The film thickness of the first layer was 50 μm. After the exposure to the atmospheric air, a film of Ti was subsequently formed as a second layer in about 2 μm by the electron beam deposition process (FIG. 17F).

The image forming apparatus of the present example was formed as described above.

EXAMPLE 17

FIG. 12 is a perspective view showing the characteristics of the present example most.

A difference from the examples 15 and 16 lies in that the non-evaporable getter of the present example was formed not only on the outside of the image display region, but also on the X-directional wiring and Y-directional wiring inside the image display region.

In the present example, as the step-f, the step-f of the example 15 and the step-f of the example 16 were performed in parallel.

The comparison/evaluation was performed on the above-described image forming apparatuses of the examples 15 to 17 and comparative examples 9 to 11. In the evaluation, the passive matrix driving was performed, the entire surface of the image forming apparatus was allowed to emit light, and the luminance change was observed with the elapse of time. The initial luminance differs with the examples, but the luminance relatively gradually decreases when the light emitting continues. The state differs with the position of the pixel to be measured, the luminance quickly drops in the pixel of the periphery in which no non-evaporable getter 10 is disposed, and the luminance dispersion is large. Particularly, in the comparative example 9, the luminance drop is remarkable, and this comparative example is clearly inferior, of course, to the examples 15 to 17, and also to the comparative examples 10, 11. The image forming apparatuses of the comparative examples 10 and 11 both indicated a similar deterioration, but the image forming apparatuses of the examples 15 to 17 have less deterioration degrees than those of the image forming apparatuses of the comparative examples, and can display high-quality images for a long time.

EXAMPLE 18

(Step-a)

A layer of a Ti powder (Furuchi Kagaku Kabushiki Kaisha, 300 meshes) was formed on the nichrome substrate with the width of 2 mm and length of 100 mm by the plasma spray coating process using Ar plasma. The thickness of the formed film was about 50 μm. The surface with the film formed thereon was porous by the particles with particle diameters of 20 to 40 μm.

(Step-b)

After the exposure to the atmospheric air, a film of Ti was formed in about 2.5 μm on the plasma spray coated Ti powder formed in the step-a by the electron beam deposition process. For the surface with the film formed thereon, Ti grew around the Ti powder particles, and the porous state was kept. Additionally, the mathematical surface roughness Ra of the Ti plasma spray coated Ti powder formed in the step-a substantially indicated around Ra=10, and this value had no large difference even after the Ti film was formed in the step-b.

EXAMPLE 19

(Step-a)

Metal Ti was formed into a film on the cleaned nichrome substrate by the sputtering process.

(Step-b)

After the exposure to the atmospheric air, the Ti surface of the substrate formed in the step-a was subjected to the blast processing, and the surface shape was undulated. Additionally, the mathematical surface roughness Ra substantially indicated around Ra=10.

(Step-c)

A film of Ti was formed on the Ti surface of the substrate treated in the step-b using the electron beam deposition process. The mathematical average roughness Ra of the surface with the film formed thereon had no large difference from that before the Ti film was formed, and substantially indicated around Ra=10. The multilayered getter was formed on the nichrome substrate in this manner.

EXAMPLE 20

(Step-a)

The cleaned nichrome substrate was subjected to the blast processing, and the surface shape was undulated. Additionally, the mathematical surface roughness Ra substantially indicated around Ra=10.

(Step-b)

The metal Ti was formed into a film on the surface of the undulated substrate formed in the step-a by the sputtering process.

(Step-c)

After the exposure to the atmospheric air, the metal Ti was formed into a film on the substrate formed in the step-b using the electron beam deposition process. The mathematical average roughness Ra of the surface with the film formed thereon had no large difference from that before the film was formed, and substantially indicated around Ra=10. The multilayered structure getter was formed on the nichrome substrate in this manner.

EXAMPLE 21

(Step-a)

A cleaned Ti foil (manufactured by Niraco Co., Ltd.) was prepared, and subjected to the blast processing in the atmospheric air, and the surface shape was undulated. Additionally, the mathematical surface roughness Ra substantially indicated around Ra=10.

(Step-b)

The metal Ti was formed into a film on the undulated surface of the Ti foil by the electron beam deposition process. The mathematical average roughness Ra of the surface with the film formed thereon had no large difference from that before the film was formed, and substantially indicated around Ra=10. The multilayered structure getter was formed in this manner.

By using the getter described in each of the above examples, a high vacuum can be maintained in vacuo for a longer time than in the conventional art. Moreover, even after the process of heating in the atmosphere, the characteristic deterioration is remarkably little as compared with the conventional non-evaporable getter.

Moreover, by using the getter described in each of the examples, a high vacuum can be maintained in vacuo for a longer time than in the conventional art irrespective of the use of the getter material powder. Moreover, even after the process of heating in the atmosphere, the characteristic deterioration is remarkably little as compared with the conventional non-evaporable getter.

Furthermore, since the manufacture is performed in the dry system process, as compared with the U.S. Pat. No. 5,242,559 using the electrophoresis, all the processes can be handled. Additionally, different from the U.S. Pat. No. 5,456,740, since the repeated sintering in the high temperature is unnecessary, the non-evaporable getter with improved characteristics can conveniently be disposed in any place.

Moreover, according to the image forming apparatus having the getter described in each example, even after the high-temperature low-vacuum process, the vacuum of the envelope constituting the image forming apparatus can be maintained for a longer time than in the conventional art, and as a result, there can be provided the image forming apparatus little in the luminance change (luminance drop) with the elapse of time and the occurrence of the luminance dispersion with the elapse of time.

Furthermore, since the gas generated in the envelope is quickly absorbed by the getter material by disposing the getter of each example in the image display region, in the periphery of the image display region, or both in the image display region and the periphery thereof, the characteristic deterioration of the electron-emitter can be suppressed, and as a result, the luminance drop in the long-time operation can be suppressed.

Additionally, in each example, the non-evaporable getter which requires neither evaporation wiring nor container like the evaporating getter can be disposed in the image display region, in the periphery of the image display region, or both in the image display region and the periphery thereof by using the adhesive material without using the vacuum evaporation or the photolithography process.

Moreover, according to the getter of each example, since the gas generated in the envelope is quickly absorbed by the getter material, the characteristic deterioration of the electron-emitter can be suppressed, and as a result, the luminance drop in the long-time operation can be suppressed.

Furthermore, in the image forming apparatus of each example, the getter ability deterioration by the envelope forming process is suppressed, and the vacuum degree in the envelope during the image display can be kept for a longer time.

Additionally, for the non-evaporable getter, since the absorbing ability deterioration is little even after the high-temperature low-vacuum state, the gas generated in the envelope after the sealing process is quickly absorbed by the getter material by disposing the non-evaporable getter, the vacuum degree in the envelope is satisfactorily maintained, the electron emission amount from the electron-emitter is stabilized, the characteristic deterioration can be suppressed, and as a result, the luminance drop in the long-time operation, particularly the luminance drop in the vicinity of the outside of the image display region, and the luminance dispersion can be suppressed.

Moreover, the present invention is particularly effective in the image forming apparatus having no electrode structure members such as the control electrode between the electron source and the image-forming member, but even when the present invention is applied to the image forming apparatus having the control electrode, and the like, the similar effect is naturally expected.

As described above, according to the present invention, a preferable getter can be realized.

What is claimed is:

1. A getter comprising:

a substrate;

a surface being formed on said substrate and including at least one of Zr and Ti; and a getter layer formed on said surface.

2. The getter according to claim 1 wherein said getter layer contains at least a non-evaporable getter material.

3. The getter according to claim 1 or 2 wherein said getter layer contains at least Ti.

4. The getter according to claim 1 wherein said getter layer is formed by depositing an evaporated material.

5. The getter according to claim 1 wherein said base surface is porous.

6. The getter according to claim 1 wherein said base surface has an undulation.

7. The getter according to claim 1 wherein said base surface is formed by spray coating a base surface composition.

8. The getter according to claim 1 wherein said base surface is formed by fixing a base surface composition powder to a base component by an adhesive material.

9. An airtight chamber which holds an atmospheric pressure or a lower pressure inside, and comprises the getter according to claim 1 inside.

10. An image forming apparatus in which an electron source and an image-forming member for forming an image by irradiation of an electron from the electron source are disposed in an envelope holding an atmospheric pressure or a lower pressure inside, the image forming apparatus comprising: the getter according to claim 1 in said envelope.

11. A getter comprising: a getter layer on a base surface containing a non-evaporable getter material.

12. The getter according to claim 11 which contains at least one of Zr and Ti as the getter material on said base surface.

13. The getter according to claim 11 or 12 wherein said getter layer contains at least Ti.

14. The getter according to claim 11 wherein said base surface has an undulation.

15. The getter according to claim 11 wherein said base surface is porous.

16. The getter according to claim 1 wherein said base surface has an undulation, and said getter layer has a layer thickness smaller than an undulation roughness of said base surface.

17. The getter according to claim 11 wherein said base surface is formed by spray coating a base surface composition.

18. The getter according to claim 11 wherein said base surface is formed by fixing a base surface composition powder to a base component by an adhesive material.

19. The getter according to claim 13 wherein said adhesive material is a hardened material formed by bonding of a silicon atom and an oxygen atom.

20. The getter according to claim 18 wherein said adhesive material is formed by solidifying a liquid adhesive or a gel adhesive.

21. An airtight chamber which holds an atmospheric pressure or a lower pressure inside, and comprises the getter according to claim 11 inside.

22. An image forming apparatus in which an electron source and an image-forming member for forming an image by irradiation of an electron from the electron source are disposed in an envelope holding an atmospheric pressure or a lower pressure inside, the image forming apparatus comprising: the getter according to claim 11 in said envelope.

23. The image forming apparatus according to claim 22 wherein said electron source comprises a plurality of electron-emitters.

24. The image forming apparatus according to claim 23 wherein said electron source and said image forming member constitute planes, and are disposed opposite to each other.

25. A method of manufacturing a getter, comprising the steps of:

forming a base surface containing at least one of Zr and Ti; and forming a getter layer on said base surface.

26. A method of manufacturing a getter, comprising the steps of:

forming a base surface containing at least a non-evaporable getter material; and forming a getter layer on said base surface.

27. The method of manufacturing the getter according to claim 25, further comprising the steps of: exposing said base surface to an atmosphere containing a substance to be absorbed by said base surface before the step of forming the getter layer on said base surface.

28. The method of manufacturing the getter according to claim 26, further comprising the steps of: exposing said base surface to an atmosphere containing a substance to be absorbed by said base surface before the step of forming the getter layer on said base surface.

29. The method of manufacturing the getter according to claim 25 wherein the step of forming the getter layer on said base surface comprises a step of evaporating and depositing a material to form the getter layer.

30. The method of manufacturing the getter according to claim 26 wherein the step of forming the getter layer on said base surface comprises a step of evaporable and depositing a material to form the getter layer.

* * * * *

UNITED STATES PATENT AND TRADEMARK OFFICE

CERTIFICATE OF CORRECTION

PATENT NO. : 6,559,596 B1 Page 1 of 1
DATED : May 6, 2003
INVENTOR(S) : Yutaka Arai et al.

It is certified that error appears in the above-identified patent and that said Letters Patent is hereby corrected as shown below:

Column 10,
Line 55, "burnt/flied." should read -- burnt/fried. --.

Column 25,
Line 51, "V 7.389," should read -- V 7.38%, --.

Column 26,
Line 24, "$1x10^{-9}$ Torr)" should read -- ($1x10^{-9}$ Torr) --.

Column 45,
Lines 5, 7 and 46, "base" should be deleted.

Signed and Sealed this

Fourteenth Day of September, 2004

JON W. DUDAS
*Director of the United States Patent and Trademark Office*